US012680552B2

(12) United States Patent
Yao et al.

(10) Patent No.: US 12,680,552 B2
(45) **Date of Patent: *Jul. 14, 2026**

(54) TURBOMACHINE AND METHOD OF ASSEMBLY

(71) Applicant: General Electric Company, Schenectady, NY (US)

(72) Inventors: Jixian Yao, Niskayuna, NY (US); Trevor Howard Wood, Clifton Park, NY (US); Kishore Ramakrishnan, Rexford, NY (US); William J. Solomon, Montgomery, OH (US); Giridhar Jothiprasad, Clifton Park, NY (US); Aaron J. King, West Harrison, OH (US)

(73) Assignee: General Electric Company, Evendale, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/667,278

(22) Filed: May 17, 2024

(65) Prior Publication Data

US 2024/0301889 A1 Sep. 12, 2024

Related U.S. Application Data

(63) Continuation-in-part of application No. 18/654,444, filed on May 3, 2024, which is a continuation-in-part (Continued)

(51) Int. Cl.

| | |
|---|---|
| ***F04D 29/32*** | (2006.01) |
| ***F04D 19/00*** | (2006.01) |
| ***F04D 29/38*** | (2006.01) |

(52) U.S. Cl.

CPC ..... *F04D 29/384* (2013.01); *F04D 19/002* (2013.01)

(58) Field of Classification Search

None

See application file for complete search history.

(56) References Cited

U.S. PATENT DOCUMENTS

| | | |
|---|---|---|
| 153,456 A | 7/1874 | Paine |
| 167,209 A | 8/1875 | Paine |

(Continued)

FOREIGN PATENT DOCUMENTS

| | | |
|---|---|---|
| CH | 264094 | 9/1949 |
| CN | 1251153 | 4/2000 |

(Continued)

OTHER PUBLICATIONS

Rodrigues et al., Aerodynamic Investigation of a Composite Low-Speed Fan for UHBR Application, Journal of Turbomachinery, TURBO-20-1413, 101004, vol. 143, Issue 10, 2021, 12 pages. https://doi.org/10.1115/1.4050671.

(Continued)

*Primary Examiner* — Kayla Mccaffrey

(74) *Attorney, Agent, or Firm* — Fitch, Even, Tabin & Flannery LLP

(57) ABSTRACT

A turbomachine includes an annular casing, a fan disposed inside the annular casing and mounted for rotation about an axial centerline, and an airfoil. The fan includes fan blades that extend radially outwardly toward the annular casing. The airfoil includes a composite core having a pressure sidewall and a suction sidewall extending between a core leading edge and a core trailing edge and a leading edge protective wrap. The fan has an average chord fan width according to a first performance factor. The fan has a quantity of fan blades according to a second performance factor.

20 Claims, 12 Drawing Sheets

Related U.S. Application Data of application No. 18/511,128, filed on Nov. 16, 2023, which is a continuation of application No. 18/138,442, filed on Apr. 24, 2023, now Pat. No. 11,852,161, which is a continuation-in-part of application No. 17/986,544, filed on Nov. 14, 2022, now Pat. No. 11,661,851.

(56) References Cited

U.S. PATENT DOCUMENTS 2,037,082 A 4/1936 Martin
3,638,428 A 2/1972 Shipley
3,693,749 A * 9/1972 Motsinger ..... F02K 1/827 415/119
3,860,361 A * 1/1975 McMurtry ..... F01D 5/3053 416/127
3,892,612 A 7/1975 Carlson
4,006,999 A 2/1977 Brantley
4,108,572 A * 8/1978 Platt ..... F01D 5/282 416/241 A
4,343,593 A 8/1982 Harris
4,453,890 A 6/1984 Brantley
4,471,020 A 9/1984 McCarthy
4,484,856 A 11/1984 Patacca
4,534,698 A 8/1985 Tomich
4,547,122 A 10/1985 Leech
4,595,340 A 6/1986 Klassen
4,698,964 A 10/1987 Glancy
4,738,594 A 4/1988 Sato
4,810,167 A 3/1989 Spoltman
4,892,462 A 1/1990 Barbier
4,971,641 A 11/1990 Nelson
5,013,216 A 5/1991 Bailey
5,018,271 A 5/1991 Bailey
5,049,036 A 9/1991 Bailey
5,067,876 A 11/1991 Moreman, III
5,088,665 A 2/1992 Vijgen
5,123,814 A 6/1992 Burdick
5,160,248 A 11/1992 Clarke
5,188,505 A 2/1993 Schilling
5,222,297 A 6/1993 Graff
5,226,789 A 7/1993 Donges
5,244,345 A 9/1993 Curtis
5,269,135 A 12/1993 Vermejan
5,273,393 A 12/1993 Jones
5,279,109 A 1/1994 Liu
5,299,914 A 4/1994 Schilling
5,336,044 A 8/1994 Forrester
5,340,280 A 8/1994 Schilling
5,344,280 A 9/1994 Langenbrunner
5,375,978 A 12/1994 Evans
5,392,514 A 2/1995 Cook
5,437,538 A 8/1995 Mitchell
5,439,353 A 8/1995 Cook
5,449,273 A 9/1995 Hertel
5,486,086 A 1/1996 Bellia
5,490,764 A * 2/1996 Schilling ..... F01D 5/16 416/241 B
5,516,257 A 5/1996 Kasprow
5,533,865 A 7/1996 Dassen
5,580,217 A 12/1996 Richards
5,628,622 A 5/1997 Thore
5,634,771 A 6/1997 Howard
5,655,883 A 8/1997 Schilling
5,672,417 A 9/1997 Champenois
5,720,597 A 2/1998 Wang
5,755,558 A 5/1998 Reinfelder
5,785,498 A 7/1998 Quinn
5,823,739 A 10/1998 Van Duyn
5,843,354 A 12/1998 Evans
5,876,651 A 3/1999 Blackburn, Jr.
5,934,609 A 8/1999 Kuklinski
5,965,240 A 10/1999 Blackburn
6,053,696 A 4/2000 Roberts
6,113,347 A 9/2000 Forrester
6,132,857 A 10/2000 Champenois
6,190,133 B1 2/2001 Ress, Jr.
6,217,283 B1 4/2001 Ravenhall
6,416,280 B1 7/2002 Forrester
6,431,498 B1 8/2002 Watts
6,431,837 B1 8/2002 Velicki
6,481,971 B1 11/2002 Forrester
6,497,550 B2 12/2002 Booth
6,829,883 B2 12/2004 Sathianathan
6,830,436 B2 12/2004 Shibata
6,979,172 B1 12/2005 Mackenzie
7,018,168 B2 3/2006 Worthoff
7,153,102 B2 12/2006 Stone
7,338,250 B2 3/2008 Martindale
7,374,403 B2 5/2008 Decker et al.
7,476,086 B2 1/2009 Wadia et al.
7,510,778 B2 3/2009 Bernard
7,575,417 B2 8/2009 Finn
7,735,833 B2 6/2010 Braun
7,744,346 B2 6/2010 Schreiber
7,780,410 B2 8/2010 Kray
7,805,839 B2 10/2010 Cammer
7,918,652 B2 4/2011 Fujimura
7,966,831 B2 6/2011 Kraft
8,021,102 B2 9/2011 Xie
8,083,487 B2 12/2011 Wood
8,137,072 B2 3/2012 Kim
8,137,073 B2 3/2012 Giusti
8,167,546 B2 5/2012 Shi
8,408,874 B2 4/2013 Mccaffrey
8,425,178 B2 4/2013 Lenk
8,454,298 B2 6/2013 Cardarella, Jr.
8,535,008 B2 9/2013 Dewar
8,568,101 B2 10/2013 Fujimura
8,657,570 B2 2/2014 Kray
8,672,609 B2 3/2014 Lussier
8,678,743 B1 3/2014 Sheridan et al.
8,684,689 B2 4/2014 Guo
8,753,065 B2 6/2014 Sheridan et al.
8,770,938 B2 7/2014 Kreiselmaier
8,807,916 B2 8/2014 Sheridan et al.
8,814,494 B1 8/2014 Sheridan et al.
8,851,421 B2 10/2014 Jevons
8,966,754 B2 3/2015 Xie
8,973,374 B2 3/2015 Sharma et al.
8,986,797 B2 3/2015 Xie
9,127,598 B2 9/2015 Snook
9,239,062 B2 1/2016 Lamboy
9,249,666 B2 2/2016 Wood
9,249,681 B2 2/2016 Robertson, Jr.
9,470,097 B2 10/2016 Hodgson
9,523,280 B2 12/2016 Pilpel
9,617,860 B2 4/2017 Lattanzio
9,623,354 B2 4/2017 Kumar
9,664,201 B2 5/2017 Dudon
9,677,570 B2 6/2017 Care
9,745,851 B2 8/2017 Li
9,816,443 B2 11/2017 Sheridan et al.
9,835,046 B2 12/2017 Reed
9,982,598 B2 5/2018 Pritchard, Jr.
10,012,150 B2 7/2018 Gallagher et al.
10,107,200 B2 10/2018 Miller
10,208,676 B2 2/2019 Johnson
10,247,106 B2 4/2019 Dansereau
10,287,992 B2 5/2019 Tan
10,337,352 B2 7/2019 Dubois
10,371,047 B2 8/2019 Schwarz
10,414,487 B2 9/2019 Laurenceau
10,443,411 B2 10/2019 Veitch
10,458,426 B2 10/2019 Wilkin, II et al.
10,502,230 B2 12/2019 Anderson
10,539,025 B2 1/2020 Kray
10,549,842 B2 2/2020 Andrzejewski
10,589,475 B2 3/2020 Kray
10,590,856 B2 3/2020 Howarth
10,677,259 B2 6/2020 Jain
10,794,281 B2 10/2020 Nestico
10,794,288 B2 10/2020 Schwarz
10,815,786 B2 10/2020 Hafner

(56) References Cited

U.S. PATENT DOCUMENTS

| | | | | |
|---|---|---|---|---|
| 10,823,052 | B2 | 11/2020 | Schwarz | |
| 10,830,179 | B2 | 11/2020 | Hatim | |
| 10,837,290 | B2 | 11/2020 | Lee | |
| 10,927,703 | B2 | 2/2021 | Kray | |
| 10,934,939 | B2 | 3/2021 | Miller | |
| 11,661,851 | B1 | 5/2023 | Yao et al. | |
| 11,834,964 | B2 | 12/2023 | Zheng | |
| 11,852,161 | B1 | 12/2023 | Yao | |
| 11,946,391 | B2 | 4/2024 | Gunasekera | |
| 2003/0129061 | A1 | 7/2003 | Finn | |
| 2004/0146393 | A1 | 7/2004 | Evans | |
| 2006/0228206 | A1 | 10/2006 | Decker | |
| 2007/0243068 | A1 | 10/2007 | Wadia | |
| 2008/0159868 | A1 | 7/2008 | Kray | |
| 2008/0175703 | A1* | 7/2008 | Lugg | F02C 7/36 415/199.5 |
| 2008/0187442 | A1 | 8/2008 | Standish | |
| 2008/0253922 | A1 | 10/2008 | Trimmer | |
| 2009/0013532 | A1 | 1/2009 | Wood | |
| 2009/0025365 | A1 | 1/2009 | Schilling | |
| 2009/0074585 | A1 | 3/2009 | Koegler | |
| 2009/0074586 | A1 | 3/2009 | Le Hong | |
| 2009/0136356 | A1 | 5/2009 | Beckford | |
| 2009/0155065 | A1 | 6/2009 | Xie | |
| 2010/0111675 | A1 | 5/2010 | Wojtyczka | |
| 2010/0166562 | A1 | 7/2010 | Boyer | |
| 2010/0329863 | A1 | 12/2010 | Kray | |
| 2011/0027096 | A1 | 2/2011 | Northfield | |
| 2011/0049297 | A1 | 3/2011 | Jevons | |
| 2011/0052383 | A1 | 3/2011 | Lussier | |
| 2011/0182740 | A1 | 7/2011 | Klinetob | |
| 2011/0182741 | A1 | 7/2011 | Alexander | |
| 2011/0211967 | A1 | 9/2011 | Deal | |
| 2011/0229334 | A1 | 9/2011 | Alexander | |
| 2011/0229337 | A1 | 9/2011 | Carper | |
| 2011/0286839 | A1 | 11/2011 | Wojtyczka | |
| 2012/0003100 | A1 | 1/2012 | James | |
| 2012/0020782 | A1 | 1/2012 | Rice | |
| 2012/0021243 | A1 | 1/2012 | Kray | |
| 2012/0099981 | A1 | 4/2012 | Verseux | |
| 2012/0134774 | A1 | 5/2012 | Clark | |
| 2012/0152893 | A1 | 6/2012 | Parkos | |
| 2012/0301291 | A1 | 11/2012 | Spanos | |
| 2012/0301292 | A1 | 11/2012 | Deal | |
| 2013/0028661 | A1 | 1/2013 | Screaton | |
| 2013/0101423 | A1 | 4/2013 | Roy | |
| 2013/0153456 | A1 | 6/2013 | Zhu | |
| 2013/0156592 | A1 | 6/2013 | Kray | |
| 2013/0164488 | A1 | 6/2013 | Wood | |
| 2013/0236323 | A1 | 9/2013 | Mironets | |
| 2013/0269159 | A1 | 10/2013 | Robitaille | |
| 2013/0272893 | A1 | 10/2013 | Fabre | |
| 2013/0323065 | A1 | 12/2013 | Murooka | |
| 2014/0007591 | A1 | 1/2014 | Khibnik et al. | |
| 2014/0030105 | A1 | 1/2014 | Fameau | |
| 2014/0193238 | A1 | 7/2014 | Sheridan | |
| 2014/0212273 | A1 | 7/2014 | Le Borgne | |
| 2014/0212295 | A1 | 7/2014 | Kray | |
| 2014/0219805 | A1 | 8/2014 | Lamboy | |
| 2014/0255152 | A1 | 9/2014 | Totten | |
| 2014/0311149 | A1 | 10/2014 | Chuang | |
| 2015/0016945 | A1 | 1/2015 | Kappes | |
| 2015/0026980 | A1 | 1/2015 | Tellier | |
| 2015/0308290 | A1 | 10/2015 | Kappes | |
| 2015/0361798 | A1 | 12/2015 | Cosby | |
| 2015/0377030 | A1 | 12/2015 | Murdock | |
| 2016/0010468 | A1 | 1/2016 | Kray | |
| 2016/0069214 | A1 | 3/2016 | Engebretsen | |
| 2016/0160659 | A1 | 6/2016 | Obuchi | |
| 2016/0177969 | A1 | 6/2016 | Schreiber | |
| 2016/0265430 | A1 | 9/2016 | Schwarz | |
| 2016/0312795 | A1 | 10/2016 | Crall | |
| 2016/0369703 | A1 | 12/2016 | Gallagher | |
| 2017/0254212 | A1 | 9/2017 | Pautard | |
| 2018/0038243 | A1 | 2/2018 | Rambo | |
| 2019/0022698 | A1 | 1/2019 | Harner | |
| 2019/0071549 | A1 | 3/2019 | Koshi | |
| 2019/0072035 | A1 | 3/2019 | Peace | |
| 2019/0242399 | A1 | 8/2019 | Kray | |
| 2019/0308376 | A1 | 10/2019 | Backhouse | |
| 2021/0108597 | A1 | 4/2021 | Marion | |
| 2021/0269168 | A1 | 9/2021 | Shaner | |
| 2021/0363923 | A1 | 11/2021 | Zysman | |
| 2022/0290572 | A1* | 9/2022 | Gunasekera | F01D 25/005 |
| 2023/0133871 | A1 | 5/2023 | Levisse et al. | |
| 2024/0110518 | A1 | 4/2024 | Miller | |
| 2024/0288000 | A1 | 8/2024 | Yao | |
| 2024/0288001 | A1 | 8/2024 | Yao | |
| 2024/0288002 | A1 | 8/2024 | Yao | |
| 2024/0288003 | A1 | 8/2024 | Yao | |
| 2024/0295224 | A1 | 9/2024 | Yao | |
| 2024/0301890 | A1 | 9/2024 | Yao | |
| 2024/0301891 | A1 | 9/2024 | Yao | |
| 2024/0318660 | A1 | 9/2024 | Yao | |
| 2024/0318661 | A1 | 9/2024 | Yao | |
| 2024/0418180 | A1 | 12/2024 | Yao | |
| 2024/0418181 | A1 | 12/2024 | Yao | |
| 2024/0418182 | A1 | 12/2024 | Yao | |
| 2024/0426316 | A1 | 12/2024 | Yao | |

FOREIGN PATENT DOCUMENTS

| | | | |
|---|---|---|---|
| CN | 1680684 | | 10/2005 |
| CN | 101107424 | | 1/2008 |
| CN | 101107441 | | 1/2008 |
| CN | 101344014 | | 1/2009 |
| CN | 101782000 | | 7/2010 |
| CN | 102121400 | | 7/2011 |
| CN | 102227545 | | 10/2011 |
| CN | 103124834 | | 5/2013 |
| CN | 103244350 | A | 8/2013 |
| CN | 103620165 | | 3/2014 |
| CN | 104508246 | | 4/2015 |
| CN | 105431615 | | 3/2016 |
| CN | 105814285 | | 7/2016 |
| CN | 107829958 | | 3/2018 |
| DE | 93910 | | 9/1897 |
| DE | 4206066 | | 9/1993 |
| DE | 19634296 | | 4/1997 |
| DE | 102006058415 | | 6/2008 |
| DE | 202009003490 | | 6/2009 |
| DE | 102009035689 | | 2/2011 |
| EP | 0526057 | | 2/1993 |
| EP | 0753098 | | 1/1997 |
| EP | 1085172 | | 3/2001 |
| EP | 1972757 | | 9/2008 |
| EP | 1992786 | | 11/2008 |
| EP | 2037082 | | 3/2009 |
| EP | 2050929 | | 4/2009 |
| EP | 2108785 | | 10/2009 |
| EP | 2204535 | | 7/2010 |
| EP | 2348192 | | 7/2011 |
| EP | 2535548 | A2 * | 12/2012 |
| EP | 2586972 | | 5/2013 |
| EP | 2660475 | | 11/2013 |
| EP | 2811143 | | 12/2014 |
| EP | 2870346 | A1 | 5/2015 |
| EP | 3015646 | | 5/2016 |
| EP | 3023588 | | 5/2016 |
| EP | 3034788 | | 6/2016 |
| FR | 910191 | | 5/1946 |
| FR | 2112278 | | 6/1972 |
| FR | 2568308 | | 1/1986 |
| FR | 3127024 | A1 | 3/2023 |
| FR | 3127025 | A1 | 3/2023 |
| FR | 3127269 | A1 | 3/2023 |
| FR | 3129375 | A1 | 5/2023 |
| FR | 3129428 | A1 | 5/2023 |
| FR | 3129432 | A1 | 5/2023 |
| FR | 3129436 | A1 | 5/2023 |
| FR | 3129690 | A1 | 6/2023 |
| FR | 3129970 | A1 | 6/2023 |
| FR | 3129972 | A1 | 6/2023 |
| FR | 3130313 | A1 | 6/2023 |

(56) References Cited

FOREIGN PATENT DOCUMENTS

| | | | |
|---|---|---|---|
| FR | 3130323 | A1 | 6/2023 |
| FR | 3130747 | A1 | 6/2023 |
| FR | 3130874 | A1 | 6/2023 |
| FR | 3130875 | A1 | 6/2023 |
| FR | 3130877 | A1 | 6/2023 |
| FR | 3130879 | A1 | 6/2023 |
| FR | 3130894 | A1 | 6/2023 |
| FR | 3130895 | A1 | 6/2023 |
| FR | 3130896 | A1 | 6/2023 |
| FR | 3130897 | A1 | 6/2023 |
| FR | 3132279 | A1 | 8/2023 |
| FR | 3132729 | A1 | 8/2023 |
| FR | 3132743 | A1 | 8/2023 |
| FR | 3133367 | A1 | 9/2023 |
| FR | 3133368 | A1 | 9/2023 |
| GB | 789883 | | 1/1958 |
| GB | 791563 | | 3/1958 |
| GB | 1187076 | | 4/1970 |
| GB | 1324898 | | 7/1973 |
| GB | 2105791 | | 3/1983 |
| GB | 2482247 | | 1/2012 |
| JP | H0849698 | | 2/1996 |
| JP | 2000087898 | | 3/2000 |
| JP | 2000145402 | | 5/2000 |
| JP | 2000161296 | | 6/2000 |
| JP | 2003056304 | | 2/2003 |
| JP | 2003090300 | | 3/2003 |
| JP | 2003227302 | | 8/2003 |
| JP | 2007321643 | | 12/2007 |
| JP | 2009013984 | | 1/2009 |
| JP | 5773400 | | 9/2015 |
| WO | 9205341 | | 4/1992 |
| WO | 9844240 | | 10/1998 |
| WO | 03076797 | | 9/2003 |
| WO | 2006042401 | | 4/2006 |
| WO | WO2014/008051 | A1 | 1/2014 |
| WO | 2014066503 | A1 | 5/2014 |
| WO | 2014066508 | | 5/2014 |
| WO | 2014133546 | | 9/2014 |
| WO | 2014143262 | | 9/2014 |

OTHER PUBLICATIONS

Polacsek et al., "Turbulence-airfoil Interaction Noise Reduction Using Wavy Leading Edge: An Experimental and Numerical Study", Internoise 2011, Osaka Japan, Sep. 2011.

Smith et al., "Cascade Tests of Serrated Leading Edge Blading at High Subsonic Speeds", National Aeronautics and Space Administration, pp. 1-36, Dec. 1974.

Stimpert et al., "Acoustic Test Results Ffrom a 36 inch (0.914m) Statorless Lift Fan with Serrated and Unserrated Rotor Blades" NASA, pp. 51, Jan. 1, 1975.

"Ceramic composition and properties", Britannica Encyclopedia, Jan. 24, 2011 (Year: 2011).

"Graphite-Epoxy Composites," by Park et al 2011; p. 4 (Year: 2011).

* cited by examiner

TURBOMACHINE AND METHOD OF ASSEMBLY

CROSS REFERENCE TO RELATED APPLICATIONS

This application is a continuation-in-part of application U.S. Ser. No. 18/654,444, filed May 3, 2024, which is a continuation-in-part of application U.S. Ser. No. 18/511,128, filed Nov. 16, 2023, which is a continuation of application U.S. Ser. No. 18/138,442, filed on Apr. 24, 2023, now U.S. Pat. No. 11,852,161, which is a continuation-in-part of application U.S. Ser. No. 17/986,544, filed on Nov. 14, 2022, now U.S. Pat. No. 11,661,851, the contents of all of which are incorporated herein by reference in their entireties.

FIELD

The present disclosure relates generally to jet engines and, more particularly, to jet engine fans.

BACKGROUND

In one form, a gas turbine engine can include a fan and a core arranged in flow communication with one another. The core generally includes, in serial flow order, a compressor section, a combustion section, a turbine section, and an exhaust section. The fan and the core may be partially surrounded by an outer nacelle. In such approaches, the outer nacelle defines a bypass airflow passage with the core.

In operation, air is provided from the fan to an inlet of the compressor section where one or more axial compressors progressively compress the air until it reaches the combustion section. Fuel is mixed with the compressed air using one or more fuel nozzles within the combustion section and burned to provide combustion gases. The combustion gases are routed from the combustion section to the turbine section. The flow of combustion gases through the turbine section drives the turbine section and is then routed through the exhaust section to atmosphere.

BRIEF DESCRIPTION OF THE DRAWINGS

A full and enabling disclosure of the present disclosure, including the best mode thereof, directed to one of ordinary skill in the art, is set forth in the specification, with reference to the appended figures, in which.

Figure 1:
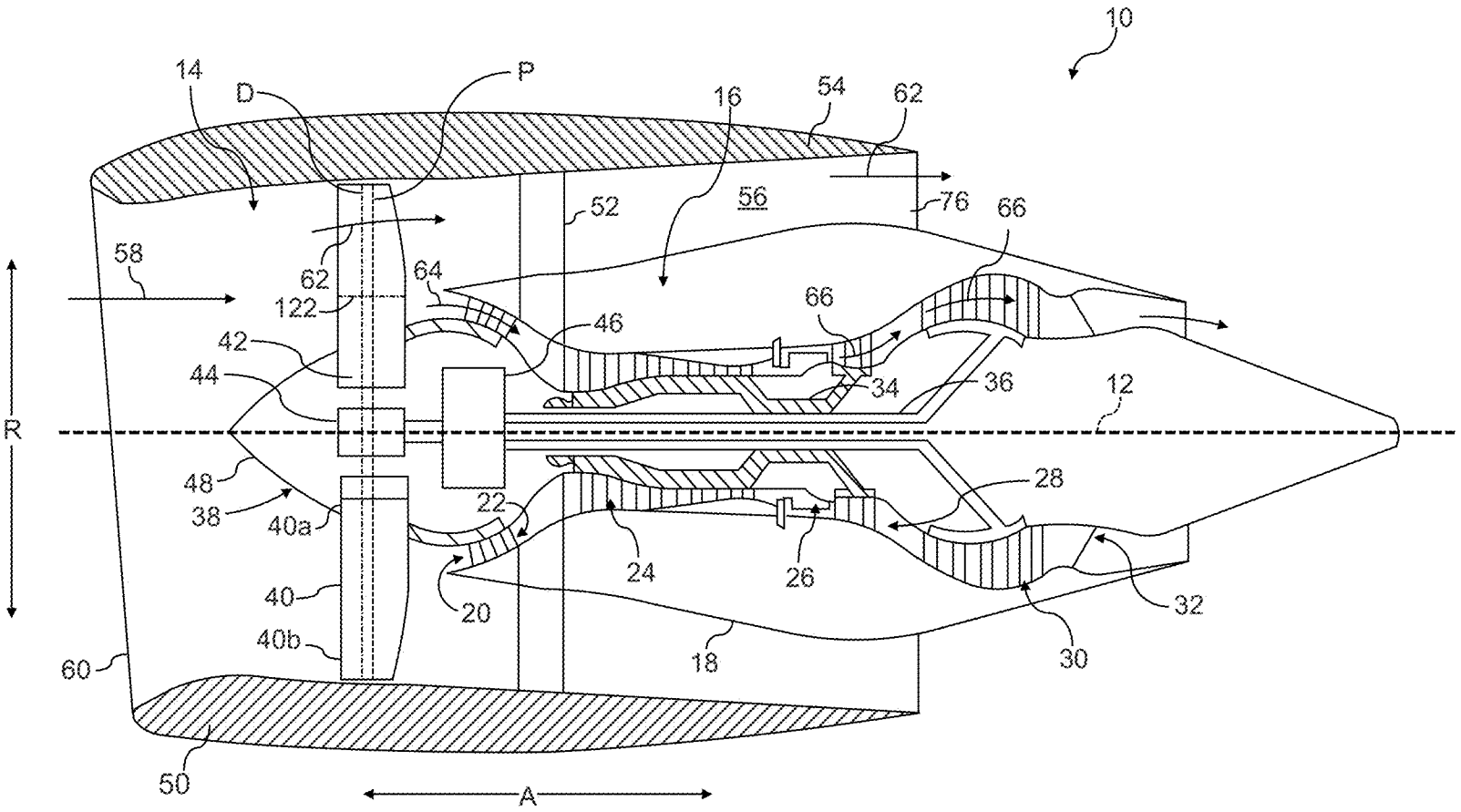
FIG. 1 is a schematic, cross-sectional view of a gas turbine engine in accordance with exemplary aspects of the present disclosure.

Elements in the figures are illustrated for simplicity and clarity and have not necessarily been drawn to scale. For example, the dimensions and/or relative positioning of some of the elements in the figures may be exaggerated relative to other elements to help to improve understanding of variations of the present disclosure. Also, common but well-understood elements that are useful or necessary in a commercially feasible embodiment are often not depicted in order to facilitate a less obstructed view of these variations of the present disclosure. Certain actions and/or steps may be described or depicted in a particular order of occurrence while those skilled in the art will understand that such specificity with respect to sequence is not actually required.

DETAILED DESCRIPTION

Aspects and advantages of the present disclosure will be set forth in part in the following description or may be learned through practice of the present disclosure.

The word "exemplary" is used herein to mean "serving as an example, instance, or illustration." Any implementation described herein as "exemplary" is not necessarily to be construed as preferred or advantageous over other implementations. Additionally, unless specifically identified otherwise, all embodiments described herein should be considered exemplary.

As used herein, the terms "first" and "second" may be used interchangeably to distinguish one component from another and are not intended to signify location or importance of the individual components.

The terms "upstream" and "downstream" refer to the relative direction with respect to a flow in a pathway. For example, with respect to a fluid flow, "upstream" refers to the direction from which the fluid flows, and "downstream" refers to the direction to which the fluid flows.

The terms "radial" or "radially" refer to a direction away from a common center. For example, in the overall context of a turbine engine, radial refers to a direction along a ray extending between a center longitudinal axis of the engine and an outer engine circumference.

The term "composite," as used herein is, refers to a material that includes non-metallic elements or materials. As used herein, a "composite component" or "composite material" refers to a structure or a component including any suitable composite material. A composite material can be a combination of at least two or more non-metallic elements or materials. Examples of a composite material can be, but not limited to, a polymer matrix composite (PMC), a ceramic matrix composite (CMC), a metal matrix composite (MMC), carbon fibers, a polymeric resin, a thermoplastic resin, bismaleimide (BMI) materials, polyimide materials, an epoxy resin, glass fibers, and silicon matrix materials. Composite components, such as a composite airfoil, can include several layers or plies of composite material. The layers or plies can vary in stiffness, material, and dimension to achieve the desired composite component or composite portion of a component having a predetermined weight, size, stiffness, and strength. One or more layers of adhesive can be used in forming or coupling composite components. Adhesives can include resin and phenolics, wherein the adhesive can require curing at elevated temperatures or other hardening techniques.

As used herein, "PMC" refers to a class of materials. By way of example, the PMC material is defined in part by a prepreg, which is a reinforcement material pre-impregnated with a polymer matrix material, such as thermoplastic resin. Non-limiting examples of processes for producing thermoplastic prepregs include hot melt pre-pregging in which the fiber reinforcement material is drawn through a molten bath of resin and powder pre-pregging in which a resin is deposited onto the fiber reinforcement material, by way of non-limiting example electrostatically, and then adhered to the fiber, by way of non-limiting example, in an oven or with the assistance of heated rollers. The prepregs can be in the form of unidirectional tapes or woven fabrics, which are then stacked on top of one another to create the number of stacked plies desired for the part. Multiple layers of prepreg may be stacked to the proper thickness and orientation for the composite component and then the resin is cured and solidified to render a fiber reinforced composite part. Resins for matrix materials of PMCs can be generally classified as thermosets or thermoplastics. Thermoplastic resins are generally categorized as polymers that can be repeatedly softened and flowed when heated and hardened when sufficiently cooled due to physical rather than chemical changes. Notable example classes of thermoplastic resins include nylons, thermoplastic polyesters, polyaryletherketones, and polycarbonate resins. Specific example of high performance thermoplastic resins that have been contemplated for use in aerospace applications include, polyetheretherketone (PEEK), polyetherketoneketone (PEKK), polyetherimide (PEI), polyaryletherketone (PAEK), and polyphenylene sulfide (PPS). In contrast, once fully cured into a hard rigid solid, thermoset resins do not undergo significant softening when heated, but instead thermally decompose when sufficiently heated. Notable examples of thermoset resins include epoxy, bismaleimide (BMI), and polyimide resins.

Instead of using a prepreg, in another non-limiting example, with the use of thermoplastic polymers, it is possible to utilize a woven fabric. Woven fabric can include, but is not limited to, dry carbon fibers woven together with thermoplastic polymer fibers or filaments. Non-prepreg braided architectures can be made in a similar fashion. With this approach, it is possible to tailor the fiber volume of the part by dictating the relative concentrations of the thermoplastic fibers and reinforcement fibers that have been woven or braided together. Additionally, different types of reinforcement fibers can be braided or woven together in various concentrations to tailor the properties of the part. For example, glass fibers, carbon fibers, and thermoplastic fibers could all be woven together in various concentrations to tailor the properties of the part. The carbon fibers provide the strength of the system, the glass fibers can be incorporated to enhance the impact properties, which is a design characteristic for parts located near the inlet of the engine, and the thermoplastic fibers provide the binding for the reinforcement fibers.

In yet another non-limiting example, resin transfer molding (RTM) can be used to form at least a portion of a composite component. Generally, RTM includes the application of dry fibers or matrix material to a mold or cavity. The dry fibers or matrix material can include prepreg, braided material, woven material, or any combination thereof.

Resin can be pumped into or otherwise provided to the mold or cavity to impregnate the dry fibers or matrix material. The combination of the impregnated fibers or matrix material and the resin are then cured and removed from the mold. When removed from the mold, the composite component can require post-curing processing.

It is contemplated that RTM can be a vacuum assisted process. That is, the air from the cavity or mold can be removed and replaced by the resin prior to heating or curing. It is further contemplated that the placement of the dry fibers or matrix material can be manual or automated.

The dry fibers or matrix material can be contoured to shape the composite component or direct the resin. Optionally, additional layers or reinforcing layers of material differing from the dry fiber or matrix material can also be included or added prior to heating or curing.

The singular forms "a," "an," and "the" include plural references unless the context clearly dictates otherwise.

The inventors have sought to maximize efficiency of turbine engines during in-flight propulsion of an aircraft, and correspondingly reduce fuel consumption. In particular, the inventors were focused on how the fan of a ducted turbine engine can be improved. The inventors, in consideration of several different engine architectures proposed, considered how the fan module would need to change to achieve mission requirements, and/or how the fan module could improve upon an existing engine efficiency and/or fuel consumption. The inventors looked at several engine architectures, then determined how the number of fan blades utilized with a fan, average chord width of the fan blades, diameter of the fan blade, fan pressure ratio, fan tip speed, and hub-to-tip ratio affect engine efficiency and/or fuel consumption.

The inventors found that in some engines, an excess number of fan blades may add unnecessary cost to the engine design without appreciable benefit, and may also add unnecessary weight to an aircraft, thereby reducing overall fuel efficiency (e.g., due to increased fuel burn). A reduction in fan blade quantity, however, was found to potentially lead to a reduction in total fan blade area desired for efficient propulsion, fan aeromechanical stability and operability, etc. The inventors considered increasing the width or fan chord of the fan blades to achieve a desired fan blade area with a lower fan blade count. Such considerations were found to be of particular interest when the engine had a higher bypass ratio (i.e., lower fan pressure ratio), and when the engine had a lower blade tip speed.

The determination of the fan blade count and average fan chord for achieving a desired efficiency often required a time consuming, iterative process. As explained in greater detail below, after evaluation of numerous turbine engine architectures having different fan blade counts and average fan chords, it was found, unexpectedly, that there exist certain relationships between a fan or fan blade diameter, a fan pressure ratio, and a redline corrected fan tip Mach number of the turbine engine that identify an average fan chord needed to produce improved results in terms of engine efficiency. It was further found, unexpectedly, that there exist certain relationships between turbine engine parameters including a hub-to-tip ratio of the fan, a fan pressure ratio, and a redline corrected fan tip Mach number of the turbine engine that identify a fan blade count needed to produce improved results in terms of engine efficiency.

Various aspects of the present disclosure describe aspects of an aircraft turbine engine characterized in part by an increased average fan chord width and a reduced blade count, which are believed to result in an improved engine aerodynamic efficiency and/or improved fuel efficiency. According to the disclosure, a turbomachine for powering an aircraft in flight comprises an annular casing and a fan disposed inside the annular casing and mounted for rotation about an axial centerline, the fan including fan blades that extend radially outwardly toward the annular casing.

Reference will now be made in detail to embodiments of the disclosure, one or more examples of which are illustrated in the accompanying drawings, which are incorporated in and constitute a part of this specification, illustrate embodiments of the disclosure and, together with the description, serve to explain the principles of the disclosure. The detailed description uses numerical and letter designations to refer to features in the drawings. Like or similar designations in the drawings and description have been used to refer to like or similar parts of the disclosure.

Referring now to the drawings, FIG. 1 is a schematic, cross-sectional view of a turbomachine, more specifically a gas turbine engine 10, in accordance with an exemplary embodiment of the present disclosure. More particularly, for the embodiment of FIG. 1, the gas turbine engine 10 is a high-bypass turbofan jet engine. gas turbine engine 10 As shown in FIG. 1, the gas turbine engine 10 defines an axial direction A (extending parallel to a longitudinal centerline 12 provided for reference) and a radial direction R. In general, the gas turbine engine 10 includes a fan section 14 and a core turbine engine 16 disposed downstream from the fan section 14.

The exemplary core turbine engine 16 depicted generally includes a substantially tubular outer casing 18 that defines an annular inlet 20. The tubular outer casing 18 encases, in serial flow relationship, a compressor section including a booster, such as a low pressure (LP) compressor 22, and a high pressure (HP) compressor 24; a combustion section 26; a turbine section including a high pressure (HP) turbine 28 and a low pressure (LP) turbine 30; and an exhaust nozzle 32. A high pressure (HP) shaft or spool 34 drivingly connects the HP turbine 28 to the HP compressor 24. A low pressure (LP) shaft or spool 36 drivingly connects the LP turbine 30 to the LP compressor 22.

Fan blades 40 extend outwardly from disk 42 generally along the radial direction R. For the embodiment depicted, the fan section 14 includes a variable pitch fan 38 having a plurality of fan blades 40 coupled to a disk 42 in a spaced apart manner. One or more of the fan blades 40 may rotatable relative to the disk 42 about a pitch axis P by virtue of the fan blades 40 being operatively coupled to a suitable actuator 44 configured to vary the pitch of the fan blades 40, typically collectively in unison. In some approaches, the fan is a fixed pitch fan and actuator 44 is not present. The fan blades 40, disk 42, and actuator 44 may be together rotatable about the longitudinal centerline 12 by LP spool 36 across a power gear box 46. The power gear box 46 includes a plurality of gears for stepping down the rotational speed of the LP spool 36 to a more efficient rotational fan speed. In some approaches, the LP spool 36 may directly drive the fan without power gear box 46.

The power gear box 46 can include a plurality of gears, including an input and an output, and may also include one or more intermediate gears disposed between and/or interconnecting the input and the output. The input can comprise a first rotational speed and the output can have a second rotational speed. In some examples, a gear ratio of the first rotational speed to the second rotational speed is equal to or greater than 3.2 and equal to or less than 5.0 The power gear box 46 can comprise various types and/or configurations. In some examples, the power gear box 46 is a single-stage gear box. In other examples, the power gear box 46 is a multi-stage gear box. In some examples, the power gear box 46 is an epicyclic gearbox. In some examples, the power gear box 46 is a non-epicyclic gear box (e.g., a compound gearbox). More particularly, in some instances, the power gear box 46 is an epicyclic gear box configured in a star gear configuration. Star gear configurations comprise a sun gear, a plurality of star gears (which can also be referred to as "planet gears"), and a ring gear. The sun gear is the input and is coupled to the power turbine (e.g., the low-pressure turbine) such that the sun gear and the power turbine rotate at the same rotational speed. The star gears are disposed between and interconnect the sun gear and the ring gear. The star gears are rotatably coupled to a fixed carrier. As such, the star gears can rotate about their respective axes but cannot collectively orbit relative to the sun gear or the ring gear. As another example, the power gear box 46 is an epicyclic gear box configured in a planet gear configuration. Planet gear configurations comprise a sun gear, a plurality of planet gears, and a ring gear. The sun gear is the input and is coupled to the power turbine. The planet gears are disposed between and interconnect the sun gear and the ring gear.

The planet gears are rotatably coupled to a rotatable carrier. As such, the planet gears can rotate about their respective axes and also collectively rotate together with the carrier relative to the sun gear and the ring gear. The carrier is the output and is coupled to the fan assembly. The ring gear is fixed from rotation.

Referring still to the exemplary embodiment of FIG. 1, the disk 42 is covered by rotatable front hub 48 aerodynamically contoured to promote an airflow through the plurality of fan blades 40. Additionally, the exemplary fan section 14 includes an annular fan casing or outer nacelle 50 that circumferentially surrounds the variable pitch fan 38 and/or at least a portion of the core turbine engine 16. It should be appreciated that the outer nacelle 50 may be configured to be supported relative to the core turbine engine 16 by a plurality of circumferentially spaced outlet guide vanes 52. Moreover, a downstream section 54 of the outer nacelle 50 may extend over an outer portion of the core turbine engine 16 so as to define a bypass airflow passage 56 therebetween.

During operation of the gas turbine engine 10, a volume of air 58 enters the gas turbine engine 10 through an associated inlet 60 of the outer nacelle 50 and/or fan section 14. As the volume of air 58 passes across the fan blades 40, a first portion 62 of the air 58, as indicated by arrow 62, is directed or routed into the bypass airflow passage 56 and a second portion 64 of the air 58, as indicated by arrow 64, is directed or routed into the LP compressor 22. The ratio between the first portion 62 of air 58 and the second portion 64 of air 58 is commonly known as a bypass ratio. The pressure of the second portion 64 of air 58 is then increased as it is routed through the HP compressor 24 and into the combustion section 26, where it is mixed with fuel and burned to provide combustion gases 66. Subsequently, the combustion gases 66 are routed through the HP turbine 28 and the LP turbine 30, where a portion of thermal and/or kinetic energy from the combustion gases 66 is extracted.

The combustion gases 66 are then routed through the exhaust nozzle 32 of the core turbine engine 16 to provide propulsive thrust. Simultaneously, the pressure of the first portion 62 of air 58 is substantially increased as the first portion 62 of air 58 is routed through the bypass airflow passage 56 before it is exhausted from a fan nozzle exhaust section 76 of the gas turbine engine 10, also providing propulsive thrust.

It should be appreciated, however, that the gas turbine engine 10 depicted in FIG. 1 is by way of example only, and that in other exemplary embodiments, aspects of the present disclosure may additionally, or alternatively, be applied to any other suitable gas turbine engine. For example, in other exemplary embodiments, the gas turbine engine 10 may instead be any other suitable aeronautical gas turbine engine, such as a turbojet engine, turboshaft engine, turboprop engine, etc. Additionally, in still other exemplary embodiments, the gas turbine engine 10 may include or be operably connected to any other suitable accessory systems. Additionally, or alternatively, the exemplary gas turbine engine 10 may not include or be operably connected to one or more of the accessory systems discussed above.

The fan blades 40 of the gas turbine engine 10 may be made from a PMC material with metal leading edges to protect the airfoil from foreign objects, such as bird strikes. A polymer matrix composite (PMC) material for the airfoil can be more durable and/or exhibit improved performance when the airfoil is subjected to flutter effects during operation. In some embodiments, engines with fewer fan blades (e.g., less than 25 fan blades) and wider chords (c), such as engines having a blade count (BC) from 14 and 18, or 16 to 20 fan blades and ratios of chord to diameter (c/D) of greater than 0.17, or greater than 0.19, and less than 0.3 (e.g., less than 0.21) have the fan blade airfoil made from a PMC material with metal leading edge.

Figure 2:
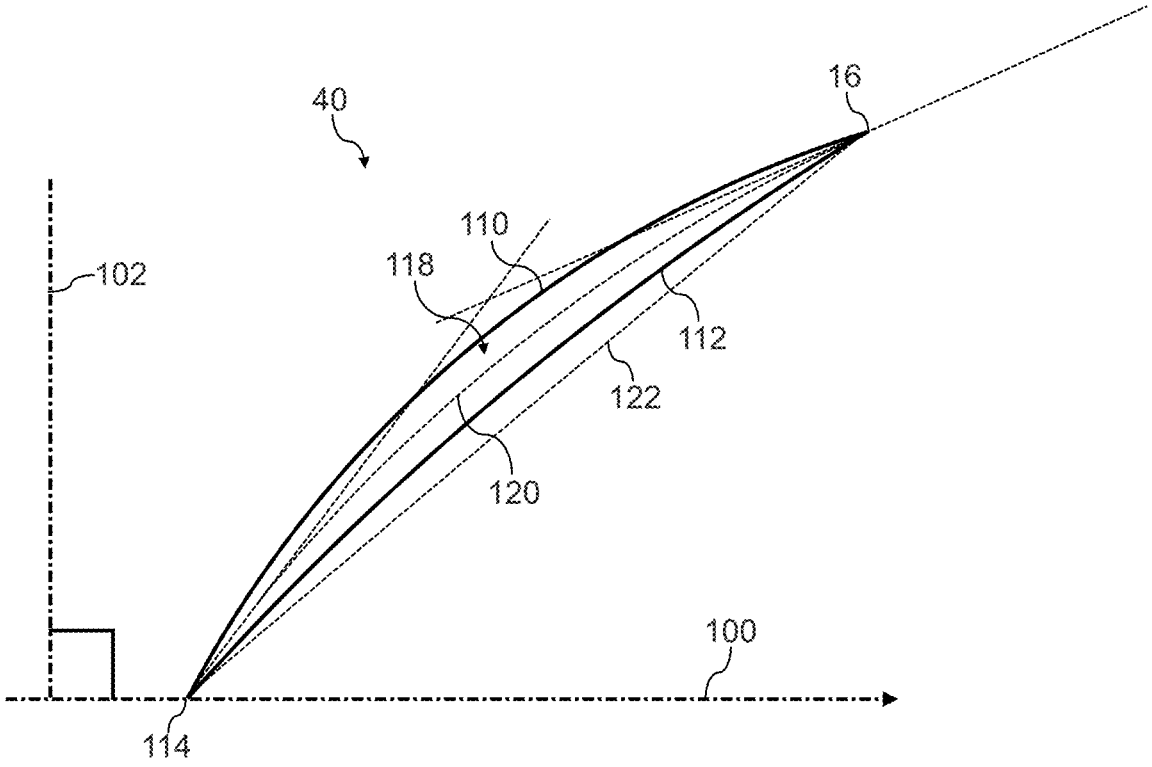
FIG. 2 is a sectional view of a fan blade in accordance with exemplary aspects of the present disclosure.

FIG. 2 is a sectional view of a fan blade 40 viewed radially (e.g., towards the rotation axis). A first axis 100 is parallel to the axial direction A of FIG. 1, and a second axis 102 is parallel to the circumferential direction θ.

Fan blade 40 includes a low-pressure surface 110 and an opposite high-pressure surface 112 that each extend between a proximal end 40*a* and a distal end 40*b* of the fan blade 40 (shown in FIG. 1). Fan blade 40 further includes a leading edge 114 and a trailing edge 116.

The low-pressure surface 110, high-pressure surface 112, leading edge 114, and trailing edge 116 form a profile 118 of the fan blade 40. The profile 118 defines a mean camber 120 that extends from the leading edge 114 to the trailing edge 116 and that is equidistant from the low-pressure surface 110 and the high-pressure surface 112.

The profile 118 further defines a local chord 122 (relative to a specific cross section through the blade) that represents a straight-line distance from the leading edge 114 to the trailing edge 116.

In some approaches, a fan blade 40 may have a profile 118 that varies along a radial height of the fan blade 40 between the proximal end 40*a* and the distal end 40*b*. For example, in some fan blade designs, a distance between the leading edge 114 and the trailing edge 116 may be greater at the proximal end 40*a* of the fan blade 40 than at the distal end 40*b*. As such, the length of the local chord 122 may vary along the radial height of the fan blade 40. In this way, an average chord line length may be derived for the fan blade that accounts for the variation in lengths of the local chord 122 along the radial height of the fan blade 40.

As mentioned earlier, the inventors have discovered relationships between timescales that include a fan pressure ratio, fan diameter, and corrected fan tip Mach number during the course of improving upon the fan module portion of various engine architectures. More particularly, and as discussed in greater detail below, the inventors have discovered relationships between ratio of axial flow timescales to rotation timescales, and suitable parameters for implementing those relationships with an engine.

The aircraft turbine engine architectures developed by the inventors include as major components a fan module and an engine core. The core includes one or more compressor stages and turbine stages. Compressor stages typically include high pressure and low pressure compressor stages, and turbines similarly include high and low pressure stages. The fan module that provides for an improved efficiency is not independent of these other parts of the engine, because there is always a trade benefit when one part is improved or modified. Improved efficiency brought by the fan can be in terms of a reduction in weight, lower installed drag, load balancing or management (dynamic or static loading), aerodynamic efficiency through the fan duct/interaction of fan to output guide vanes, and other factors. In an effort to improve upon what the fan can deliver (positive benefit of fan design) there often times need to be sacrifices in other parts of the engine (negative benefit of fan design). Or the benefits of a new fan design when viewed independent of a particular core design or airframe requirement, often times requires revision or is unrealistic given the impact that such a fan design will have on other parts of the engine, e.g., compressor operating margin, balance of a fan and output guide vanes (OGV) along with a power gearbox, and location of a low pressure compressor (packaging impacts). The teachings described herein are also applicable to other engine architectures such as electrically-driven fans (which may or may not include a turbine) and hybrid electrically-driven fans (e.g., distributed electric propulsion systems in which a gas turbine drives multiple fans).

The inventors, proceeding in the manner of designing improved fan modules, accounting for the trade-offs between fan module improvements and other potentially negative or limitations on fan module design, unexpectedly found certain relationships that define an improved fan design, now described in detail.

In one aspect, the inventors have discovered a relationship between an average fan chord "c", a fan diameter "D" (e.g., a tip-to-tip dimension of the fan), a fan pressure ratio "FPR" of a fan, and a corrected redline fan tip Mach number $$\text{“}M_{tip,c}^{(RL)}\text{”}$$

according to the below relationship, referred to herein as the First Performance Factor ("FPF") for a fan module:

$$FPF = \left[\frac{c}{0.15 \cdot D}\right] \Big/ \left[\left[\frac{\sqrt{FPR-1}}{\sqrt{0.4}}\right] \Big/ M_{tip,c}^{(RL)}\right] - 1.23 \tag{1}$$

$$m_1 \cdot \left[M_{tip,c}^{(RL)} - 1.1\right] + 6 > FPF > m_1 \cdot \left[M_{tip,c}^{(RL)} - 1.1\right] + \Delta y_1 \tag{2}$$

The ratio of average fan chord "c" to fan diameter "D" is a nondimensionalized chord width ratio greater than 0.1

(e.g., greater than 0.15, greater than 0.17, or greater than 0.19), and less than 0.3 (e.g., less than 0.21).

As used herein, the "fan pressure ratio" (FPR) refers to a ratio of a stagnation pressure immediately downstream of the plurality of outlet guide vanes 52 during operation of the fan 38 to a stagnation pressure immediately upstream of the plurality of fan blades 40 during the operation of the fan 38. The "$\sqrt{FPR-1}$" portion of the average fan chord relationship may be utilized as a surrogate for referencing a proportionality to the increase in axial flow velocity through the fan. The fan pressure ratio is greater than 1.2 (e.g., greater than 1.3), and less than 1.5 (e.g., less than 1.45, less than 1.42, or less than 1.4).

As used herein, $$\text{“}M_{tip,c}^{(RL)}\text{”}$$

is a corrected fan tip Mach number at redline (e.g., maximum permissible rotational speed of the fan at a redline shaft speed, which is either directly coupled to the fan or through a reduction gearbox). "Fan tip speed" refers to a linear speed of an outer tip of a fan blade 40 during operation of the fan 38. "Corrected fan tip speed" (referred to as "$U_{tip,c}$") may be provided, for example, as ft/sec divided by an industry standard temperature correction. In an example approach, $U_{tip,c}$ may be less than 1,500 ft/sec (e.g., less than 1,250 ft/sec or less than 1,100 ft/sec), and greater than 500 ft/sec. "Corrected fan tip Mach number" refers to a nondimensionalized value obtained by dividing $U_{tip,c}$ by the generally accepted speed of sound at standard day sea level atmospheric conditions (i.e., 1,116.45 ft/sec). As such, $$M_{tip,c}^{(RL)}$$

may be less than 1.34 (e.g., less than 1.12 or less than 0.99), and greater than 0.45.

FPF, as defined in (1), may be thought of as representing a ratio of speeds. When considered with the normalized chord width "c/D," FPF may be thought of as a correlation of timescales of the blade rotation with the time taken for a flow particle to traverse a fan average chord length when the engine is operating at static conditions.

Figure 3:
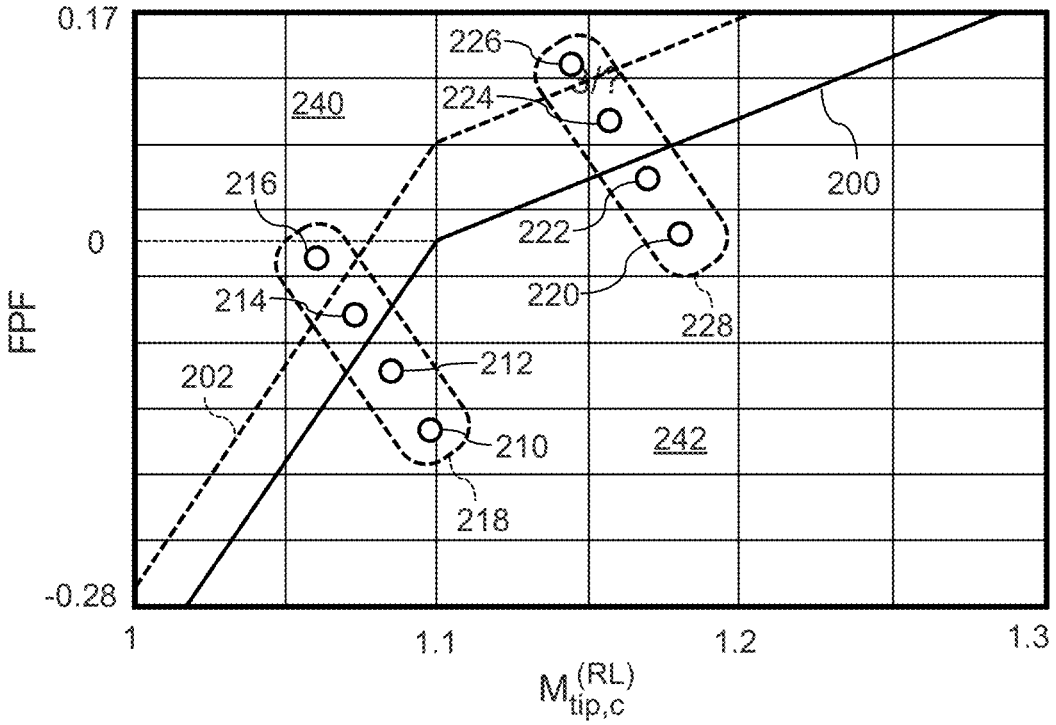
FIG. 3 shows first example engines arranged on a first plot in accordance with a first performance factor for a fan module according to the present disclosure.

Referring to the inequality defined in (2) and to the plot of FIG. 3, example engine embodiments are shown having unique FPF values and corresponding redline corrected fan tip Mach number $$\left(M_{tip,c}^{(RL)}\right).$$

FPF increases in value along the Y-axis, while the X-axis represents left-to-right increasing redline corrected fan tip Mach number $$\left(M_{tip,c}^{(RL)}\right).$$

FIG. 3 also shows a first line 200 and a second line 202 that is offset from the first line 200 along the Y-axis. The first and second lines 200, 202 are defined by the $$\text{“}m_1 \cdot \left[M_{tip,c}^{(RL)} - 1.1\right] + \Delta y_1\text{”}$$

portion of inequality (2). As used herein, "$m_1$" refers to a slope of a line 200, 202, "1.1" refers to a reference corrected redline tip Mach number at which Y-intercept is defined in the FPF, and $\Delta y_1$ refers an offset from the Y-intercept along the Y-axis.

As shown in FIG. 3, the first and second lines 200, 202 are piecewise linear dividing curves; i.e., the first and second lines 200, 202 have different slopes "m" depending on the $$M_{tip,c}^{(RL)}$$

along the X-axis. More particularly, when the value of $$M_{tip,c}^{(RL)}$$

is equal to or greater than 1.1, the first and second lines 200, 202 have slopes "$m_1$" equal to 0.87. When the value of $$M_{tip,c}^{(RL)}$$

is less than 1.1, the first and second lines 200, 202 have slopes "$m_1$" equal to 3.34. While depicted as piecewise linear dividing curves, the low-speed scaling is actually nonlinear and there are advantages to lower c/D designs toward the lower portion of the plot of FIG. 3 associated with lower FPR and lower $$M_{tip,c}^{(RL)}.$$

As discussed, $\Delta y_1$ refers an offset from the Y-intercept along the Y-axis. The $\Delta y_1$ value can be 0.0125, 0.04, 0.07, 0.1, or 0.2, or can vary between 0 and 6, 0 and 0.0125, 0.0125 and 0.04, 0.04 and 0.07, 0.07 and 0.1, 0.1 and 0.2, or a value greater than 0.2 and less than 6.

FIG. 3 shows eight example engine embodiments, of which gas turbine engines 210, 212, 214, 216 may be referred to as low speed engine designs (as indicated by subplot area 218), and engines 220, 222, 224, 226 may be referred to as high speed engine designs (as indicated by subplot area 228). Each of the gas turbine engines 210, 212, 214, 216, 220, 222, 224, 226 have a gear ratio in a range equal to or greater than 3.2 and less than or equal to 5.0.

As represented by the FPF, which indicates a particular fan chord relationship, the inventors discovered a limited or narrowed selection of average fan chords that uniquely take into consideration other factors associated with the fan and engine type. For instance, the inventors determined that an engine having an FPF value for a given $$M_{tip,c}^{(RL)}$$

value above line 200 (within plot area 240) may allow for relatively wider chord widths as compared to engines having an FPF value for a given $$M_{tip,c}^{(RL)}$$

value below line 200 (within plot area 242). In this way, gas turbine engines 214, 216, 224, and 226 may provide advantages over gas turbine engines 210, 212, 220, and 222, such as a reduced fan blade count (discussed in greater detail below), increased aeromechanical stability and reduced fan lift coefficient $C_L$ during takeoff of the aircraft. In some instances, such advantages may become more pronounced as FPF increases and $$M_{tip,c}^{(RL)}$$

value decreases (for next generation ultra-high bypass ratio engines for instance). For example, the improvement in engine performance based on the redline tip Mach number may have FPF values greater than $$m_1 \cdot \left[M_{tip,c}^{(RL)} - 1.1\right] + 0.0125,$$

greater than $$m_1 \cdot \left[M_{tip,c}^{(RL)} - 1.1\right] + 0.04,$$

greater than $$m_1 \cdot \left[M_{tip,c}^{(RL)} - 1.1\right] + 0.07,$$

greater than $$m_1 \cdot \left[M_{tip,c}^{(RL)} - 1.1\right] + 0.1,$$

or greater than $$m_1 \cdot \left[M_{tip,c}^{(RL)} - 1.1\right] + 0.2$$

(these other examples are schematically represented by the phantom line 202).

In another aspect, the inventors have discovered a relationship between a fan blade count "BC", a hub-to-tip ratio of a fan "HTR", a fan pressure ratio "FPR" of a fan, and a corrected redline fan tip Mach number $$\text{“}M_{tip,c}^{(RL)}\text{”}$$

according to the below relationship, referred to herein as the Second Performance Factor ("SPF") for a fan module:

$$SPF = \sqrt{\frac{\pi}{4}\left(1 - HTR^2\right) \Big/ \left(\frac{BC}{20}\right)} \Big/ \left(\frac{\sqrt{FPR - 1}}{\sqrt{0.4}}\right) \Big/ M_{tip,c}^{(RL)} - 0.97 \tag{3}$$

$$m_2 \cdot \left[M_{tip,c}^{(RL)} - 1.1\right] + 1.5 > SPF > m_2 \cdot \left[M_{tip,c}^{(RL)} - 1.1\right] + \Delta y_2 \tag{4}$$

Regarding the hub-to-tip ratio "HTR," a fan blade defines a hub radius ($R_{hub}$), which is the radius of the leading edge at the hub relative to a centerline of the fan, and a tip radius ($R_{tip}$), which is the radius of the leading edge at a tip of the fan blade relative to the centerline of the fan. HTR is the ratio of the hub radius to the tip radius ($R_{hub}/R_{tip}$). The ratio is greater than 0.1 and less than 0.5 (e.g., less than 0.275, less than 0.25, or less than 0.225).

Blade count "BC" corresponds to the number of fan blades circumferentially arranged about the fan hub. The blade count is between 10 fan blades and 40 fan blades. In certain example approaches, the blade count is less than or equal to 18 fan blades (e.g., 16 or fewer fan blades).

"FPR" and $$\text{“}M_{tip,c}^{(RL)}\text{”}$$

refer to a fan pressure ratio and a redline corrected fan tip Mach number, respectively, as discussed with respect to the average fan chord relationship above. In this way, the values of one or more of the FPR and $$\text{“}M_{tip,c}^{(RL)}\text{”}$$

may be the same as those discussed with respect to the average fan chord relationship.

Figure 4:
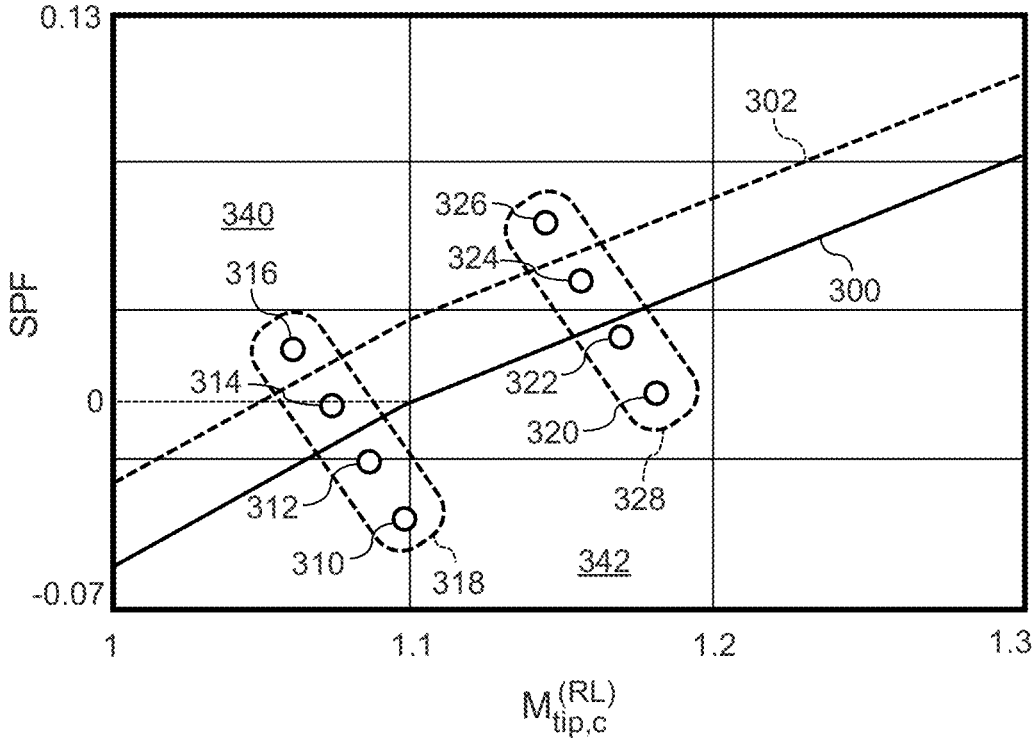
FIG. 4 shows second example engines arranged on a second plot in accordance with a second performance factor for a fan module according to the present disclosure.

Referring to the inequality defined in (4) and to the plot of FIG. 4, example engine embodiments are shown having unique SPF values and corresponding redline corrected fan tip Mach number $$\left(M_{tip,c}^{(RL)}\right).$$

SPF increases in value along the Y-axis, while the X-axis represents left-to-right increasing redline corrected fan tip Mach number $$\left(M_{tip,c}^{(RL)}\right).$$

FIG. 4 also shows a first line 300 and a second line 302 that is offset from the first line 300 along the Y-axis. The first and second lines 300, 302 are defined by the $$\text{“}m_2 \cdot \left[M_{tip,c}^{(RL)} - 1.1\right] + \Delta y_2\text{”}$$

portion of inequality (4).

As shown in FIG. 4, the first and second lines 300, 302 are piecewise linear dividing curves; i.e., the first and second lines 300, 302 have different slopes "$m_2$" depending on the $$M_{tip,c}^{(RL)}$$

along the X-axis. More particularly, when the value of $$M_{tip,c}^{(RL)}$$

is equal to or greater than 1.1, the first and second lines 300, 302 have slopes "$m_2$" equal to 0.41. When the value of $$M_{tip,c}^{(RL)}$$

is less than 1.1, the first and second lines 300, 302 have slopes "$m_2$" equal to 0.55.

As used herein, "$m_2$" refers to a slope of a line 300, 302, which as shown, is equal to 1. "1.1" refers to a reference corrected redline tip Mach number at which the Y-intercept is defined, and $\Delta y_2$ refers an offset from the Y-intercept along the Y-axis. The $\Delta y_2$ value can be 0.0075, 0.01, 0.02, 0.024, 0.037, 0.04, or 0.06, or can vary between 0 and 1.5, 0 and 0.0075, 0.0075 and 0.01, 0.01 and 0.2, 0.2 and 0.024, 0.024 and 0.037, 0.037 and 0.04, 0.04 and 0.6, or a value greater than 0.6 and less than 1.5.

FIG. 4 shows eight example engine embodiments, of which gas turbine engines 310, 312, 314, 316 may be referred to as low speed engine designs (as indicated by subplot area 318), and engines 320, 322, 324, 326 may be referred to as high speed engine designs (as indicated by subplot area 328). Each of the gas turbine engines 310, 312, 314, 316, 320, 322, 324, 326 have a gear ratio a range equal to or greater than 3.2 and less than or equal to 5.0.

As represented by the SPF, which indicates a particular fan blade count relationship, the inventors discovered a limited or narrowed selection of fan blade count that uniquely take into consideration other factors associated with the fan and engine type. For instance, the inventors determined that an engine having an SPF value for a given $$M_{tip,c}^{(RL)}$$

value above line 300 (within plot area 340) may allow for reduced fan blade counts as compared to engines having an SPF value for a given $$M_{tip,c}^{(RL)}$$

value below line 300 (within plot area 342). In this way, gas turbine engines 314, 316, 324, and 326 may provide advantages over gas turbine engines 310, 312, 320, and 322, such as a reduced cost and weight. In some instances, such advantages may become more pronounced as the SPF value increases and the $$M_{tip,c}^{(RL)}$$

value decreases (for next generation ultra-high bypass ratio engines for instance). For example, the improvement in engine performance based on the redline tip Mach number may have SPF values greater than $$m_2 \cdot \left[M_{tip,c}^{(RL)} - 1.1\right] + 0.0075,$$

greater than $$m_2 \cdot \left[M_{tip,c}^{(RL)} - 1.1\right] + 0.01,$$

greater than $$m_2 \cdot \left[M_{tip,c}^{(RL)} - 1.1\right] + 0.02,$$

greater than $$m_2 \cdot \left[M_{tip,c}^{(RL)} - 1.1\right] + 0.024,$$

greater than $$m_2 \cdot \left[M_{tip,c}^{(RL)} - 1.1\right] + 0.037,$$

greater than $$m_2 \cdot \left[M_{tip,c}^{(RL)} - 1.1\right] + 0.04,$$

or greater than $$m_2 \cdot \left[M_{tip,c}^{(RL)} - 1.1\right] + 0.06$$

(these other examples are schematically represented by the phantom line 302).

Figure 5:
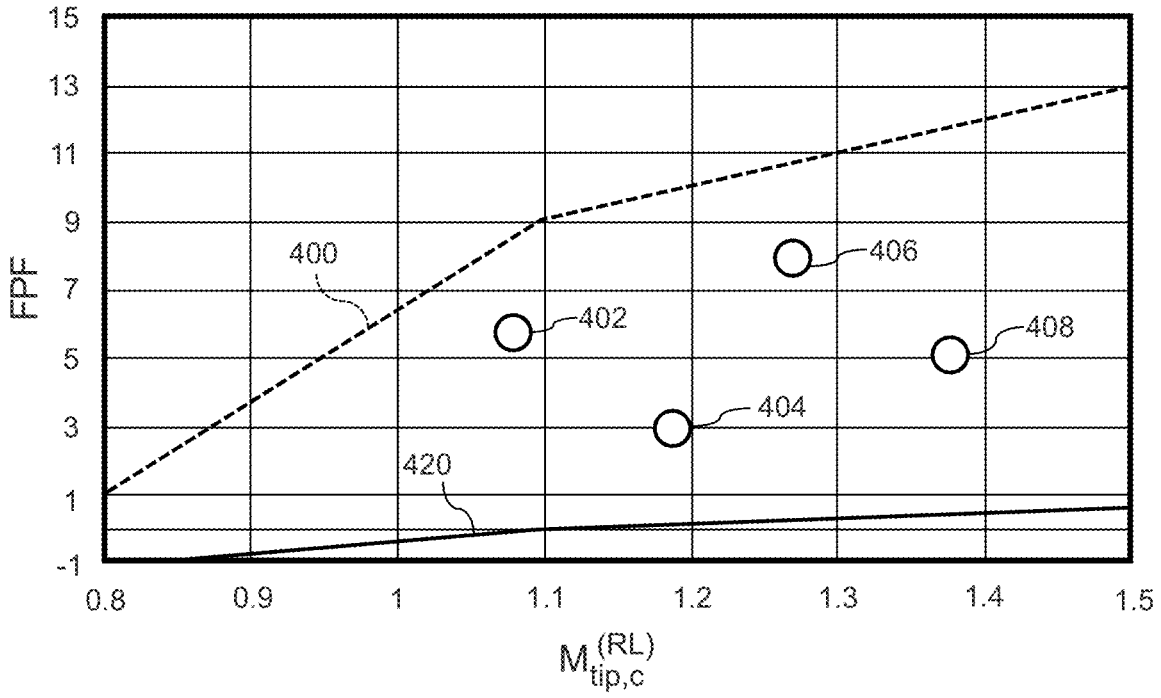
FIG. 5 shows third example engines arranged on a third plot in accordance with the first performance factor for a fan module according to the present disclosure.

FIG. 5 shows additional example engine embodiments 402, 404, 406, 408 having First Performance Factor (FPF) values, as similarly described herein. Line 400 is a piecewise linear dividing curve having different slopes "$m_1$" depending on the $$M_{tip,c}^{(RL)}$$

along the X-axis. More particularly, when the value of $$M_{tip,c}^{(RL)}$$

is equal to or greater than 1.1, line 400 has a slope "$m_1$" equal to 9.43. When the value of $$M_{tip,c}^{(RL)}$$

is less than 1.1, line 400 has a slope "$m_1$" equal to 27.02.

Line 420 corresponds to line 200 of FIG. 3 and is similarly a piecewise linear dividing curve having different slopes "$m_2$" depending on the $$M_{tip,c}^{(RL)}$$

along the X-axis. As with FIG. 3, when the value of $$M_{tip,c}^{(RL)}$$

is equal to or greater than 1.1, the line 420 has a slope "$m_2$" equal to 0.87. When the value of $$M_{tip,c}^{(RL)}$$

is less than 1.1, line 420 has a slope "$m_2$" equal to 3.34.

In this approach, the First Performance Factor (FPF) is as provided:

$$FPF = \left[\frac{c}{0.15 \cdot D}\right] \Big/ \left[\left[\frac{\sqrt{FPR-1}}{\sqrt{0.4}}\right] \Big/ M_{tip,c}^{(RL)}\right] - 1.23 \tag{5}$$

$$m_1 \cdot \left[M_{tip,c}^{(RL)} - 1.1\right] + 9.14 > FPF > m_2 \cdot \left[M_{tip,c}^{(RL)} - 1.1\right] \tag{6}$$

The First Performance Factor (FPF) values may be in the range, for example, equal to or greater than −0.8 and equal to or less than 8.4, equal to or greater than 0 and equal to or less than 6, or equal to or greater than 1 and equal to or less than 2.

$$M_{tip,c}^{(RL)}$$

values may be within a range equal to or greater than 0.8 and equal to or less than 1.5, or equal to or greater than 0.9 and equal to or less than 1.4. FPR values may be within a range equal to or greater than 1.2 and equal to or less than 1.6, equal to or greater than 1.3 and equal to or less than 1.5, or equal to or greater than 1.35 and equal to or less than 1.45.

Figure 6:
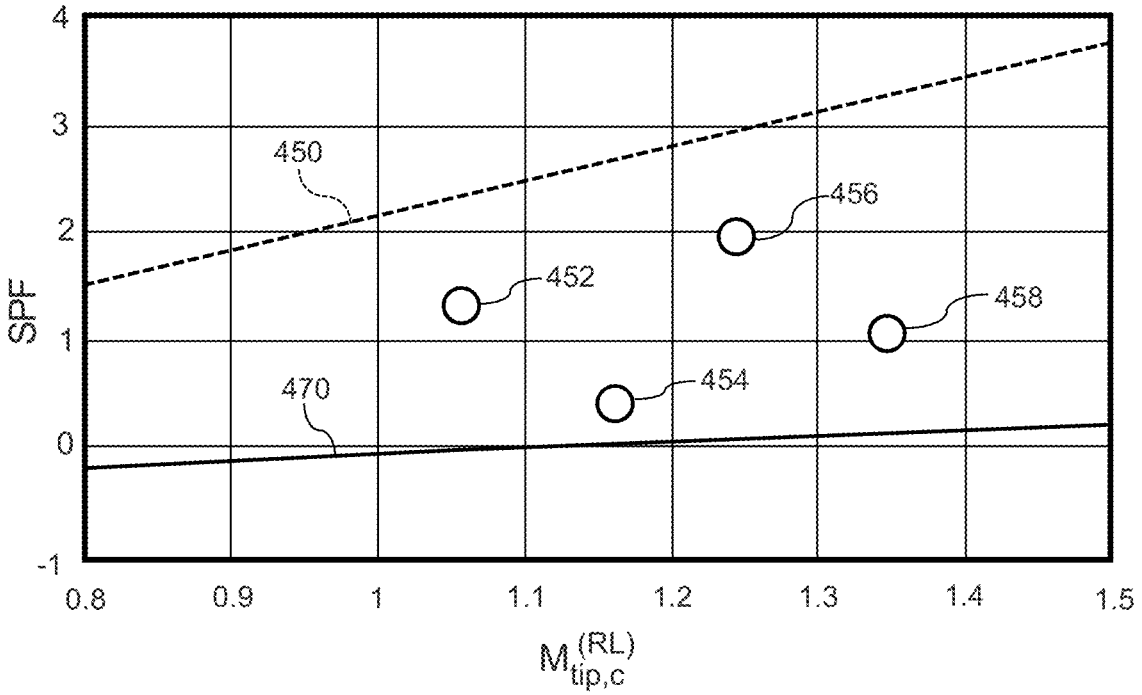
FIG. 6 shows fourth example engines arranged on a fourth plot in accordance with the second performance factor for a fan module according to the present disclosure.

FIG. 6 shows additional example engine embodiments 452, 454, 456, 458 having Second Performance Factor (SPF) values, as similarly described herein. Line 450 is a linear curve having slope "$m_3$" of 3.17. Line 470 corresponds to line 300 of FIG. 4 and is similarly a piecewise linear dividing curve having different slopes "$m_4$" depending on the $$M_{tip,c}^{(RL)}$$

along the X-axis. More particularly, when the value of $$M_{tip,c}^{(RL)}$$

is equal to or greater than 1.1, line 470 has a slope "$m_4$" equal to 0.41. When the value of $$M_{tip,c}^{(RL)}$$

is less than 1.1, line 420 has a slope "$m_4$" equal to 0.55.

In this approach, the Second Performance Factor (SPF) is as provided:

$$SPF = \sqrt{\frac{\pi}{4}\left(1 - HTR^2\right) \Big/ \left(\frac{BC}{20}\right)} \Big/ \left(\frac{\sqrt{FPR-1}}{\sqrt{0.4}}\right) \Big/ M_{tip,c}^{(RL)} - 0.97 \tag{7}$$

$$m_3 \cdot \left[M_{tip,c}^{(RL)} - 1.1\right] + 2.52 > SPF > m_4 \cdot \left[M_{tip,c}^{(RL)} - 1.1\right] \tag{8}$$

The Second Performance Factor (SPF) values may be in the range, for example, equal to or greater than 0.087 and equal to or less than 2.4, or equal to or greater than 1 and equal to or less than 2.

$$M_{tip,c}^{(RL)}$$

values may be within a range equal to or greater than 0.8 and equal to or less than 1.5, or equal to or greater than 0.9 and equal to or less than 1.4. HTR values may be within a range equal to or greater than 0.2 and equal to or less than 0.4, or equal to or greater than 0.25 and equal to or less than 0.35.

The inventors have discovered a relationship between the First Performance Factor and Second Performance Factor described herein. More particularly, the inventors discovered that engine designs achieving each of the First Performance Factor and Second Performance Factor, without significant changes in solidity, provide improved engine performance. Blade solidity is defined as the ratio of the blade chord length to the distance of space between the blades.

Example engine parameters and corresponding First Performance Factors and Second Performance Factors are presented in Table 1 below.

TABLE 1

| Example | HTR | FPR | $M_{tip,c}^{(RL)}$ | SPF | FPF |
|---|---|---|---|---|---|
| 1 | 0.206 | 1.522 | 1.417 | 1.782 | 2.374 |
| 2 | 0.400 | 1.376 | 1.421 | 0.981 | 0.976 |
| 3 | 0.260 | 1.204 | 1.177 | 0.823 | 2.722 |
| 4 | 0.224 | 1.595 | 0.976 | 0.646 | −0.359 |
| 5 | 0.213 | 1.517 | 0.815 | 0.613 | −0.823 |
| 6 | 0.265 | 1.448 | 1.497 | 1.152 | 1.161 |

TABLE 1-continued

| Example | HTR | FPR | $M_{tip,c}^{(RL)}$ | SPF | FPF |
|---|---|---|---|---|---|
| 7 | 0.352 | 1.250 | 0.962 | 0.087 | −0.445 |
| 8 | 0.394 | 1.328 | 1.228 | 2.403 | 6.606 |
| 9 | 0.213 | 1.517 | 0.815 | 0.613 | −0.823 |
| 10 | 0.235 | 1.240 | 1.231 | 2.053 | 8.398 |

In this way, using fan parameters such as fan pressure ratios, corrected fan tip Mach number, fan diameters, and hub-to-tip ratios, the inventors discovered approaches that utilize the above-described average fan chord relationship to obtain an average chord width, and the above-described fan blade count relationship to obtain a fan blade count. These obtained constraints guide one to select fan chord width, blade count, or both suited for the particularized engine architectures and mission requirements, informed by engine-unique environments and trade-offs in design (as discussed above), which are believed to result in an improved engine.

In another aspect, the FPF and SPF may also be useful as a design tool for down-selecting, or providing a guideline for reducing the number of candidate designs for fan blade counts and average fan chords from which to design a fan module for a particular architecture. In this way, an engine architecture is improved overall by knowing, early in the design process, what constraints or limitations would be imposed by a fan module given the mission objectives.

In another aspect method of assembly is provided. The method includes mounting a fan inside an annular casing for rotation about an axial centerline. The fan including fan blades that extend radially outwardly toward the annular casing. The fan further includes an average fan chord width according to the First Performance Factor ("FPF") and/or a quantity of fan blades according to the Second Performance Factor ("SPF") discussed above.

Also disclosed herein is a non-metallic leading edge protective wrap that can protect a leading edge of an airfoil having a composite core. For example, the leading edge protective wrap protects against erosion and foreign object damage, such as from bird strikes. The leading edge protective wrap includes a trailing wrap wrapped around a core leading edge of the composite core and is connected to a pressure sidewall and suction sidewall of the composite core. The leading edge protective wrap also includes a leading edge wrap wrapped around the core leading edge and a leading edge of the trailing wrap. Accordingly, the leading wrap is an outer wrap with respect to the trailing wrap.

The non-metallic leading edge protective wrap disclosed herein offers several advantages. For example, the non-metallic leading edge protective wrap is less likely to break away from the composite core of the airfoil during operation of the turbomachine, which would expose the composite core to the elements and possible foreign object damage (FOD). Additionally, the non-metallic leading edge protective wrap may wrap unbroken around the core leading edge, which can improve ruggedness of the airfoil and prevent structural damage to the airfoil.

The non-metallic leading edge protective wrap disclosed herein was moreover found particularly advantageous for a fan module contemplated by the above relationships (1) through (4). For example, the First Performance Factor (FPF) and Second Performance Factor (SPF) parameters drive the fan blade design towards a lower corrected fan tip speed ($U_{c(tip)}$). A lower corrected fan tip speed ($U_{c(tip)}$) lowers the relative velocities of foreign objects that may cause FOD, such as from bird strikes. This allows for a deviation from traditional metallic leading-edge protections to a non-metallic leading edge. Non-metallic leading edges have the advantage of potentially co-curing with a composite airfoil base, eliminating the need for secondary bonding of the leading edge, and thus improving manufacturing processes.

Moreover, the First Performance Factor (FPF) and Second Performance Factor (SPF) parameters driving the fan blade design towards a lower corrected fan tip speed ($U_{c(tip)}$) also allows for the selection of a lower fan chord and potentially a reduced blade count (BC). This reduction in fan chord or tip speed, and particularly a reduction in both fan chord and tip speed, enables the use of a lighter non-metallic leading edge, which synergistically improves the efficiency of the engine (with FPF and SPF) by reducing the overall system weight and enhancing fuel efficiency.

Such reduction in fan chord or tip speed may also result in aerodynamic losses resulting from the fan blade leading edge profile along an airfoil being more exposed to the aerodynamic flow path. The non-metallic leading edge protective wrap discussed herein can therefore be integrated into the fan module contemplated by the above relationships (1) through (4) to further improve performance of the gas turbine engine. For example, the non-metallic leading edge protective wrap may improve aerodynamic flow through the fan, thereby improving fuel consumption, reducing or even eliminating the undesirable aerodynamic losses noted above. The non-metallic leading edge protective wrap may also improve the structural integrity of the airfoil and protect the fan blades from erosion and foreign object damage.

Additionally, the First Performance Factor (FPF) may drive the corrected redline fan tip Mach number $$\left(M_{tip,c}^{(RL)}\right)$$

below 1.1, which allows for selection of a fan blade design having reduced blade stiffness. The non-metallic leading edge protective wrap discussed herein may counteract the risks associated with a fan blade having reduced blade stiffness by improving the structural integrity of the fan blade.

Accordingly, integration of the non-metallic leading edge protective wrap technology with the relationships discussed hereinabove (relationships (1) through (4), above) results in a gas turbine engine having synergistic engine improvements in terms of aerodynamic efficiency, fuel efficiency, and durability.

Figure 7:
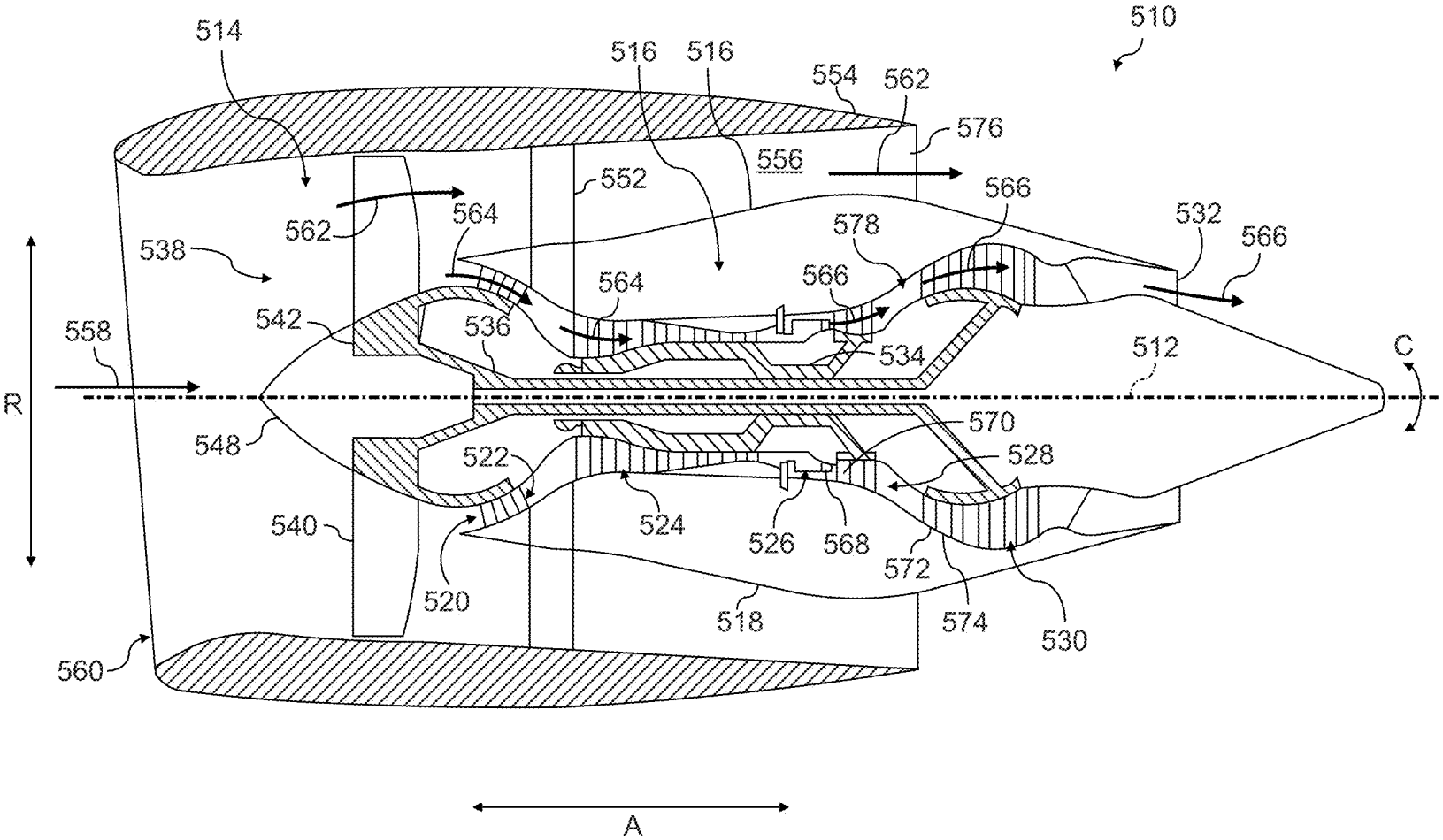
FIG. 7 is a schematic cross-sectional view of an exemplary aviation gas turbine engine according to various embodiments of the present subject matter.

Referring now to the drawings, FIG. 7 provides a schematic cross-sectional view of a turbomachine embodied as a gas turbine engine 510 for an aerial vehicle. For the embodiment of FIG. 5, the gas turbine engine 510 is a high-bypass turbofan jet engine. The gas turbine engine 510 defines an axial direction A (extending parallel to a longitudinal axis 512) and a radial direction R that is normal to the axial direction A. The gas turbine engine 510 also defines a circumferential direction C that extends three hundred sixty degrees (360°) around the longitudinal axis 512.

The gas turbine engine 510 includes a fan section 514 and a core engine 516 disposed downstream of the fan section 514. The core engine 516 includes a substantially tubular engine cowl 518 that defines an annular core inlet 520. As schematically shown in FIG. 5, the engine cowl 518 encases, in serial flow relationship, a compressor section including a booster, such as a low pressure (LP) compressor 522, followed downstream by a high pressure (HP) compressor 524; a combustion section 526; a turbine section including an HP turbine 528 followed downstream by an LP turbine 530; and a jet exhaust nozzle 532. The compressor section, combustion section 526, turbine section, and jet exhaust nozzle 532 together define a core air flow path. An HP shaft or spool 534 drivingly connects the HP turbine 528 to the HP compressor 524 to rotate them in unison concentrically with respect to the longitudinal axis 512. An LP shaft or spool 536 drivingly connects the LP turbine 530 to the LP compressor 522 to rotate them in unison concentrically with respect to the longitudinal axis 512. Thus, the LP shaft 536 and HP shaft 534 are each rotary components, rotating about the axial direction A during operation of the gas turbine engine 510. The gas turbine engine 510 can include a plurality of bearings to support such rotary components.

The fan section 514 includes a fan 538 having a plurality of fan blades 540 coupled to a fan disk 542 in a spaced apart manner. The fan blades 540 extend outward from the fan disk 542 along the radial direction R. The fan blades 540 and the fan disk 542 are together rotatable about the longitudinal axis 512. The fan disk 542 is covered by a rotatable spinner 548 aerodynamically contoured to promote an airflow through the plurality of fan blades 540. In addition, the fan section 514 includes an annular fan casing or outer nacelle 550 that circumferentially surrounds the fan 538 and/or at least a portion of the core engine 516. The outer nacelle 550 is supported relative to the core engine 516 by a plurality of circumferentially-spaced outlet guide vanes 552. Alternatively, the outer nacelle 550 also may be supported by struts of a structural fan frame. Moreover, a downstream section 554 of the outer nacelle 550 extends over an outer portion of the core engine 516 so as to define a bypass airflow passage 556 therebetween.

During operation of the gas turbine engine 510, a volume of air 558 enters the gas turbine engine 510 through an associated inlet 560 of the outer nacelle 550 and/or fan section 514. As the volume of air 558 passes across the fan blades 540, a first portion of the air 558 (as indicated by arrow 562) is directed or routed into the bypass airflow passage 556, and a second portion of the air 558 (as indicated by arrow 564) is directed or routed into the upstream section of the core air flow path, or more specifically into the annular core inlet 520 of the LP compressor 522. The pressure of the second portion of air 564 is then increased as it is routed through the HP compressor 524. The high pressure air 564 is then discharged into the combustion section 526 where the air 564 is mixed with fuel and burned to provide combustion gases 566.

The combustion gases 566 are routed into and expand through the HP turbine 528 where a portion of thermal and/or kinetic energy from the combustion gases 566 is extracted via sequential stages of HP turbine stator vanes 568 that are coupled to the engine cowl 518 and HP turbine rotor blades 570 that are coupled to the HP shaft or spool 534, thus causing the HP shaft or spool 534 to rotate, thereby supporting operation of the HP compressor 524. The combustion gases 566 then flow downstream into and expand through the LP turbine 530 where a second portion of thermal and kinetic energy is extracted from the combustion gases 566 via sequential stages of LP turbine stator vanes 572 that are coupled to the engine cowl 518 and LP turbine rotor blades 574 that are coupled to the LP shaft or spool 536, thus causing the LP shaft or spool 536 to rotate, thereby supporting operation of the LP compressor 522 and rotation of the fan 538.

The combustion gases 566 are subsequently routed through the jet exhaust nozzle 532 of the core engine 516 to provide propulsive thrust. Simultaneously, the pressure of the first portion of air 562 is substantially increased as the first portion of air 562 is routed through the bypass airflow passage 556 before it is exhausted from a fan nozzle exhaust section 576 of the gas turbine engine 510, also providing propulsive thrust. The HP turbine 528, the LP turbine 530, and the jet exhaust nozzle 532 at least partially define a hot gas path 578 for routing the combustion gases 566 through the core engine 516.

It should be appreciated that the exemplary gas turbine engine 510 depicted in FIG. 7 is by way of example only, and that in other exemplary embodiments, the gas turbine engine 510 may have any other suitable configuration. For example, in other exemplary embodiments, the fan 538 may be configured in any other suitable manner (e.g., as a variable pitch fan) and further may be supported using any other suitable fan frame configuration. Moreover, it also should be appreciated that in other exemplary embodiments that any other suitable HP compressor 524 and HP turbine 528 configurations may be utilized. It also should be appreciated, that in still other exemplary embodiments, aspects of the present disclosure may be incorporated into any other suitable type of gas turbine engine. For example, aspects of the present disclosure may be incorporated into, e.g., a turboshaft engine, turboprop engine, turbojet engine, industrial and marine gas turbine engines, auxiliary power units, etc.

Additionally, it will be appreciated that in at least certain embodiments of the present disclosure, the gas turbine engine 510 has one or more airfoils formed of a composite material, such as a CMC material or a PMC material. Composite airfoils formed of CMC material for aviation gas turbine engines are typically found in the hot section of the core engine 516, such as in the turbine section. For instance, the airfoils of the HP turbine nozzles, or the HP turbine stator vanes 568, can be formed of CMC material. Further, the airfoils of the HP turbine rotor blades 570 can be formed of a CMC material. The airfoils in the LP turbine 530 can also be formed of CMC material. The composite airfoils formed of PMC material for aviation gas turbine engines are typically found upstream of the hot section of the core engine 516, such as in the compressor section and the fan section 514. For instance, the airfoils of the LP and HP compressor nozzles and the compressor blades of the LP and HP compressors 522, 524 can be formed of PMC material. Further, the fan blades 540 of the fan 538 can be formed of a PMC material. In accordance with the inventive aspects of the present disclosure, a composite airfoil having a leading edge protective wrap that provides leading edge protection against erosion, Foreign Object Debris (FOD), and bird strike threats, among other things, is disclosed herein. The leading edge protective wrap can be used with or applied to any suitable composite airfoil of a turbine engine, such as any of the airfoils noted above.

With reference to FIGS. 8, 9, 10, 11, and 12, collectively, various views are provided of an engine component having a composite airfoil equipped with a leading edge protective wrap.

Figure 8:
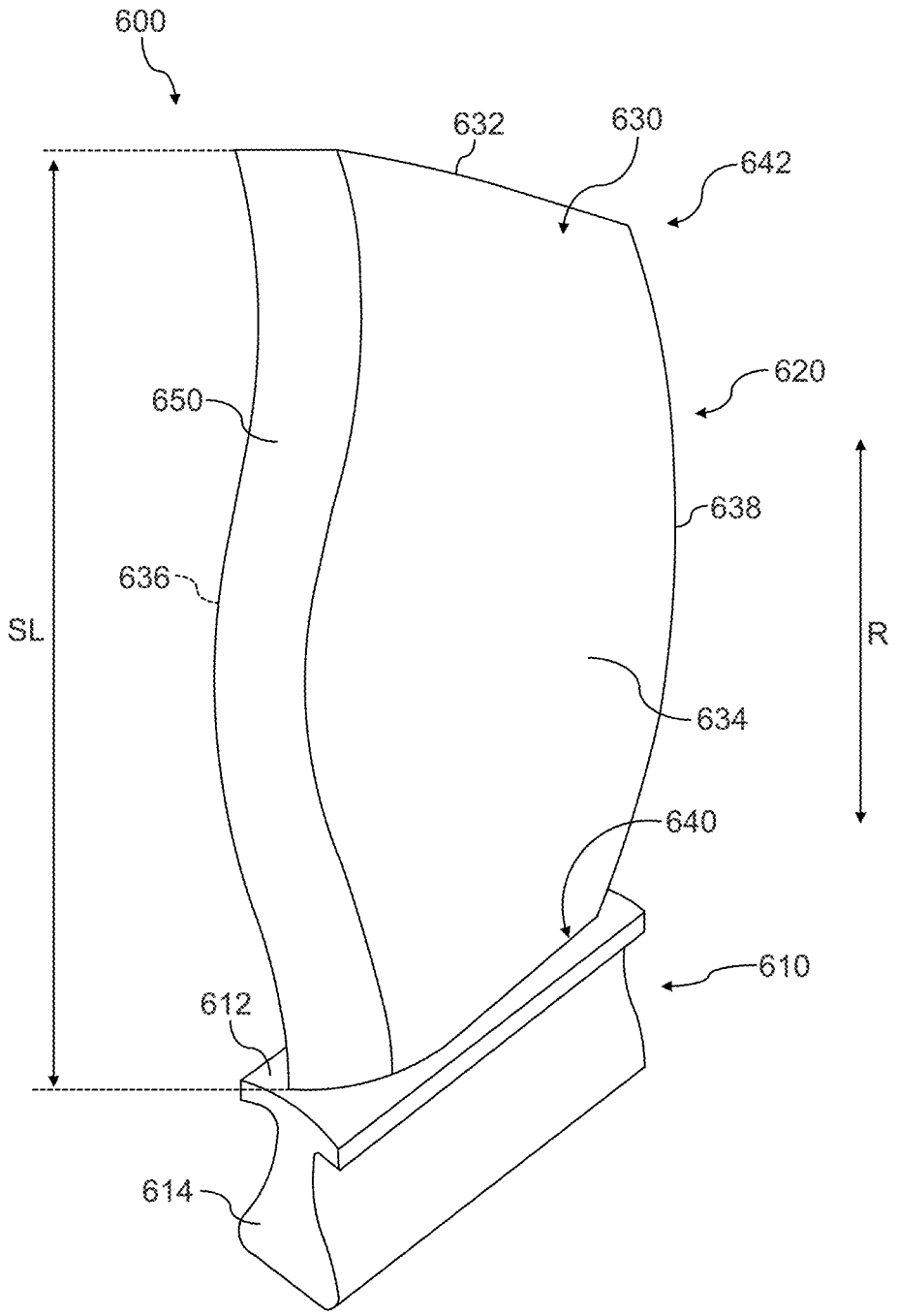
FIG. 8 provides a perspective view of a fan blade according to an example embodiment of the present subject matter.

In particular, FIG. 8 provides a perspective view of an engine component having a composite airfoil equipped with a leading edge protective wrap 650. In FIG. 8 the engine component is a fan blade 600 of an aviation gas turbine engine.

Figure 9:
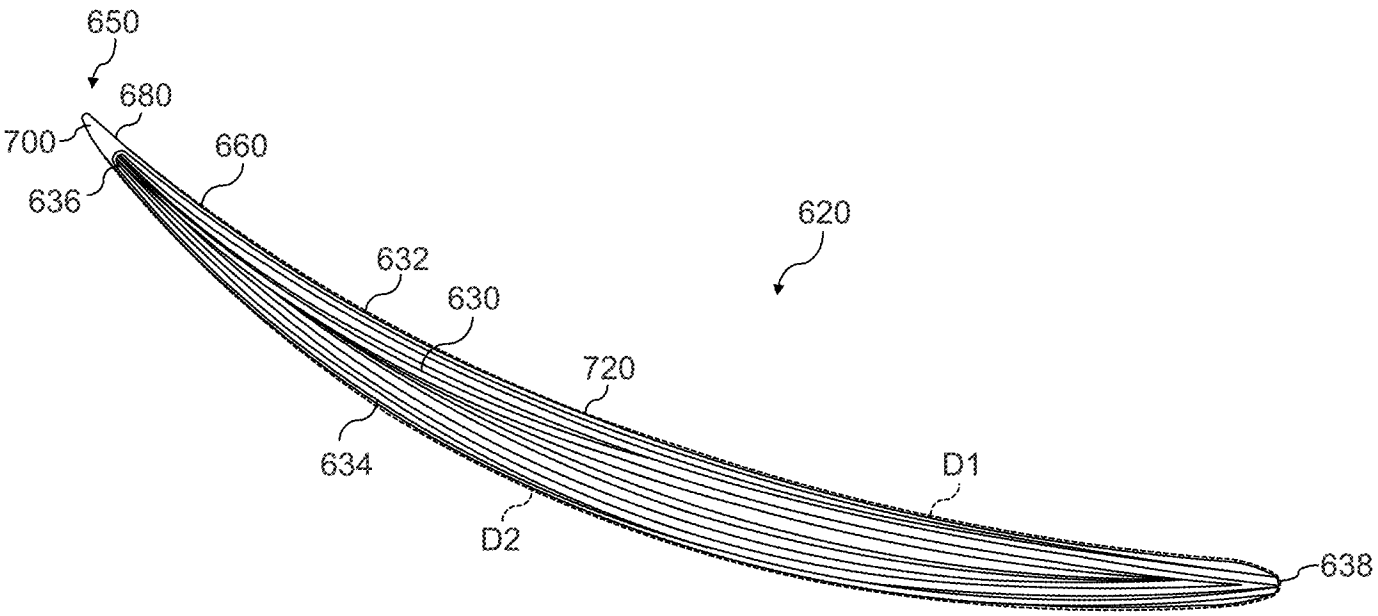
FIG. 9 provides a cross-sectional view of an airfoil of the fan blade of FIG. 6.

FIG. 9 provides a cross-sectional view of an airfoil 620 of the fan blade 600 of FIG. 8.

Figure 10:
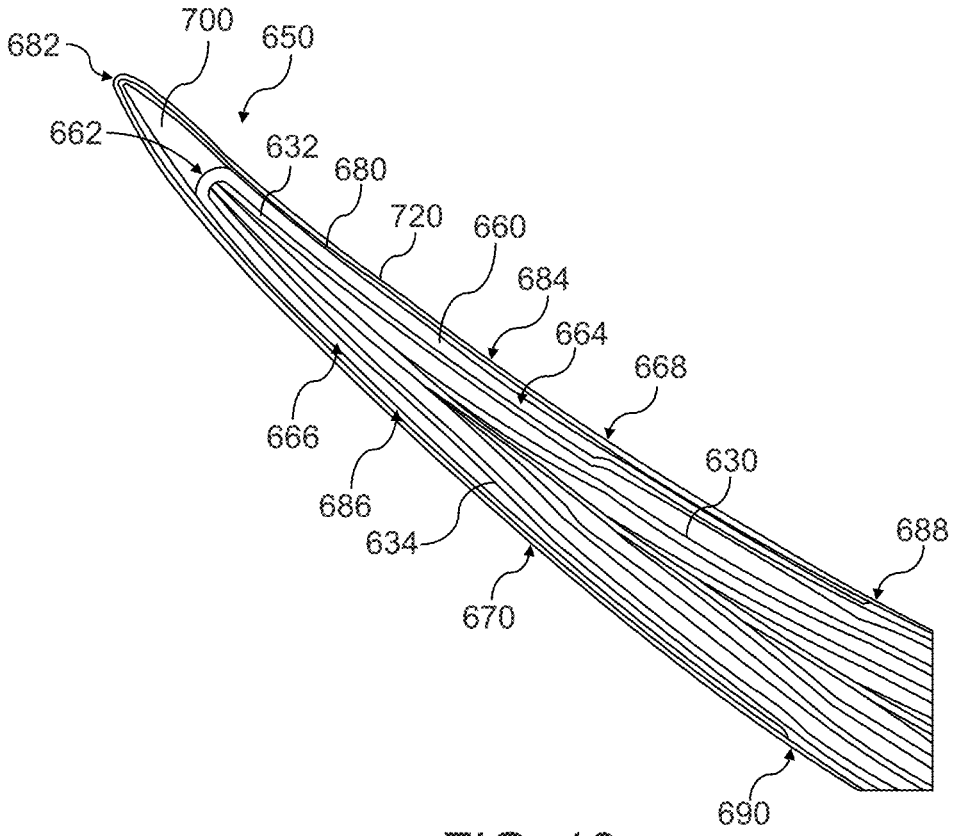
FIGS. 10 and 11 provide close-up cross-sectional views of the airfoil of the fan blade of FIG. 6.
Figure 11:
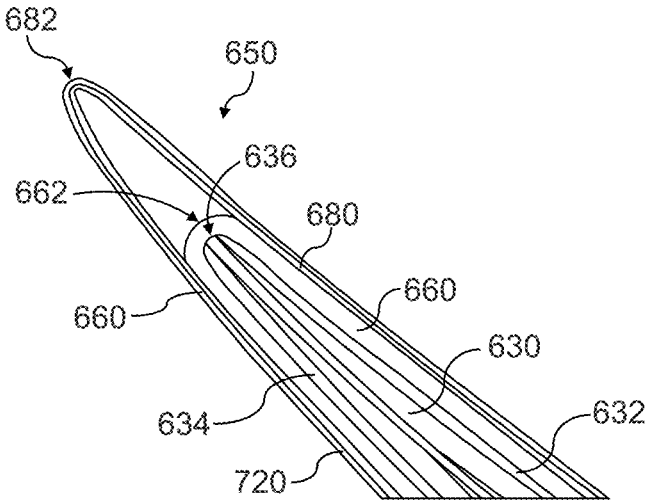

FIGS. 10 and 11 provide close-up cross-sectional views of the airfoil 620 of the fan blade 600 of FIG. 8.

Figure 12:
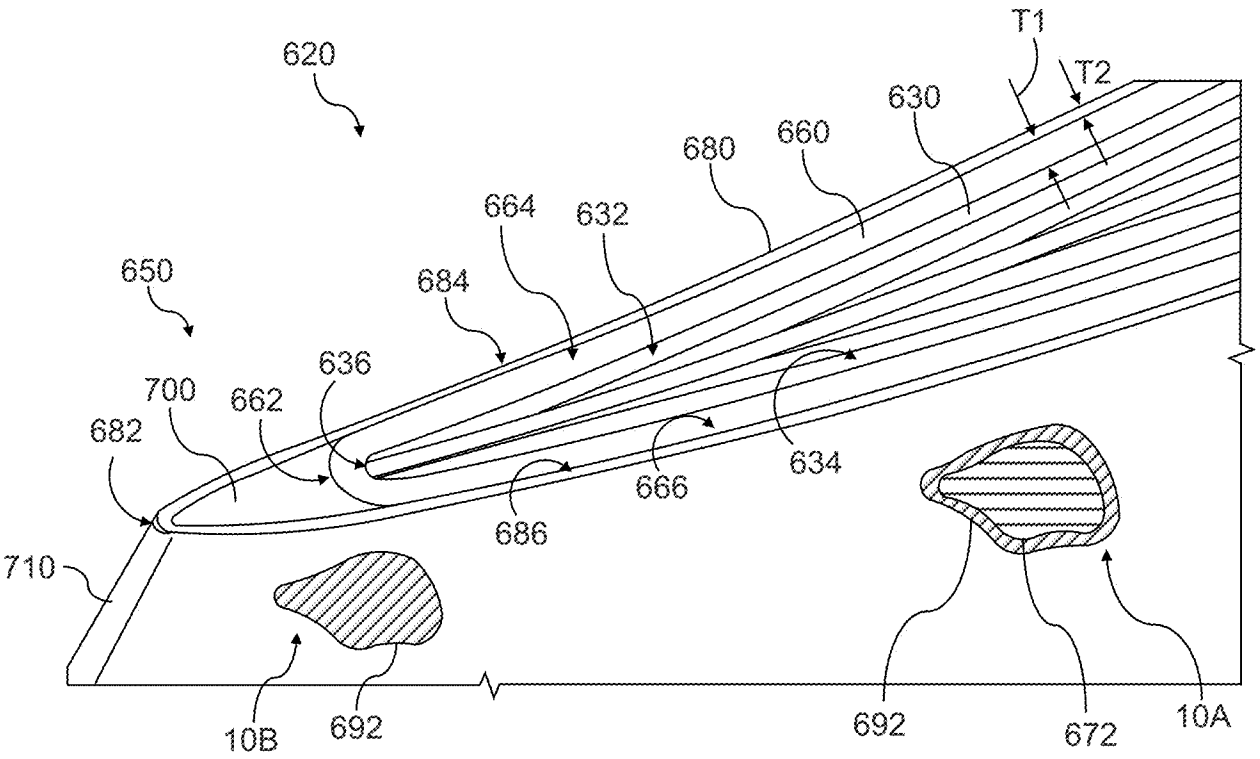
FIG. 12 provides a close-up, perspective cross-sectional view of the airfoil of the fan blade 600 of FIG. 6.

FIG. 12 provides a close-up, perspective cross-sectional view of the airfoil 620 of the fan blade 600 of FIG. 8.

Although the leading edge protective wrap 650 is disclosed in this example embodiment as being applied to an airfoil of a fan blade for an aviation gas turbine engine, it will be appreciated that the leading edge protective wrap 650 can be applied to other suitable composite airfoils of a gas turbine engine or turbomachine.

Referring particularly to FIG. 8, the fan blade 600 includes a root 610 and an airfoil 620. The root 610 includes a platform 612 and a dovetail 614. The dovetail 614 connects the fan blade 600 with a fan disk, such as the fan disk 542 depicted in FIG. 7. The airfoil 620 extends lengthwise outward from the root 610, e.g., along the radial direction R.

The airfoil 620 has a composite core 630. The composite core 630 has a pressure sidewall 632 and a suction sidewall 634 extending between a core leading edge 636 (hidden by the leading edge protective wrap 650 in FIG. 8; see FIG. 11) and a core trailing edge 638. As is depicted in FIG. 9, the pressure sidewall 632 has a concave shape while the suction sidewall 634 has a convex shape. The pressure sidewall 632 and the suction sidewall 634 are joined together at the core leading edge 636 and the core trailing edge 638 to define an airfoil shape. During operation, the fan blade 600 rotates in a direction such that the pressure sidewall 632 follows the suction sidewall 634. Thus, as shown in FIG. 8, the fan blade 600 would rotate into the page. Moreover, the composite core 630 of the airfoil 620 extends between a base 640 and a tip 642, e.g., along the radial direction R. A span length SL is defined between the base 640 and the tip 642 as shown in FIG. 8. The base 640 of the airfoil 620 is connected to the root 610.

It will be appreciated that in some embodiments, the composite core 630 is formed of a composite material. For instance, for this embodiment, the composite core 630 is formed of a PMC material. In other embodiments, the composite core 630 can be formed of a CMC material. Exemplary matrix materials for a CMC composite core can include silicon carbide, silicon, silica, alumina, or combinations thereof. Ceramic fibers can be embedded within the matrix, such as oxidation stable reinforcing fibers including monofilaments like sapphire and silicon carbide (e.g., Textron's SCS-6), as well as rovings and yarn including silicon carbide (e.g., Nippon Carbon's NICALON®, Ube Industries' TYRANNO®, and Dow Corning's SYLRAMIC®), alumina silicates (e.g., Nextel's 440 and 480), and chopped whiskers and fibers (e.g., Nextel's 440 and SAFFIL®), and optionally ceramic particles (e.g., oxides of Si, Al, Zr, Y, and combinations thereof) and inorganic fillers (e.g., pyrophyllite, wollastonite, mica, talc, kyanite, and montmorillonite). Such CMC materials may have coefficients of thermal expansion in the range of about $1.3\times10^{-6}$ in/in/° F. to about $3.5\times10^{-6}$ in/in/° F. in a temperature range of approximately 1000-1200° F. In yet other embodiments, the composite core 630 can be formed of other suitable composite materials.

As previously discussed, the airfoil 620 includes the leading edge protective wrap 650. The leading edge protective wrap 650 protects the composite core 630, especially at its core leading edge 636. For instance, the leading edge protective wrap 650 can protect the core leading edge 636 from erosion, FOD, and bird strike threats, among other things. For this embodiment, the leading edge protective wrap 650 includes a trailing wrap 660 wrapped around the core leading edge 636 of the composite core 630. The trailing wrap 660 enhances the structural integrity of the airfoil 620 and is particularly useful for preventing or minimizing structural damage to the airfoil 620, e.g., from bird strikes. As depicted best in FIG. 10, the trailing wrap 660 is connected to the pressure sidewall 632 and the suction sidewall 634 of the composite core 630. More specifically, the trailing wrap 660 has a pressure sidewall 664 and a suction sidewall 666. The trailing wrap 660 also has a leading edge 662. The pressure sidewall 664 of the trailing wrap 660 is connected to or otherwise positioned adjacent to the pressure sidewall 632 of the composite core 630 and the suction sidewall 666 of the trailing wrap 660 is connected to or otherwise positioned adjacent to the suction sidewall 634 of the composite core 630. The trailing wrap 660 extends between a pressure side end 668 and a suction side end 670. In this regard, the trailing wrap 660 terminates at one end at the pressure side end 668 and at its other end at the suction side end 670.

The leading edge protective wrap 650 also includes a leading edge wrap 680 wrapped around the core leading edge 636 of the composite core 630 and the leading edge 662 of the trailing wrap 660. That is, the leading edge wrap 680 is wrapped around the leading edge 662 of the trailing wrap 660, which is in turn wrapped around core leading edge 636 of the composite core 630. Thus, the leading edge wrap 680 is an outer wrap with respect to the trailing wrap 660.

The leading edge wrap 680 has a leading edge 662 that is spaced from the leading edge 662 of the trailing wrap 660. The leading edge 662 of the leading edge wrap 680 leads or is positioned or situated upstream of the leading edge 662 of the trailing wrap 660; hence the leading and trailing denotations of the leading and trailing wraps 660, 680. As depicted, the leading edge wrap 680 is connected to the pressure sidewall 664 and the suction sidewall 666 of the trailing wrap 660. More specifically, the leading edge wrap 680 has a pressure sidewall 682 and a suction sidewall 686. The pressure sidewall 682 of the leading edge wrap 680 is connected to or otherwise positioned adjacent to the pressure sidewall 664 of the trailing wrap 660 and the suction sidewall 686 of the leading edge wrap 680 is connected to or otherwise positioned adjacent to the suction sidewall 666 of the trailing wrap 660. The leading edge wrap 680 extends between a pressure side end 688 and a suction side end 690. In this regard, the leading edge wrap 680 terminates at one end at the pressure side end 688 and at its other end at the suction side end 690.

In addition, the leading edge protective wrap 650 further includes a filler 700. The filler 700 is positioned at least in part between the leading edge 662 of the trailing wrap 660 and the leading edge 662 of the leading edge wrap 680. The filler 700 fills the cavity formed between the trailing wrap 660 and the leading edge wrap 680 at the leading portion of the airfoil 620. The cavity formed between the trailing wrap 660 and the leading edge wrap 680 can extend between the base 640 and the tip 642 of the airfoil 620. The filler 700 can be filled into the entire cavity and thus can extend from the base 640 to the tip 642 or the span length SL of the composite core 630 between the trailing wrap 660 and the leading edge wrap 680. In certain exemplary embodiments, for example, the trailing wrap 660, the leading edge wrap 680, and the filler 700 extend the span length SL of the composite core 630. In this way, the entire span of the core leading edge 636 of the composite core 630 can be protected by the leading edge protective wrap 650. In other embodiments, the leading edge protective wrap 650 need not protect the full span of the core leading edge 636 of the composite core 630.

The filler 700 can be formed of a non-metallic material, such as at least one of a resin, an adhesive, composite tows or fibrous bundle, a 2D weave or woven material, a 3D weave or woven material, rolled fibers, single toe material, and a preform (e.g., a preformed insert). In certain exemplary embodiments, filler 700 is formed with the same resin used to form the composite core 630. In this way, the filler 700 can be co-molded with the composite core 630 and no subsequent bond is needed. In embodiments in which the filler 700 and the composite core 630 are co-molded, the sharp leading edge radius can be net molded.

In certain exemplary embodiments, optionally, the leading edge protective wrap 650 can also include a protective nose 710 as shown in FIG. 12. The protective nose 710 is connected to the leading edge 662 of the leading edge wrap 680. The protective nose 710 is thus positioned upstream or forward of the leading edge wrap 680. Accordingly, the protective nose 710 forms the leading edge of the airfoil 620. Advantageously, the protective nose 710 can ward off or reduce erosion at the leading edge of the airfoil 620.

The protective nose 710 can extend from the base 640 to the tip 642 or the span length SL of the composite core 630. Accordingly, in certain exemplary embodiments, the trailing wrap 660, the leading edge wrap 680, the filler 700, and the protective nose 710 each extend the span length SL of the composite core 630. Further, the protective nose 710 can be formed of any suitable non-metallic material. For instance, the protective nose 710 can be formed of any of the non-metallic materials noted herein and can be 2D or 3D woven. Accordingly, in certain exemplary embodiments, the trailing wrap 660, the leading edge wrap 680, the filler 700, and the protective nose 710 can each be formed of a non-metallic material.

Further, in certain exemplary embodiments, the airfoil 620 of the fan blade 600 can be coated with a protective coating 720, such as an environmental barrier coating. As shown in FIG. 7, the entire perimeter of the airfoil 620 can be coated with the protective coating 720. In particular, as shown in FIG. 8, the protective coating 720 can be applied to the outer surface of the leading edge wrap 680 of the leading edge protective wrap 650, along the pressure and suction sides 632, 634 of the composite core 630, and around the core trailing edge 638 of the composite core 630. The protective coating 720 can be applied along the entire perimeter of the airfoil 620 as well as along the entire span of the airfoil 620. The protective coating 720 can be applied to the outer surface of the protective nose 710 or the protective nose 710 can be added to the airfoil 620 after the protective coating 720 has been applied.

Components of the leading wrap protection wrap 650 can be formed of various non-metallic materials. In certain exemplary embodiments, the trailing wrap 660 and the leading edge wrap 680 are formed of a non-metallic material. The non-metallic material forming the trailing wrap 660 and the leading edge wrap 680 can be a fibrous composite material, for example. For instance, in certain exemplary embodiments, the fibrous composite material is formed of at least one of an S-glass, carbon, E-glass, and Kevlar material.

In certain exemplary embodiments, at least one of the trailing wrap 660 and the leading edge wrap 680 is formed of a fibrous material having fibers that wrap unbroken around the core leading edge 636. The fibers of a given wrap run "unbroken" around the core leading edge 636 in that they run continuously from the pressure sidewall, around the leading edge, and to the suction sidewall of the given wrap. In certain exemplary embodiments, at least one of the leading edge wrap 680 and the trailing wrap 660 is formed of a 3D weave having fibers that wrap unbroken around the core leading edge 636 of the composite core 630. In other embodiments, at least one of the leading edge wrap 680 and the trailing wrap 660 is formed of a 2D weave having fibers that wrap unbroken around the core leading edge 636 of the composite core 630.

As one example, as shown in FIG. 12, the trailing wrap 660 is formed of a non-metallic fibrous material having fibers 672 (only four fibers are shown in the cutaway 10A of the trailing wrap 660) that wrap unbroken around the core leading edge 636 of the composite core 630. The fibers 672 can form part of a 3D or 2D weave, for example. The fibers 672 run along at least a portion of the pressure sidewall 664, wrap around the leading edge 662 (and consequently the core leading edge 636), and continue running along the suction sidewall 666 of the trailing wrap 660. In certain exemplary embodiments, one or more of the fibers 672 can run continuously or unbroken from the pressure side end 668 to the suction side end 670 of the trailing wrap 660. The unbroken fibers 672 of the trailing wrap 660 provide ruggedization to the airfoil 620.

As another example, as shown in FIG. 12, the leading edge wrap 680 is formed of a non-metallic fibrous material having fibers 692 (only five fibers are shown in the cutaway 10B of the leading edge wrap 680) that wrap unbroken around the core leading edge 636 of the composite core 630 and the leading edge 662 of the trailing wrap 660. The fibers 692 can form part of a 3D or 2D weave, for example. The fibers 692 run along at least a portion of the pressure sidewall 682, wrap around the leading edge 662 (and consequently the core leading edge 636 and the leading edge 662), and continue running along the suction sidewall 686 of the leading edge wrap 680. In certain exemplary embodiments, one or more of the fibers 692 can extend continuously or unbroken from the pressure side end 688 to the suction side end 690 of the leading edge wrap 680. The unbroken fibers 692 of the leading edge wrap 680 provide ruggedization to the airfoil 620. In certain exemplary embodiments, the fibers 692 of the leading edge wrap 680 and the fibers 672 of the trailing wrap 660 can run unbroken around the core leading edge 636 of the composite core 630.

As shown in FIG. 12, for this embodiment, the leading edge wrap 680 is thinner than the trailing wrap 660. The trailing wrap 660 has a first thickness T1 and the leading edge wrap 680 has a second thickness T2 that is less thick than the first thickness T1 of the trailing wrap 660. Stated another way, the trailing wrap 660 is thicker than the leading edge wrap 680. The thickness of the trailing wrap 660 can provide structural integrity to the composite core 630, particularly at the core leading edge 636. The thinner leading edge wrap 680 can be easily wrapped to shape to form a small or sharp leading edge radius of the airfoil 620. Thus, the two-wrap construction of the leading edge protective wrap 650 can enhance the structural integrity of the airfoil 620 whilst still being able to meet the sharp leading edge design intent of the airfoil 620. In certain exemplary embodiments, the second thickness T2 of the leading edge wrap 680 is less than half the first thickness T1 of the trailing wrap 660. In some other embodiments, the second thickness T2 of the leading edge wrap 680 is less than one third the first thickness T1 of the trailing wrap 660. As one example, the leading edge wrap 680 can be ~0.003 mils thick and the trailing wrap can be ~0.009 mils thick.

In addition, the trailing wrap 660 can have different thicknesses. For instance, as noted, the trailing wrap 660 extends between a pressure side end 668 and a suction side end 670. The pressure side end 668 can be connected to the pressure sidewall 632 of the composite core 630 and the suction side end 670 can be connected to the suction sidewall 634 of the composite core 630. In certain exemplary embodiments, the trailing wrap 660 can be thicker at its leading edge 662 than at one or both of its pressure side end 668 and the suction side end 670. In other embodiments, the trailing wrap 660 can be thinner at its leading edge 662 than at one or both of its pressure side end 668 and the suction side end 670.

The leading edge wrap 680 can have different thicknesses as well. As noted above, the leading edge wrap 680 extends between a pressure side end 688 and a suction side end 690. The pressure side end 688 can be connected to the pressure sidewall 664 of the trailing wrap 660 and the suction side end 690 can be connected to the suction sidewall 666 of the trailing wrap 660. In certain exemplary embodiments, the leading edge wrap 680 can be thicker at its leading edge 662 than at one or both of its pressure side end 688 and the suction side end 690. In other embodiments, the leading edge wrap 680 can be thinner at its leading edge 662 than at one or both of its pressure side end 688 and the suction side end 690.

Further, in certain exemplary embodiments, as is depicted in FIG. 9, the composite core 630 defines a pressure side camber distance D1 (represented by the dashed-dot line outlining the camber of the pressure sidewall 632) and a suction side camber distance D2 (represented by the dashed line outlining the camber of the suction sidewall 634). The pressure side camber distance D1 spans between the core leading edge 636 and the core trailing edge 638 along the pressure sidewall 632 of the composite core 630. The suction side camber distance D2 spans between the core leading edge 636 and the core trailing edge 638 along the suction sidewall 634 of the composite core 630.

In certain exemplary embodiments, the trailing wrap 660 is wrapped around the core leading edge 636 of the composite core 630 such that trailing wrap 660 extends from the core leading edge 636 at least ten percent (10%) of the pressure side camber distance D1 and from the core leading edge 636 at least ten percent (10%) of the suction side camber distance D2. In other embodiments, the trailing wrap 660 is wrapped around the core leading edge 636 of the composite core 630 such that trailing wrap 660 extends from the core leading edge 636 at least twenty percent (20%) of the pressure side camber distance D1 and from the core leading edge 636 at least twenty percent (20%) of the suction side camber distance D2. In some other embodiments, the trailing wrap 660 is wrapped around the core leading edge 636 of the composite core 630 such that trailing wrap 660 extends from the core leading edge 636 at least fifty percent (50%) of the pressure side camber distance D1 and from the core leading edge 636 at least fifty percent (50%) of the suction side camber distance D2. In yet other embodiments, the trailing wrap 660 is wrapped around the core leading edge 636 of the composite core 630 such that trailing wrap 660 extends from the core leading edge 636 the entire pressure side camber distance D1 and from the core leading edge 636 the entire suction side camber distance D2.

In addition, in certain exemplary embodiments, the leading edge wrap 680 is wrapped around the core leading edge 636 of the composite core 630 such that leading edge wrap 680 extends from the core leading edge 636 at least ten percent (10%) of the pressure side camber distance D1 and from the core leading edge 636 at least ten percent (10%) of the suction side camber distance D2. In some other embodiments, the leading edge wrap 680 is wrapped around the core leading edge 636 of the composite core 630 such that leading edge wrap 680 extends from the core leading edge 636 at least twenty percent (20%) of the pressure side camber distance D1 and from the core leading edge 636 at least twenty percent (20%) of the suction side camber distance D2. In other embodiments, the leading edge wrap 680 is wrapped around the core leading edge 636 of the composite core 630 such that leading edge wrap 680 extends from the core leading edge 636 at least fifty percent (50%) of the pressure side camber distance D1 and from the core leading edge 636 at least fifty percent (50%) of the suction side camber distance D2. In yet other embodiments, the leading edge wrap 680 is wrapped around the core leading edge 636 of the composite core 630 such that leading edge wrap 680 extends from the core leading edge 636 the entire pressure side camber distance D1 and from the core leading edge 636 the entire suction side camber distance D2.

Moreover, for this embodiment, the leading edge wrap 680 is wrapped around the core leading edge 636 of the composite core 630 such that leading edge wrap 680 extends further toward the core trailing edge 638 along at least one of the pressure side camber distance D1 and the suction side camber distance D2 than does the trailing wrap 660. As is depicted in FIGS. 7 and 8, the leading edge wrap 680 is wrapped around the core leading edge 636 of the composite core 630 so that the leading edge wrap 680 extends further toward the core trailing edge 638 along the pressure side camber distance D1 than does the trailing wrap 660 and so that the leading edge wrap 680 extends further toward the core trailing edge 638 along the suction side camber distance D2 than does the trailing wrap 660. In alternative embodiments, the trailing wrap 660 is wrapped around the core leading edge 636 of the composite core 630 such that trailing wrap 660 extends further toward the core trailing edge 638 along at least one of the pressure side camber distance D1 and the suction side camber distance D2 than does the leading edge wrap 680. In some further embodiments, the leading edge wrap 680 and the trailing wrap are wrapped around the core leading edge 636 of the composite core 630 such that leading edge wrap 680 and the trailing wrap 660 terminate at the same point along the pressure side camber distance D1. Additionally, or alternatively, in certain exemplary embodiments, the leading edge wrap 680 and the trailing wrap are wrapped around the core leading edge 636 of the composite core 630 such that leading edge wrap 680 and the trailing wrap 660 terminate at the same point along the suction side camber distance D2.

With reference to FIGS. 8 through 12, collectively, the leading edge protective wrap 650 can be applied to the composite core 630 to form the airfoil 620 using a suitable method. As one example, the composite core 630 can be laid up in a suitable manner to specification. The trailing wrap 660 can then be wrapped around the core leading edge 636 of the composite core 630. More specifically, the pressure sidewall 664 of the trailing wrap 660 can be connected to or positioned adjacent to the pressure sidewall 632 of the composite core 630 and the suction sidewall 666 of the trailing wrap 660 can be connected to or positioned adjacent to the suction sidewall 634 of the composite core 630. In certain exemplary embodiments, the trailing wrap 660 is constructed of a composite material prepreg or dry fabric and the composite core 630 can be constructed as an airfoil preform.

The trailing wrap 660 can have a thickness that is at least 25% greater than the thickness of any of the plies of the composite core 630. Further, the trailing wrap 660 can span the entire span length SL (FIG. 8) of the airfoil 620 or can span along a portion of the span length SL. The pressure side end 668 of the pressure sidewall 664 can form a butt joint with an outer ply that forms the pressure sidewall 632 of the composite core 630. Similarly, the suction side end 670 of the suction sidewall 666 can form a butt joint with an outer ply that forms the suction sidewall 634 of the composite core 630, e.g., as shown in FIG. 10.

With the trailing wrap 660 wrapped around the core leading edge 636 of the composite core 630, the leading edge wrap 680 can be wrapped around the core leading edge 636 of the composite core 630 as well. For instance, the pressure sidewall 682 of the leading edge wrap 680 can be connected to or positioned adjacent to the pressure sidewall 664 of the trailing wrap 660 and the suction sidewall 686 of the leading edge wrap 680 can be connected to or positioned adjacent to the suction sidewall 666 of the trailing wrap 660. The leading edge wrap 680 is thinner than the trailing wrap 660. Further, the leading edge wrap 680 can span the entire span length SL (FIG. 8) of the airfoil 620 or can span along a portion of the span length SL. The pressure side end 688 of the pressure sidewall 682 can form a lap-shear joint with the outer ply that forms the pressure sidewall 632 of the composite core 630. Similarly, the suction side end 690 of the suction sidewall 686 can form a lap-shear joint with the outer ply that forms the suction sidewall 634 of the composite core 630, e.g., as shown in FIG. 10.

When the leading edge wrap 680 is wrapped the core leading edge 636, the leading edge 662 of the leading edge wrap 680 is spaced from the leading edge 662 of the trailing wrap 660. In this regard, a void or cavity is formed between the leading edge wrap 680 and the trailing wrap 660. The filler 700 can be inserted into the cavity between the leading edge wrap 680 and the trailing wrap 660. The filler 700 can completely fill the cavity. In some example embodiments, the leading edge wrap 680 can be laid onto a forming tool such that the leading edge wrap 680 is formed to specification. Then, the filler 700 can be positioned at the leading edge 662 of the leading edge wrap 680. Next, the composite core 630 with the trailing wrap 660 wrapped therearound can be laid up on the forming tool on top of the leading edge wrap 680 and filler 700. The filler 700 can take its desired shape to fill the cavity between the leading edge wrap 680 and the trailing wrap 660. The whole airfoil 620 can then be removed from the forming tool and the lap-shear joints between the leading edge wrap 680 and the composite core 630 can be further secured. The protective nose 710 can be applied to the leading edge 662 of the leading edge wrap 680 to further protect the leading edge of the airfoil 620. In addition, the entire airfoil or a portion thereof can be coated with the protective coating 720.

In certain exemplary embodiments, the leading edge wrap 680 can be constructed of a composite material prepreg or dry fabric, and as noted above, the trailing wrap 660 can likewise be constructed of a composite material prepreg. The trailing and leading wraps 660, 680 can be wrapped around the core leading edge 636 of the composite core 630 as described above such that they are net molded to specification. As the leading edge protective wrap 650 is net molded, there is generally no need to machine the leading edge radius to specification. The leading edge of the airfoil 620 is defined by thickness of the trailing and leading wraps 660, 680 and the geometry of the cross section of the airfoil 620. Advantageously, the non-metallic leading edge protective wrap 650 can provide protection for the leading edge of the airfoil 620, such as against FOD and bird strikes.

Figure 13:
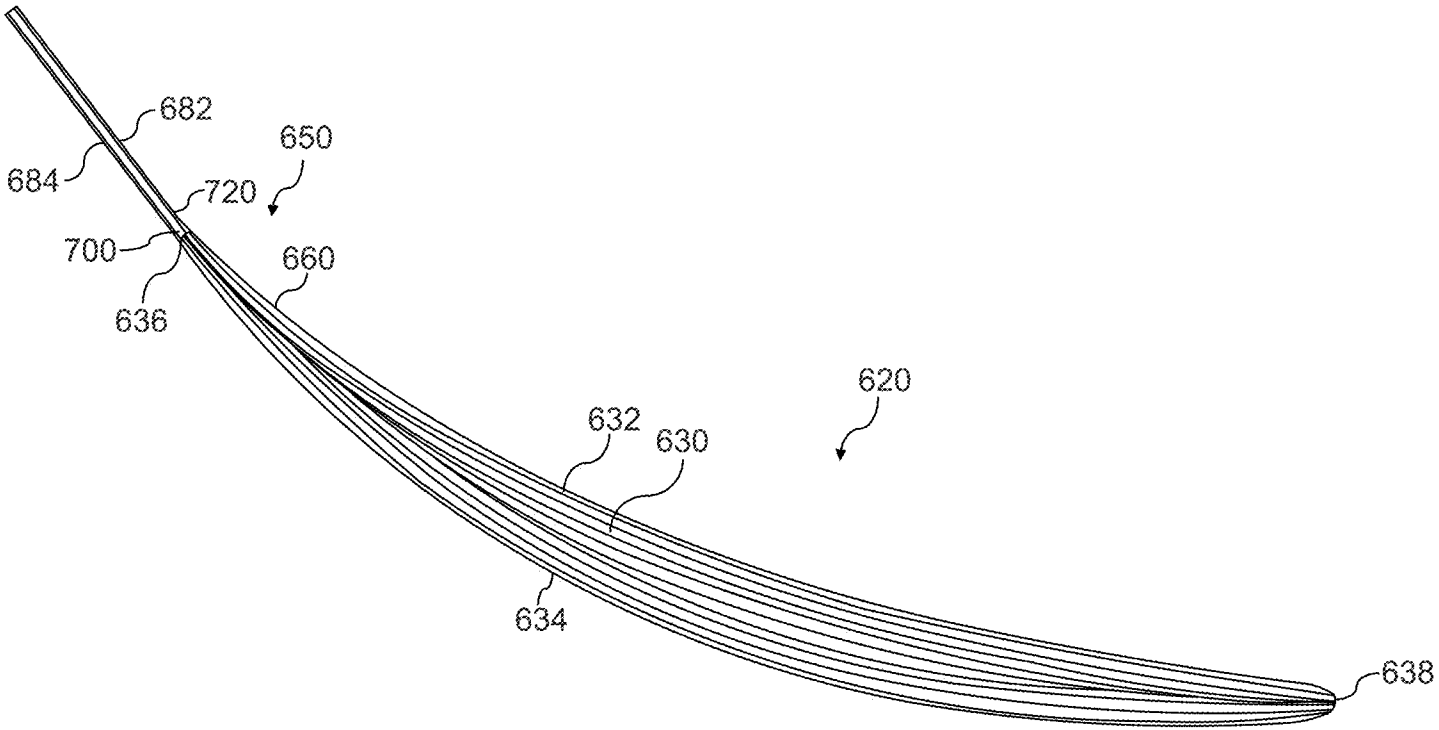
FIG. 13 provides a cross-sectional view of an airfoil having a leading edge wrap prior to being machined.
Figure 14:
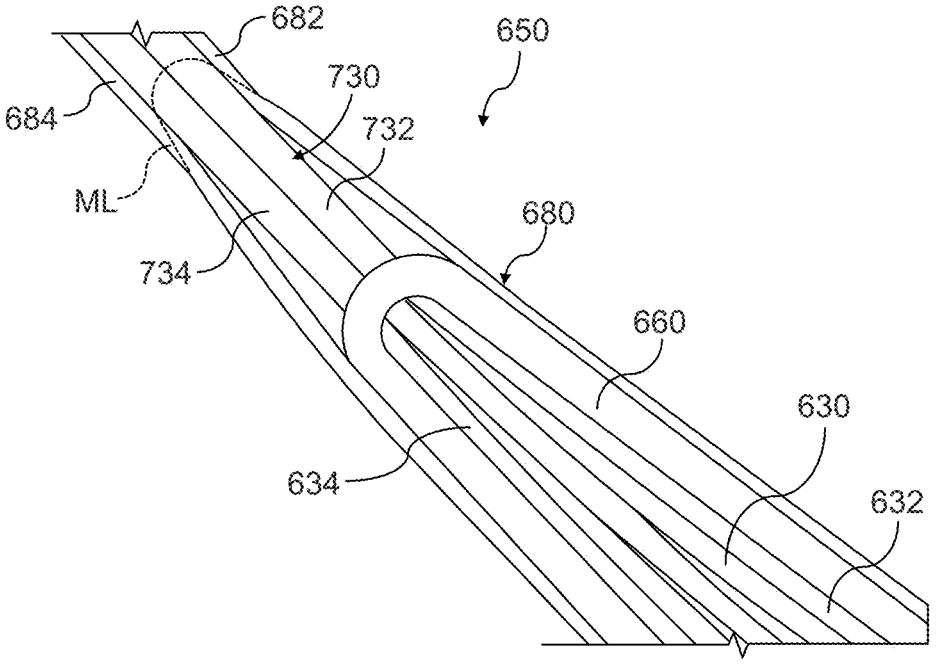
FIG. 14 provides a close-up cross-sectional view of a leading edge wrap of the airfoil of FIG. 11.
Figure 15:
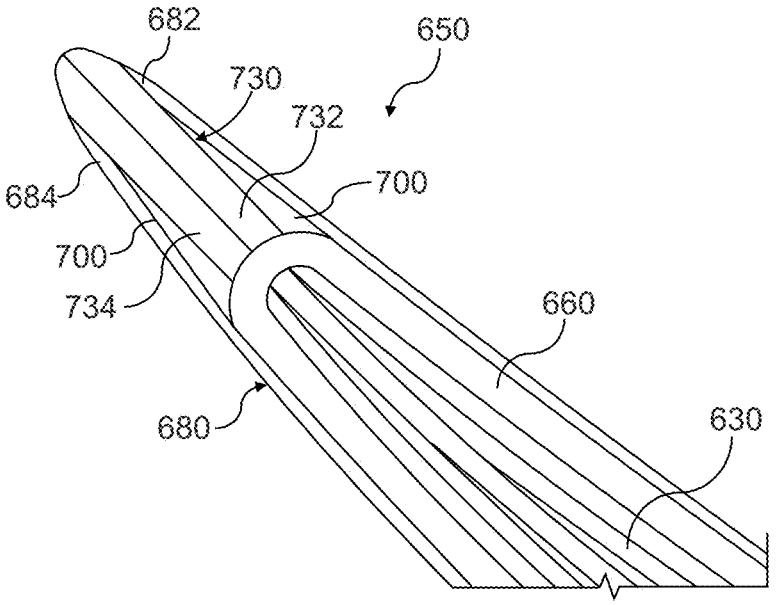
FIG. 15 provides a close-up cross-sectional view of the leading edge wrap of the airfoil of FIG. 11 after the leading edge wrap has been machined to specification.

Referring now to FIGS. 13, 14, and 15, collectively, various views are provided showing a progression of how an engine component having a composite airfoil equipped with a leading edge protective wrap is formed to specification according to example embodiment of the present disclosure.

In particular, FIG. 13 provides a cross-sectional view of an airfoil 620 having a leading edge protective wrap 650 prior to being machined. For this embodiment, the airfoil 620 is a part of a fan blade of an aviation gas turbine engine.

FIG. 14 provides a close-up cross-sectional view of the leading edge protective wrap 650 of the airfoil 620 of FIG. 13.

FIG. 15 provides a close-up cross-sectional view of the leading edge protective wrap 650 of the airfoil 620 of FIG. 13 after the leading edge protective wrap 650 has been machined to specification.

Although the leading edge protective wrap 650 is disclosed in this example embodiment as being applied to a composite core airfoil of a fan blade for an aviation gas turbine engine, it will be appreciated that the leading edge protective wrap 650 can be applied to other suitable composite airfoils of a gas turbine engine or turbomachine.

The leading edge protective wrap 650 can be applied to the composite core 630 to form the airfoil 620 using a suitable method. As one example, the composite core 630 can be laid up to specification in a suitable manner. The trailing wrap 660 can then be wrapped around the core leading edge 636 of the composite core 630. Then, a pressure sidewall 682 or a suction sidewall 686 of the leading edge wrap 680 can be laid up on a forming tool. The composite core 630 and wrapped trailing wrap 660 can be laid up on the pressure sidewall 682 or the suction sidewall 686 depending on which one is laid up on the forming tool.

Subsequently, a nose laminate 730 having one or more plies is laid up at least in part on the pressure sidewall 682 or the suction sidewall 686 depending on which one is laid up on the forming tool. For this embodiment, the nose laminate 730 has two plies, including a first ply 732 and a second ply 734. Notably, the nose laminate 730 forms a butt joint with the leading edge 662 of the trailing wrap 660. As is depicted in FIG. 14, the first ply 732 and the second ply 734 each form a butt joint with the trailing wrap 660 at its leading edge 662. The nose laminate 730 extends outward from the trailing wrap 660 as is depicted in FIG. 13. In certain exemplary embodiments, the nose laminate 730 has at least two plies. In other embodiments, the nose laminate 730 has at least three plies. In yet other embodiments, the nose laminate 730 has at least four plies. In addition, in certain exemplary embodiments, at least one ply 732, 734 of the nose laminate 730 and the trailing wrap 660 have the same thickness. For instance, as is depicted in FIG. 14, the first and second plies 732, 734 both have the same thickness as the trailing wrap 660.

With the nose laminate 730 laid up on the pressure sidewall 682 or the suction sidewall 686 depending on which one is laid up on the forming tool, the sidewall of the leading edge wrap 680 that has not yet been laid up is laid up at least in part on the nose laminate 730 and at least in part on the trailing wrap 660. For instance, assuming the suction sidewall 634 of the leading edge wrap 680 is laid up on the forming tool initially, the pressure sidewall 632 can be laid up at least in part on the first ply 732 of the nose laminate 730 and at least in part on the trailing wrap 660 as is depicted in FIG. 14.

The filler 700 can be added at any suitable stage, e.g., just before and/or after laying up the nose laminate 730. In some embodiments, filler 700 is positioned between at least one of: i) the nose laminate 730 and the pressure sidewall 682 of the leading edge wrap 680; and ii) the nose laminate 730 and the suction sidewall 686 of the leading edge wrap 680. In some embodiments, as is depicted in FIGS. 12 and 13, filler 700 is positioned between the nose laminate 730 and the pressure sidewall 682 of the leading edge wrap 680 and between the nose laminate 730 and the suction sidewall 686 of the leading edge wrap 680. In this way, the cavity or voids between the nose laminate 730, the leading edge wrap 680, and the trailing wrap 660 are filled. This may have advantageous mechanical properties.

With the composite core 630 and leading edge protective wrap 650 laid up, the extra stock can be machined off and the leading edge radius of the airfoil 620 can be shaped to specification. For instance, as is depicted in FIG. 14, the leading edge protective wrap 650 can be machined to specification along machine line ML to form the leading edge radius.

Referring particularly to FIG. 15, FIG. 15 depicts the leading edge radius machined to specification. As shown in FIG. 15, for this embodiment, the resultant airfoil 620 has a composite core 630 having a pressure sidewall 632 and a suction sidewall 634 each extending between a core leading edge 636 and a core trailing edge 638. The airfoil 620 has a leading edge protective wrap 650. The leading edge protective wrap 650 has trailing wrap 660 wrapped around the core leading edge 636. The trailing wrap 660 is connected to or otherwise positioned adjacent to the pressure sidewall 632 and the suction sidewall 634 of the composite core 630. The trailing wrap 660 has a leading edge 662 and having a pressure sidewall 664 and a suction sidewall 666. The leading edge protective wrap 650 also has a nose laminate 730. The nose laminate 730 forms a butt joint with the leading edge 662 of the trailing wrap 660.

Additionally, the leading edge protective wrap 650 has a leading edge wrap 680 having a pressure sidewall 682 and a suction sidewall 684. The pressure sidewall 682 of the leading edge wrap 680 is connected at least in part to the pressure sidewall 664 of the trailing wrap 660 and at least in part to the nose laminate 730, or more particularly, to the first ply 732 of the nose laminate 730. The suction sidewall 684 of the leading edge wrap 680 is connected at least in part to the suction sidewall 666 of the trailing wrap 660 and at least in part to the nose laminate 730, or more particularly, to the second ply 734 of the nose laminate 730. As depicted, the leading edge radius is formed in part by the nose laminate 730 and the leading edge wrap 680. In this regard, the pressure and suction sidewalls 682, 684 of the leading edge wrap 680 are not contiguous in this embodiment.

Figure 16:
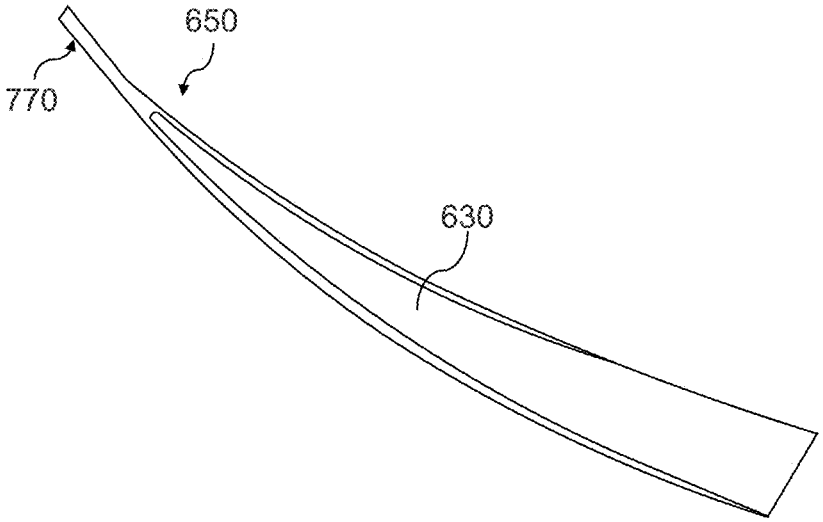
FIG. 16 provides a cross-sectional view of an airfoil having a leading edge wrap prior to being machined.
Figure 17:
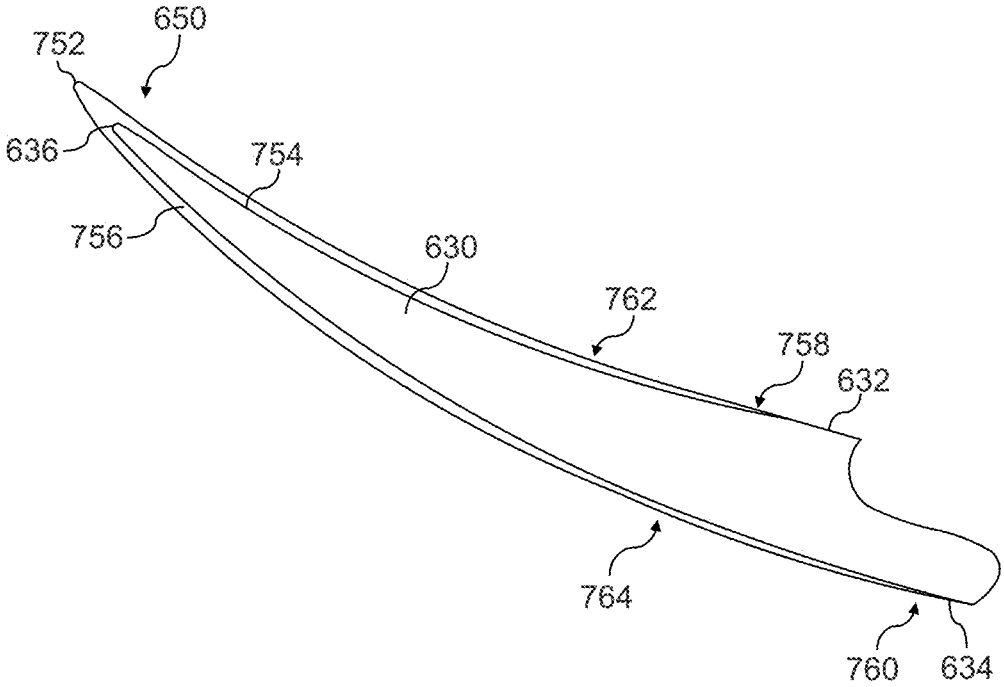
FIG. 17 provides a close-up cross-sectional view of the leading edge wrap of the airfoil of FIG. 16 after being machined to specification.

Referring now to FIGS. 16 and 17, collectively, various views are provided showing a progression of how an engine component having a composite airfoil equipped with a non-metallic leading edge protective wrap is formed to specification according to example embodiment of the present disclosure.

In particular, FIG. 16 provides a cross-sectional view of an airfoil 620 having a leading edge protective wrap 650 prior to being machined. For this embodiment, the airfoil 620 is a part of a fan blade of an aviation gas turbine engine.

FIG. 17 provides a close-up cross-sectional view of the leading edge protective wrap 650 of the airfoil 620 of FIG. 16 after being machined to specification.

Although the leading edge protective wrap 650 is disclosed in this example embodiment as being applied to a composite core airfoil of a fan blade for an aviation gas turbine engine, it will be appreciated that the leading edge protective wrap 650 can be applied to other suitable composite airfoils of a gas turbine engine or turbomachine.

For this embodiment, the leading edge protective wrap 650 is a single 3D woven wrap. That is, the 3D woven leading edge protective wrap 650 is formed of a non-metallic 3D woven material. The 3D woven wrap 650 can be an engineered multi-axis woven or braided fiberglass structure, for instance. In certain exemplary embodiments, the 3D woven wrap 650 can be constructed from a composite multifilament yarn. Using such a multifilament yarn allows for a Resin Transfer Molding (RTM) or RTM resin to mechanically bond/lock the 3D woven wrap 650 in place with respect to the composite core 630. In this regard, the 3D woven wrap 650 need not be reliant or as reliant on chemical bonding as in conventional metallic leading edge structures. In certain exemplary embodiments, the 3D woven leading edge protective wrap 650 can be co-molded with the composite core 630. In certain exemplary embodiments, the 3D woven leading edge protective wrap 650 can include fiberglass fibers woven in a 3D pattern. In other embodiments, the 3D woven leading edge protective wrap 650 can include silicon fibers woven in a 3D pattern.

As depicted, the 3D woven leading edge protective wrap 650 has a pressure sidewall 754 and a suction sidewall 756. The 3D woven leading edge protective wrap 650 is wrapped around the core leading edge 636 and is connected to the pressure sidewall 632 and the suction sidewall 634 of the composite core 630. The pressure sidewall 754 of the 3D woven leading edge protective wrap 650 terminates at a pressure side end 758 and the suction sidewall 756 terminates at a suction side end 760. Notably, the pressure sidewall 754 tapers from a pressure taper point 762 to the pressure side end 758 and the suction sidewall 756 tapers from a suction taper point 764 to the suction side end 760. The tapering of the pressure and suction sidewalls 754, 756 creates a smooth transition between the plies of the composite core 630 and the 3D woven leading edge protective wrap 650. Furthermore, for this embodiment, the suction sidewall 756 of the 3D woven leading edge protective wrap 650 extends along its suction side camber than does the pressure sidewall 754 along its pressure side camber as shown in FIGS. 16 and 16. The 3D woven leading edge protective wrap 650 can span the entire span length SL (FIG. 8) of the airfoil 620 or can span along a portion of the span length SL.

The 3D woven leading edge protective wrap 650 can be applied to the composite core 630 to form the airfoil 620 in the following example manner. The 3D woven leading edge protective wrap 650 can be wrapped around the core leading edge 636 of the composite core 630. In particular, the pressure sidewall 754 of the 3D woven leading edge protective wrap 650 is connected to or otherwise positioned adjacent to the pressure sidewall 632 of the composite core 630 and the suction sidewall 756 of the 3D woven leading edge protective wrap 650 is connected to or otherwise positioned adjacent to the suction sidewall 634 of the composite core 630. The 3D woven leading edge protective wrap 650 is wrapped tightly around the core leading edge 636 of the composite core 630 so that there are no resulting voids or cavities. Notably, the composite core 630 is laid up to account for the 3D woven leading edge protective wrap 650 to be wrapped or applied thereto. In particular, the pressure sidewall 632 and the suction sidewall 634 of the composite core 630 can be laid up to account for the tapered geometry of the 3D woven leading edge protective wrap 650. The complementary layup of the composite core 630 facilitates placement or wrapping of the 3D woven leading edge protective wrap 650 onto the composite core 630.

As is best shown in FIG. 16, the 3D woven leading edge protective wrap 650 initially has excess stock 770 extending outward from where the pressure sidewall 754 and the suction sidewall 756 connect. To create the leading edge 752 (FIG. 17) and the radius of the leading edge of the airfoil 620 more generally, the excess stock 770 is machined away using a suitable machining technique. As shown in FIG. 17, the leading edge 752 and the radius of the airfoil 620 have been machined to specification. Thereafter, optionally, a protective nose (not shown) can be applied to the leading edge 752 for extra protection. Furthermore, optionally, one or more protective coatings can be applied to the airfoil 620.

This written description uses examples to disclose the present disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

Further aspects are provided by the subject matter of the following clauses:

A turbomachine for an aircraft, comprising: an annular casing; and a fan disposed inside the annular casing and mounted for rotation about an axial centerline, the fan including fan blades that extend radially outwardly toward the annular casing; wherein the fan includes an average fan chord width of the fan blades ("c"), a diameter of the fan ("D"), a fan pressure ratio ("FPR"), and a redline corrected fan tip Mach number $$(\text{“}M_{tip,c}^{(RL)}\text{”}),$$

according to a First Performance Factor; wherein $$FPF = \left[\frac{c}{0.15 \cdot D}\right] \Big/ \left[\left[\frac{\sqrt{FPR-1}}{\sqrt{0.4}}\right] \Big/ M_{tip,c}^{(RL)}\right] - 1.23,$$

and wherein $$m_1 \cdot \left[M_{tip,c}^{(RL)} - 1.1\right] + 6 > FPF > m_1 \cdot \left[M_{tip,c}^{(RL)} - 1.1\right] + \Delta y_1,$$

and wherein $0<\Delta y_1<6$.

The turbomachine of one or more of these clauses wherein $$M_{tip,c}^{(RL)}$$

is within a range equal to or greater than 0.45 and equal to or less than 1.34.

The turbomachine of one or more of these clauses wherein $$M_{tip,c}^{(RL)}$$

is within a range equal to or greater than 0.45 and equal to or less than 1.12.

The turbomachine of one or more of these clauses wherein $m_1$ is equal to 0.87 when $$M_{tip,c}^{(RL)}$$

is greater than or equal to 1.1.

The turbomachine of one or more of these clauses wherein $m_1$ is equal to 1.0 when $$M_{tip,c}^{(RL)}$$

is greater than or equal to 1.1.

The turbomachine of one or more of these clauses wherein $m_1$ is equal to 2.5 when $$M_{tip,c}^{(RL)}$$

is less than 1.1.

The turbomachine of one or more of these clauses wherein $m_1$ is equal to 3.34 when $$M_{tip,c}^{(RL)}$$

is less than 1.1.

The turbomachine of one or more of these clauses wherein $\Delta y_1$ is equal to or greater than 0.0125 and less than 6.

The turbomachine of one or more of these clauses wherein $\Delta y_1$ is equal to or greater than 0.04 and less than 6.

The turbomachine of one or more of these clauses wherein $\Delta y_1$ is equal to or greater than 0.07 and less than 6.

The turbomachine of one or more of these clauses wherein $\Delta y_1$ is equal to or greater than 0.1 and less than 6.

The turbomachine of one or more of these clauses wherein $\Delta y_1$ is equal to or greater than 0.2 and less than 6.

The turbomachine of one or more of these clauses wherein the turbomachine has a gear ratio within a range equal to or greater than 3.2 and equal to or less than 5.0.

The turbomachine of one or more of these clauses wherein the fan blade includes an airfoil portion made from a polymer matrix composite (PMC) material, a metallic leading edge, the ratio c/D is between 0.16 and 0.21, and the fan has between 16 and 25 fan blades.

The turbomachine of one or more of these clauses wherein ratio c/D is within a range equal to or greater than 0.1 and equal to or less than 0.3.

The turbomachine of one or more of these clauses wherein ratio c/D is within a range equal to or greater than 0.15 and equal to or less than 0.21.

The turbomachine of one or more of these clauses wherein ratio c/D is equal to or greater than 0.1.

The turbomachine of one or more of these clauses wherein ratio c/D is equal to or less than 0.3.

The turbomachine of one or more of these clauses wherein FPR is within a range equal to or greater than 1.2 and equal to or less than 1.5.

The turbomachine of one or more of these clauses wherein FPR is within a range equal to or greater than 1.3 and equal to or less than 1.45.

The turbomachine of one or more of these clauses wherein FPR is equal to or greater than 1.2.

The turbomachine of one or more of these clauses wherein FPR is equal to or greater than 1.3.

The turbomachine of one or more of these clauses wherein FPR is equal to or less than 1.5.

The turbomachine of one or more of these clauses wherein FPR is equal to or less than 1.45.

The turbomachine of one or more of these clauses wherein $U_{c(tip)}$ is within a range equal to or greater than 500 ft/sec and equal to or less than 1,500 ft/sec.

The turbomachine of one or more of these clauses wherein $U_{c(tip)}$ is within a range equal to or greater than 500 ft/sec and equal to or less than 1,250 ft/sec.

A turbomachine comprising: an annular casing; and a fan disposed inside the annular casing and mounted for rotation about an axial centerline, the fan including fan blades that extend radially outwardly toward the annular casing; wherein the fan includes a fan hub-to-tip ratio ("HTR"), a fan blade count ("BC"), a fan pressure ratio ("FPR"), and a redline corrected redline fan tip Mach number $$(\text{“}M_{tip,c}^{(RL)}\text{”})$$

according to a Second Performance Factor ("SPF"), $$SPF = \sqrt{\frac{\pi}{4}(1 - HTR^2)} \Big/ \left(\frac{BC}{20}\right) \Big/ \left(\frac{\sqrt{FPR - 1}}{\sqrt{0.4}}\right) \Big/ M_{tip,c}^{(RL)} - 0.97, ,$$

wherein $$m_2 \cdot \left[M_{tip,c}^{(RL)} - 1.1\right] + 1.5 > SPF > m_2 \cdot \left[M_{tip,c}^{(RL)} - 1.1\right] + \Delta y_2,$$

and wherein $0<\Delta y_2<1.5$.

The turbomachine of one or more of these clauses wherein $\Delta y_2$ is equal to or greater than 0.0075 and less than 1.5.

The turbomachine of one or more of these clauses wherein $\Delta y_2$ is equal to or greater than 0.01 and less than 1.5.

The turbomachine of one or more of these clauses wherein $\Delta y_2$ is equal to or greater than 0.02 and less than 1.5.

The turbomachine of one or more of these clauses wherein $\Delta y_2$ is equal to or greater than 0.024 and less than 1.5.

The turbomachine of one or more of these clauses wherein $\Delta y_2$ is equal to or greater than 0.037 and less than 1.5.

The turbomachine of one or more of these clauses wherein $\Delta y_2$ is equal to or greater than 0.04 and less than 1.5.

The turbomachine of one or more of these clauses wherein $\Delta y_2$ is equal to or greater than 0.06 and less than 1.5.

The turbomachine of one or more of these clauses wherein $m_2$ is equal to 0.41 when $$M_{tip,c}^{(RL)}$$

is greater than or equal to 1.1.

The turbomachine of one or more of these clauses wherein $m_2$ is equal to 0.55 when $$M_{tip,c}^{(RL)}$$

is less than 1.1.

The turbomachine of one or more of these clauses wherein HTR is within a range equal to or greater than 0.1 and equal to or less than 0.5.

The turbomachine of one or more of these clauses wherein HTR is within a range equal to or greater than 0.2 and equal to or less than 0.275.

The turbomachine of one or more of these clauses wherein HTR is within a range equal to or greater than 0.2 and equal to or less than 0.25.

The turbomachine of one or more of these clauses wherein HTR is equal to or greater than 0.1.

The turbomachine of one or more of these clauses wherein HTR is equal to or less than 0.5.

The turbomachine of one or more of these clauses wherein BC is within a range equal to or greater than 10 and equal to or less than 18.

The turbomachine of one or more of these clauses wherein FPR is within a range equal to or greater than 1.2 and equal to or less than 1.5.

The turbomachine of one or more of these clauses wherein FPR is within a range equal to or greater than 1.3 and equal to or less than 1.45.

A method of assembly, comprising: mounting a fan inside an annular casing for rotation about an axial centerline, the fan including fan blades that extend radially outwardly toward the annular casing; wherein the fan includes an average fan chord width of the fan blades ("c"), a diameter of the fan ("D"), a fan pressure ratio ("FPR"), and a redline corrected fan tip redline Mach number $$(\text{“}M_{tip,c}^{(RL)}\text{”})$$

according to a First Performance Factor ("FPF"), wherein:

$$FPF = \left[\frac{c}{0.15 \cdot D}\right] \Big/ \left[\left[\frac{\sqrt{FPR - 1}}{\sqrt{0.4}}\right] \Big/ M_{tip,c}^{(RL)}\right] - 1.23;$$

$$m_1 \cdot \left[M_{tip,c}^{(RL)} - 1.1\right] + 6 > FPF > m_1 \cdot \left[M_{tip,c}^{(RL)} - 1.1\right] + \Delta y_1;$$

and $0<\Delta y_1<6$; or wherein the fan includes a fan hub-to-tip ratio ("HTR"), a fan blade count ("BC"), FPR, and $$M_{tip,c}^{(RL)}$$

according to a Second Performance Factor ("SPF"), wherein:

$$SPF = \sqrt{\frac{\pi}{4}(1 - HTR^2) \Big/ \left(\frac{BC}{20}\right)} \Big/ \left(\frac{\sqrt{FPR - 1}}{\sqrt{0.4}}\right) \Big/ M_{tip,c}^{(RL)} - 0.97;$$

$$m_2 \cdot \left[M_{tip,c}^{(RL)} - 1.1\right] + 1.5 > SPF > m_2 \cdot \left[M_{tip,c}^{(RL)} - 1.1\right] + \Delta y_2;$$

and $0<\Delta y_2<1.5$.

A turbomachine for an aircraft, comprising: an annular casing; and a fan disposed inside the annular casing and mounted for rotation about an axial centerline, the fan including fan blades that extend radially outwardly toward the annular casing; wherein the fan includes an average fan chord width of the fan blades ("c"), a diameter of the fan ("D"), a fan pressure ratio ("FPR"), and a redline corrected fan tip Mach number $$(\text{“}M_{tip,c}^{(RL)}\text{”}),$$

according to a First Performance Factor; wherein $$FPF = \left[\frac{c}{0.15 \cdot D}\right] \Big/ \left[\left[\frac{\sqrt{FPR - 1}}{\sqrt{0.4}}\right] \Big/ M_{tip,c}^{(RL)}\right] - 1.23,$$

and wherein $$m_1 \cdot \left[M_{tip,c}^{(RL)} - 1.1\right] + 9.14 > FPF > m_2 \cdot \left[M_{tip,c}^{(RL)} - 1.1\right],$$

wherein $m_1$ is equal to 9.43 when $$M_{tip,c}^{(RL)}$$

is greater than or equal to 1.1 and is equal to 27.02 when $$M_{tip,c}^{(RL)}$$

is less than 1.1, and wherein $m_2$ is equal to 0.87 when $$M_{tip,c}^{(RL)}$$

is greater than or equal to 1.1 and is equal to 3.34 when $$M_{tip,c}^{(RL)}$$

is less than 1.1.

The turbomachine of one or more of these clauses wherein FPF is within a range equal to or greater than –0.8 and equal to or less than 8.4.

The turbomachine of one or more of these clauses wherein FPF is within a range equal to or greater than 0 and equal to or less than 6.

The turbomachine of one or more of these clauses wherein FPF is within a range equal to or greater than 1 and equal to or less than 2.

The turbomachine of one or more of these clauses wherein $$M_{tip,c}^{(RL)}$$

is within a range equal to or greater than 0.8 and equal to or less than 1.5.

The turbomachine of one or more of these clauses wherein $$M_{tip,c}^{(RL)}$$

is within a range tip,c equal to or greater than 0.9 and equal to or less than 1.4.

The turbomachine of one or more of these clauses wherein ratio c/D is within a range equal to or greater than 0.1 and equal to or less than 0.3.

The turbomachine of one or more of these clauses wherein FPR is within a range equal to or greater than 1.2 and equal to or less than 1.6.

The turbomachine of one or more of these clauses wherein FPR is within a range equal to or greater than 1.3 and equal to or less than 1.5.

The turbomachine of one or more of these clauses wherein FPR is within a range equal to or greater than 1.35 and equal to or less than 1.45.

The turbomachine of one or more of these clauses wherein the turbomachine has a gear ratio within a range equal to or greater than 3.2 and equal to or less than 5.0.

The turbomachine of one or more of these clauses wherein the fan blade includes an airfoil portion made from a polymer matrix composite (PMC) material, a metallic leading edge, the ratio c/D is between 0.16 and 0.21, and the fan has between 16 and 25 fan blades.

A turbomachine comprising: an annular casing; and a fan disposed inside the annular casing and mounted for rotation about an axial centerline, the fan including fan blades that extend radially outwardly toward the annular casing; wherein the fan includes a fan hub-to-tip ratio ("HTR"), a fan blade count ("BC"), a fan pressure ratio ("FPR"), and a redline corrected redline fan tip Mach number $$(\text{“}M_{tip,c}^{(RL)}\text{”})$$

according to a Second Performance Factor ("SPF"), $$SPF = SPF = \sqrt{\frac{\pi}{4}(1 - HTR^2) \Big/ \left(\frac{BC}{20}\right)} \Big/ \left(\frac{\sqrt{FPR - 1}}{\sqrt{0.4}}\right) \Big/ M_{tip,c}^{(RL)} - 0.97,$$

wherein $$m_3 \cdot \left[M_{tip,c}^{(RL)} - 1.1\right] + 2.52 > SPF > m_4 \cdot \left[M_{tip,c}^{(RL)} - 1.1\right]$$

wherein $m_3$ is equal to 3.17, and wherein $m_4$ is equal to 0.41 when $$M_{tip,c}^{(RL)}$$

is greater than or equal to 1.1 and is equal to 0.55 when $$M_{tip,c}^{(RL)}$$

is less than 1.1.

The turbomachine of one or more of these clauses wherein SPF is within a range equal to or greater than 0.087 and equal to or less than 2.4.

The turbomachine of one or more of these clauses wherein SPF is within a range equal to or greater than 1 and equal to or less than 2.

An airfoil for a turbine engine, the airfoil comprising: a composite core having a pressure sidewall and a suction sidewall extending between a core leading edge and a core trailing edge; a leading edge protective wrap, comprising: a trailing wrap wrapped around the core leading edge and connected to the pressure sidewall and the suction sidewall of the composite core, the trailing wrap having a leading edge and having a pressure sidewall and a suction sidewall; a leading wrap wrapped around the core leading edge and the leading edge of the trailing wrap and connected to the pressure sidewall and the suction sidewall of the trailing wrap, the leading wrap having a leading edge that is spaced from the leading edge of the trailing wrap; and a filler positioned between the leading edge of the trailing wrap and the leading edge of the leading wrap.

The airfoil of any preceding clause, further comprising: a protective nose connected to the leading edge of the leading wrap.

The airfoil of any preceding clause, wherein the trailing wrap and the leading wrap are formed of a non-metallic material.

The airfoil of any preceding clause, wherein the non-metallic material is a fibrous composite material.

The airfoil of any preceding clause, wherein the fibrous composite material is formed of at least one of an S-glass, carbon, E-glass, and Kevlar material.

The airfoil of any preceding clause, wherein the trailing wrap has a first thickness and the leading wrap has a second thickness that is less thick than the first thickness.

The airfoil of any preceding clause, wherein the second thickness of the leading wrap is less than half the first thickness of the trailing wrap.

The airfoil of any preceding clause, wherein the second thickness of the leading wrap is less than one third the first thickness of the trailing wrap.

The airfoil of any preceding clause, wherein the composite core defines a pressure sidewall camber distance and a suction sidewall camber distance, the pressure sidewall camber distance spans between the core leading edge and the core trailing edge along the pressure sidewall of the composite core and the suction sidewall camber distance spans between the core leading edge and the core trailing edge along the suction sidewall of the composite core, and wherein the trailing wrap is wrapped around the core leading edge of the composite core such that trailing wrap extends from the core leading edge at least twenty percent of the pressure sidewall camber distance and from the core leading edge at least twenty percent of the suction sidewall camber distance.

The airfoil of any preceding clause, wherein at least one of the leading wrap and the trailing wrap has fibers that wrap unbroken around the core leading edge.

The airfoil of any preceding clause, wherein the filler is formed of at least one of a resin, an adhesive, composite tows, a 2D weave, a 3D weave, rolled fibers, and a preform.

The airfoil of any preceding clause, wherein the composite core extends between a base and a tip defining a span length, and wherein the leading wrap, the trailing wrap, and the filler extend the span length of the composite core.

The airfoil of any preceding clause, wherein the leading wrap extends between a pressure side end and a suction side end, the pressure side end being connected to the pressure sidewall of the trailing wrap and the suction side end being connected to the suction sidewall of the trailing wrap, and wherein the leading wrap is thinner at the leading edge of the leading wrap than at one or both of the pressure side end and the suction side end.

The airfoil of any preceding clause, wherein the trailing wrap extends between a pressure side end and a suction side end, the pressure side end being connected to the pressure sidewall of the composite core and the suction side end being connected to the suction sidewall of the composite core, and wherein the trailing wrap is thinner at the leading edge of the trailing wrap than at one or both of the pressure side end and the suction side end.

An airfoil for a turbine engine, the airfoil comprising: a composite core having a pressure sidewall and a suction sidewall each extending between a core leading edge and a core trailing edge; a leading edge protective wrap, comprising: a trailing wrap wrapped around the core leading edge and connected to the pressure sidewall and the suction sidewall of the composite core, the trailing wrap having a pressure sidewall and a suction sidewall; a nose laminate, the nose laminate forming a butt joint with the leading edge of the trailing wrap; and a leading wrap having a pressure sidewall and a suction sidewall, the pressure sidewall of the leading wrap being connected at least in part to the pressure sidewall of the trailing wrap and at least in part to the nose laminate, the suction sidewall of the leading wrap being connected at least in part to the suction sidewall of the trailing wrap and at least in part to the nose laminate.

The airfoil of any preceding clause, further comprising: a filler positioned between at least one of: the nose laminate and the pressure sidewall of the leading wrap, and the nose laminate and the suction sidewall of the leading wrap.

The airfoil of any preceding clause, wherein the nose laminate has at least two plies, and wherein at least one ply of the at least two plies of the nose laminate and the trailing edge wrap have the same thickness.

An airfoil for a turbine engine, the airfoil comprising: a composite core having a pressure sidewall and a suction sidewall extending between a core leading edge and a core trailing edge; and a leading edge protective wrap wrapped around the core leading edge and connected to the pressure sidewall and the suction sidewall of the composite core, the leading edge protective wrap being formed of a 3D woven material.

The airfoil of any preceding clause, wherein the leading edge protective wrap has a leading edge, a pressure sidewall connected to the pressure sidewall of the composite core, and a suction sidewall connected to the suction sidewall of the composite core.

The airfoil of any preceding clause, wherein the pressure sidewall of the leading edge protective wrap tapers from a pressure taper point positioned along the pressure sidewall of the leading edge protective to a pressure side end of the leading edge protective wrap and the suction sidewall of the leading edge protective wrap tapers from a suction taper point positioned along the suction sidewall of the leading edge protective to a suction side end of the leading edge protective wrap.

A method of forming an airfoil, comprising: laying up a composite core, the composite core having a first sidewall and a second sidewall connected at a core leading edge; wrapping a trailing wrap around the core leading edge of the composite core, the trailing wrap having a first sidewall and a second sidewall connected at a leading edge; and wrapping a leading wrap around the core leading edge of the composite core and the leading edge of the trailing wrap.

The method of any preceding clause, further comprising: inserting a filler between the leading edge of the trailing wrap and the leading edge of the leading wrap.

The method of any preceding clause, further comprising: connecting a protective nose to the leading edge of the leading wrap.

The method of any preceding clause, wherein the trailing wrap is formed of a non-metallic material.

The method of any preceding clause, wherein the leading wrap is formed of a non-metallic material.

The method of any preceding clause, wherein the trailing wrap and the leading wrap are formed of a non-metallic material.

The method of any preceding clause, wherein the non-metallic material forming the leading wrap and/or the trailing wrap is a fibrous composite material.

The method of any preceding clause, wherein the fibrous composite material is formed of at least one of an S-glass, carbon, E-glass, and Kevlar material.

The method of any preceding clause, wherein the trailing wrap has a first thickness and the leading wrap has a second thickness that is less thick than the first thickness.

The method of any preceding clause, wherein the second thickness of the leading wrap is less than half the first thickness of the trailing wrap.

The method of any preceding clause, wherein the second thickness of the leading wrap is less than one third the first thickness of the trailing wrap.

The method of any preceding clause, wherein the composite core defines a pressure sidewall camber distance and a suction sidewall camber distance, the pressure sidewall camber distance spans between the core leading edge and the core trailing edge along the pressure sidewall of the composite core and the suction sidewall camber distance spans between the core leading edge and the core trailing edge along the suction sidewall of the composite core, and wherein the trailing wrap is wrapped around the core leading edge of the composite core such that trailing wrap extends from the core leading edge at least twenty percent of the pressure sidewall camber distance and from the core leading edge at least twenty percent of the suction sidewall camber distance.

The method of any preceding clause, wherein at least one of the leading wrap and the trailing wrap has fibers that wrap unbroken around the core leading edge.

The method of any preceding clause, wherein at least one of the leading wrap and the trailing wrap is formed of a 3D weave having fibers that wrap unbroken around the core leading edge.

The method of any preceding clause, wherein at least one of the leading wrap and the trailing wrap is formed of a 2D weave having fibers that wrap unbroken around the core leading edge.

The method of any preceding clause, wherein the filler is formed of at least one of a resin, an adhesive, composite tows, a 2D weave, a 3D weave, rolled fibers, and a preform.

The method of any preceding clause, wherein the composite core extends between a base and a tip defining a span length, and wherein the leading wrap, the trailing wrap, and the filler extend the span length of the composite core.

The method of any preceding clause, wherein the leading wrap extends between a pressure side end and a suction side end, the pressure side end being connected to the pressure sidewall of the trailing wrap and the suction side end being connected to the suction sidewall of the trailing wrap, and wherein the leading wrap is thinner at the leading edge of the leading wrap than at one or both of the pressure side end and the suction side end.

The method of any preceding clause, wherein the trailing wrap extends between a pressure side end and a suction side end, the pressure side end being connected to the pressure sidewall of the composite core and the suction side end being connected to the suction sidewall of the composite core, and wherein the trailing wrap is thinner at the leading edge of the trailing wrap than at one or both of the pressure side end and the suction side end.

A method of forming an airfoil, comprising: laying up a composite core, the composite core having a core leading edge; wrapping a trailing wrap around the core leading edge of the composite core, the trailing wrap having a first sidewall and a second sidewall connected at a leading edge; laying up a first sidewall of a leading wrap along the first sidewall of the trailing wrap; laying up a nose laminate at least in part on the first sidewall of the leading wrap, the nose laminate forming a butt joint with the leading edge of the trailing wrap; laying up a second sidewall of the leading wrap at least in part on the nose laminate and at least in part on the second sidewall of the trailing wrap; and machining a leading edge radius of the airfoil.

The method of any preceding clause, further comprising: adding filler between the first sidewall of the leading wrap and the nose laminate.

The method of any preceding clause, further comprising: adding filler between the second sidewall of the leading wrap and the nose laminate.

The method of any preceding clause, wherein the first sidewall of the trailing wrap is thicker than the first sidewall of the leading wrap.

The method of any preceding clause, wherein the second sidewall of the trailing wrap is thicker than the second sidewall of the leading wrap.

The method of any preceding clause, wherein the nose laminate is formed of at least two plies.

The method of any preceding clause, wherein the leading edge radius is formed in part by the nose laminate and in part by the leading wrap, wherein the first sidewall and the second sidewall of the leading wrap are not contiguous at the leading edge radius of the airfoil.

The method of any preceding clause, wherein the airfoil is a component of an aviation gas turbine engine.

The method of any preceding clause, wherein the airfoil is a component of a compressor of an aviation gas turbine engine.

The method of any preceding clause, wherein the airfoil is a component of a turbine of an aviation gas turbine engine.

The method of any preceding clause, wherein the airfoil is a component of a fan of a turbofan.

The method of any preceding clause, wherein the first sidewall and the second sidewall of the trailing wrap are a suction sidewall and pressure sidewall, respectively.

The method of any preceding clause, wherein the first sidewall and the second sidewall of the leading wrap are a suction sidewall and pressure sidewall, respectively.

A method of forming an airfoil, comprising: laying up a composite core, the composite core having a first sidewall and a second sidewall connected at a core leading edge; and wrapping a 3D woven leading edge wrap around the core leading edge.

The method of any preceding clause, further comprising: machining the 3D woven leading edge wrap to form a leading edge radius of the airfoil.

The method of any preceding clause, wherein the 3D woven leading edge wrap if formed of a non-metallic 3D woven material.

The method of any preceding clause, wherein the 3D woven leading edge wrap is wrapped around the core leading edge such that a first sidewall of the 3D woven leading edge wrap is positioned adjacent to a first sidewall of the composite core and a second sidewall of the 3D woven leading edge wrap is positioned adjacent to a second sidewall of the composite core.

The method of any preceding clause, wherein the 3D woven leading edge wrap is wrapped around the core leading edge of the composite core so that there are no resulting voids or cavities between the 3D woven leading edge wrap and the composite core.

The method of any preceding clause, wherein a first sidewall of the 3D woven leading edge wrap tapers from a first taper point to an end of the first sidewall. Additionally, or alternatively, a second sidewall of the 3D woven leading edge wrap tapers from a second taper point to an end of the second sidewall.

The method of any preceding clause, wherein the 3D woven leading edge wrap is co-molded with the composite core.

The method of any preceding clause, wherein the 3D woven leading edge wrap is an engineered multi-axis woven structure.

The method of any preceding clause, wherein the 3D woven leading edge wrap is a braided fiberglass structure.

The method of any preceding clause, wherein the 3D woven leading edge wrap is formed of a composite multi-filament yarn.

The method of any preceding clause, wherein the 3D woven leading edge wrap is formed of silicon fibers woven in a 3D pattern.

A turbomachine for an aircraft, comprising: an annular casing; and a fan disposed inside the annular casing and mounted for rotation about an axial centerline, the fan including fan blades that extend radially outwardly toward the annular casing; wherein the fan includes an average fan chord width of the fan blades ("c"), a diameter of the fan ("D"), a fan pressure ratio ("FPR"), and a redline corrected fan tip speed ("$U_{c(tip)}$"), according to a First Performance Factor; wherein $FPF=[c/D]/[\sqrt{FPR-1}/U_{c(tip)}]$; and wherein $0.24*U_{c(tip)}+489>FPF>0.24*U_{c(tip)}-12+dy_1$ and wherein $0<dy_1<500$.

The turbomachine of one or more of these clauses wherein ratio c/D is within a range equal to or greater than 0.1 and equal to or less than 0.3.

The turbomachine of one or more of these clauses wherein ratio c/D is within a range equal to or greater than 0.15 and equal to or less than 0.21.

The turbomachine of one or more of these clauses wherein ratio c/D is equal to or greater than 0.1.

The turbomachine of one or more of these clauses wherein ratio c/D is equal to or less than 0.3.

The turbomachine of one or more of these clauses wherein FPR is within a range equal to or greater than 1.2 and equal to or less than 1.5.

The turbomachine of one or more of these clauses wherein FPR is within a range equal to or greater than 1.3 and equal to or less than 1.45.

The turbomachine of one or more of these clauses wherein FPR is equal to or greater than 1.2.

The turbomachine of one or more of these clauses wherein FPR is equal to or greater than 1.3.

The turbomachine of one or more of these clauses wherein FPR is equal to or less than 1.5.

The turbomachine of one or more of these clauses wherein FPR is equal to or less than 1.45.

The turbomachine of one or more of these clauses wherein $U_{c(tip)}$ is within a range equal to or greater than 500 ft/sec and equal to or less than 1,500 ft/sec.

The turbomachine of one or more of these clauses wherein $U_{c(tip)}$ is within a range equal to or greater than 500 ft/sec and equal to or less than 1,250 ft/sec.

The turbomachine of one or more of these clauses wherein $dy_1$ is equal to or greater than 7.5 and equal to or less than 500.

The turbomachine of one or more of these clauses wherein $dy_1$ is equal to or greater than 16 and equal to or less than 500.

The turbomachine of one or more of these clauses wherein $dy_1$ is equal to or greater than 25 and equal to or less than 500.

A turbomachine comprising: an annular casing; and a fan disposed inside the annular casing and mounted for rotation about an axial centerline, the fan including fan blades that extend radially outwardly toward the annular casing; wherein the fan includes a fan hub-to-tip ratio ("HTR"), a fan blade count ("BC"), a fan pressure ratio ("FPR"), and a redline corrected fan tip speed ("$U_{c(tip)}$") according to a Second Performance Factor ("SPF"); wherein $$SPF = \sqrt{\frac{\pi}{4}\cdot\left(\frac{1-HTR^2}{BC}\right)} \Big/ \left[\frac{\sqrt{FPR-1}}{U_{c(tip)}}\right];$$

and wherein $0.15*U_{c(tip)}+654>SPF>0.15*U_{c(tip)}+153+dy_2$ and wherein $0<dy_2<500$.

The turbomachine of one or more of these clauses wherein HTR is within a range equal to or greater than 0.1 and equal to or less than 0.5.

The turbomachine of one or more of these clauses wherein HTR is within a range equal to or greater than 0.2 and equal to or less than 0.275.

The turbomachine of one or more of these clauses wherein HTR is within a range equal to or greater than 0.2 and equal to or less than 0.25.

The turbomachine of one or more of these clauses wherein HTR is equal to or greater than 0.1.

The turbomachine of one or more of these clauses wherein HTR is equal to or less than 0.5.

The turbomachine of one or more of these clauses wherein BC is within a range equal to or greater than 10 and equal to or less than 18.

The turbomachine of one or more of these clauses wherein FPR is within a range equal to or greater than 1.2 and equal to or less than 1.5.

The turbomachine of one or more of these clauses wherein FPR is within a range equal to or greater than 1.3 and equal to or less than 1.45.

The turbomachine of one or more of these clauses wherein FPR is equal to or greater than 1.2.

The turbomachine of one or more of these clauses wherein FPR is equal to or greater than 1.3.

The turbomachine of one or more of these clauses wherein FPR is equal to or less than 1.5.

The turbomachine of one or more of these clauses wherein FPR is equal to or less than 1.45.

The turbomachine of one or more of these clauses wherein $U_{c(tip)}$ is within a range equal to or greater than 500 ft/sec and equal to or less than 1,500 ft/sec.

The turbomachine of one or more of these clauses wherein $U_{c(tip)}$ is within a range equal to or greater than 500 ft/sec and equal to or less than 1,250 ft/sec.

The turbomachine of one or more of these clauses wherein $dy_2$ is equal to 5 and equal to or less than 500.

The turbomachine of one or more of these clauses wherein $dy_2$ is equal to 10 and equal to or less than 500.

The turbomachine of one or more of these clauses wherein $dy_2$ is equal to 15 and equal to or less than 500.

A method of assembly, comprising: mounting a fan inside an annular casing for rotation about an axial centerline, the fan including fan blades that extend radially outwardly toward the annular casing; wherein the fan includes an average fan chord width of the fan blades ("c"), a diameter of the fan ("D"), a fan pressure ratio ("FPR"), and a redline corrected fan tip speed ("$U_{c(tip)}$") according to a First Performance Factor ("FPF"), wherein: $FPF=[c/D]/[\sqrt{FPR-1}/U_{c(tip)}]$; and $0.24*U_{c(tip)}+489>FPF>0.24*U_{c(tip)}-12+dy_1$ and wherein $0<dy_1<500$; or wherein the fan includes a fan hub-to-tip ratio ("HTR"), a fan blade count ("BC"), FPR, and $U_{c(tip)}$ according to a Second Performance Factor ("SPF"), wherein:

$$SPF = \sqrt{\frac{\pi}{4}\cdot\left(\frac{1-HTR^2}{BC}\right)}\Big/\left[\frac{\sqrt{FPR-1}}{U_{c(tip)}}\right];$$

and $0.15*U_{c(tip)}+654>SPF>0.15*U_{c(tip)}+153+dy_2$ and wherein $0<dy_2<500$.

A turbomachine for an aircraft comprising: an annular casing; a fan disposed inside the annular casing and mounted for rotation about an axial centerline, the fan including fan blades that extend radially outwardly toward the annular casing; and an airfoil comprising a composite core having a pressure sidewall and a suction sidewall extending between a core leading edge and a core trailing edge and a leading edge protective wrap; wherein the fan includes an average fan chord width of the fan blades ("c"), a diameter of the fan ("D"), a fan pressure ratio ("FPR"), and a redline corrected fan tip Mach number $$(\text{“}M_{tip,c}^{(RL)}\text{”})$$

according to a First Performance Factor ("FPF"), wherein $$FPF = \left[\frac{c}{0.15\cdot D}\right]\Big/\left[\left[\frac{\sqrt{FPR-1}}{\sqrt{0.4}}\right]\Big/M_{tip,c}^{(RL)}\right]-1.23,$$

wherein $$m_1\cdot\left[M_{tip,c}^{(RL)}-1.1\right]+9.14>FPF>m_2\cdot\left[M_{tip,c}^{(RL)}-1.1\right],$$

and wherein $m_1$ is equal to 9.43 when $$M_{tip,c}^{(RL)}$$

is greater than or equal to 1.1 and is equal to 27.02 when $$M_{tip,c}^{(RL)}$$

is less than 1.1, and wherein $m_2$ is equal to 0.87 when $$M_{tip,c}^{(RL)}$$

is greater than or equal to 1.1 and is equal to 3.34 when $$M_{tip,c}^{(RL)}$$

is less than 1.1.

The turbomachine of any preceding clause, wherein FPF is within a range equal to or greater than −0.8 and equal to or less than 8.4.

The turbomachine of any preceding clause, wherein FPF is within a range equal to or greater than 0 and equal to or less than 6.

The turbomachine of any preceding clause, wherein FPF is within a range equal to or greater than 1 and equal to or less than 2.

The turbomachine of any preceding clause, wherein $$M_{tip,c}^{(RL)}$$

is within a range equal to or greater than 0.8 and equal to or less than 1.5.

The turbomachine of any preceding clause, wherein $$M_{tip,c}^{(RL)}$$

is within a range equal to or greater than 0.9 and equal to or less than 1.4.

The turbomachine of any preceding clause, wherein ratio c/D is within a range equal to or greater than 0.1 and equal to or less than 0.3.

The turbomachine of any preceding clause, wherein FPR is within a range equal to or greater than 1.2 and equal to or less than 1.6.

The turbomachine of any preceding clause, wherein FPR is within a range equal to or greater than 1.3 and equal to or less than 1.5.

The turbomachine of any preceding clause, wherein FPR is within a range equal to or greater than 1.35 and equal to or less than 1.45.

The turbomachine of any preceding clause, wherein the turbomachine has a gear ratio within a range equal to or greater than 3.2 and equal to or less than 5.0.

The turbomachine of any preceding clause, wherein the fan blade includes an airfoil portion made from a polymer matrix composite (PMC) material, a metallic leading edge, the ratio c/D is between 0.16 and 0.21, and the fan has between 16 and 25 fan blades.

The turbomachine of any preceding clause, wherein the leading edge protective wrap comprises: a trailing wrap wrapped around the core leading edge and connected to the pressure sidewall and the suction sidewall of the composite core, the trailing wrap having a leading edge and having a pressure sidewall and a suction sidewall, and a leading wrap wrapped around the core leading edge and the leading edge of the trailing wrap and connected to the pressure sidewall and the suction sidewall of the trailing wrap, the leading wrap having a leading edge that is spaced from the leading edge of the trailing wrap.

The turbomachine of any preceding clause, wherein: leading wrap is connected to the pressure sidewall and the suction sidewall of the trailing wrap; the leading wrap includes a leading edge that is spaced from the leading edge of the trailing wrap; and the airfoil further comprises a filler positioned between the leading edge of the trailing wrap and the leading edge of the leading wrap.

The turbomachine of any preceding clause, wherein the airfoil further comprises a protective nose connected to the leading edge of the leading wrap.

The turbomachine of any preceding clause, wherein: the trailing wrap and the leading wrap are formed of a non-metallic material; the non-metallic material is a fibrous composite material; and the fibrous composite material is formed of at least one of an S-glass, carbon, E-glass, and Kevlar material.

The turbomachine of any preceding clause, wherein the trailing wrap has a first thickness and the leading wrap has a second thickness that is less thick than the first thickness.

The turbomachine of any preceding clause, wherein the second thickness of the leading wrap is less than half the first thickness of the trailing wrap.

The turbomachine of any preceding clause, wherein the composite core defines a pressure sidewall camber distance and a suction sidewall camber distance, the pressure sidewall camber distance spans between the core leading edge and the core trailing edge along the pressure sidewall of the composite core and the suction sidewall camber distance spans between the core leading edge and the core trailing edge along the suction sidewall of the composite core, and wherein the trailing wrap is wrapped around the core leading edge of the composite core such that trailing wrap extends from the core leading edge at least twenty percent of the pressure sidewall camber distance and from the core leading edge at least twenty percent of the suction sidewall camber distance.

The turbomachine of any preceding clause, wherein at least one of the leading wrap and the trailing wrap has fibers that wrap unbroken around the core leading edge.

The turbomachine of any preceding clause, wherein the filler is formed of at least one of a resin, an adhesive, composite tows, a 2D weave, a 3D weave, rolled fibers, and a preform.

The turbomachine of any preceding clause, wherein the composite core extends between a base and a tip defining a span length, and wherein the leading wrap, the trailing wrap, and the filler extend the span length of the composite core.

The turbomachine of any preceding clause, wherein the leading wrap extends between a pressure side end and a suction side end, the pressure side end being connected to the pressure sidewall of the trailing wrap and the suction side end being connected to the suction sidewall of the trailing wrap, and wherein the leading wrap is thinner at the leading edge of the leading wrap than at one or both of the pressure side end and the suction side end.

The turbomachine of any preceding clause, wherein the trailing wrap extends between a pressure side end and a suction side end, the pressure side end being connected to the pressure sidewall of the composite core and the suction side end being connected to the suction sidewall of the composite core, and wherein the trailing wrap is thinner at the leading edge of the trailing wrap than at one or both of the pressure side end and the suction side end.

The turbomachine of any preceding clause, wherein: the airfoil further comprises a nose laminate, the nose laminate forming a butt joint with the leading edge of the trailing wrap; and the leading wrap includes a pressure sidewall and a suction sidewall, the pressure sidewall of the leading wrap being connected at least in part to the pressure sidewall of the trailing wrap and at least in part to the nose laminate, the suction sidewall of the leading wrap being connected at least in part to the suction sidewall of the trailing wrap and at least in part to the nose laminate.

The turbomachine of any preceding clause, further comprising a filler positioned between at least one of: the nose laminate and the pressure sidewall of the leading wrap; and the nose laminate and the suction sidewall of the leading wrap.

The turbomachine of any preceding clause, wherein the nose laminate has at least two plies, and wherein at least one ply of the at least two plies of the nose laminate and the trailing wrap have the same thickness.

The turbomachine of any preceding clause, wherein: the leading edge protective wrap is wrapped around the core leading edge and connected to the pressure sidewall and the suction sidewall of the composite core, the leading edge protective wrap being formed of a 3D woven material; the leading edge protective wrap has a leading edge, a pressure sidewall connected to the pressure sidewall of the composite core, and a suction sidewall connected to the suction sidewall of the composite core; and the pressure sidewall of the leading edge protective wrap tapers from a pressure taper point positioned along the pressure sidewall of the leading edge protective to a pressure side end of the leading edge protective wrap and the suction sidewall of the leading edge protective wrap tapers from a suction taper point positioned along the suction sidewall of the leading edge protective to a suction side end of the leading edge protective wrap.

A turbomachine comprising: an annular casing; a fan disposed inside the annular casing and mounted for rotation about an axial centerline, the fan including fan blades that extend radially outwardly toward the annular casing; and an airfoil comprising a composite core having a pressure sidewall and a suction sidewall extending between a core leading edge and a core trailing edge and a leading edge protective wrap; wherein the fan includes a fan hub-to-tip ratio ("HTR"), a fan blade count ("BC"), a fan pressure ratio ("FPR"), and a redline corrected fan tip Mach number $$(\text{“}M_{tip,c}^{(RL)}\text{”})$$

according to a Second Performance Factor ("SPF"), wherein $$SPF = \sqrt{\frac{\pi}{4}(1 - HTR^2)\Big/\left(\frac{BC}{20}\right)}\Big/\left(\frac{\sqrt{FPR-1}}{\sqrt{0.4}}\right)\Big/M_{tip,c}^{(RL)} - 0.97,$$

wherein $$m_3 \cdot \left[M_{tip,c}^{(RL)} - 1.1\right] + 2.52 > SPF > m_4 \cdot \left[M_{tip,c}^{(RL)} - 1.1\right]$$

wherein $m_3$ is equal to 3.17, and wherein $m_4$ is equal to 0.41 when $$M_{tip,c}^{(RL)}$$

is greater than or equal to 1.1 and is equal to 0.55 when $$M_{tip,c}^{(RL)}$$

is less than 1.1.

The turbomachine of any preceding clause, wherein SPF is within a range equal to or greater than 0.087 and equal to or less than 2.4.

The turbomachine of any preceding clause, wherein SPF is within a range equal to or greater than 1 and equal to or less than 2.

The turbomachine of any preceding clause, wherein $$M_{tip,c}^{(RL)}$$

is within a range equal to or greater than 0.8 and equal to or less than 1.5.

The turbomachine of any preceding clause, wherein $$M_{tip,c}^{(RL)}$$

is within a range equal to or greater than 0.9 and equal to or less than 1.4.

The turbomachine of any preceding clause, wherein HTR is within a range equal to or greater than 0.2 and equal to or less than 0.4.

The turbomachine of any preceding clause, wherein HTR is within a range equal to or greater than 0.25 and equal to or less than 0.35.

The turbomachine of any preceding clause, wherein FPR is within a range equal to or greater than 1.2 and equal to or less than 1.6.

The turbomachine of any preceding clause, wherein FPR is within a range equal to or greater than 1.3 and equal to or less than 1.5.

The turbomachine of any preceding clause, wherein FPR is within a range equal to or greater than 1.35 and equal to or less than 1.45.

The turbomachine of any preceding clause, wherein BC is within a range equal to or greater than 3 and equal to or less than 18.

The turbomachine of any preceding clause, wherein BC is within a range equal to or greater than 10 and equal to or less than 16.

The turbomachine of any preceding clause, wherein the turbomachine has a gear ratio within a range equal to or greater than 3.2 and equal to or less than 5.0.

The turbomachine of any preceding clause, wherein the fan blade includes an airfoil portion made from a polymer matrix composite (PMC) material, a metallic leading edge, the ratio c/D is between 0.16 and 0.21, and the fan has between 16 and 25 fan blades.

A turbomachine for an aircraft comprising: an annular casing; a fan disposed inside the annular casing and mounted for rotation about an axial centerline, the fan including fan blades that extend radially outwardly toward the annular casing; and an airfoil comprising a composite core having a pressure sidewall and a suction sidewall extending between a core leading edge and a core trailing edge and a leading edge protective wrap; wherein the fan includes an average fan chord width of the fan blades ("c"), a diameter of the fan ("D"), a fan pressure ratio ("FPR"), and a redline corrected fan tip Mach number $$(\text{“}M_{tip,c}^{(RL)}\text{”})$$

according to a First Performance Factor ("FPF"), wherein $$FPF = \left[\frac{c}{0.15 \cdot D}\right]\Big/\left[\left[\frac{\sqrt{FPR-1}}{\sqrt{0.4}}\right]\Big/M_{tip,c}^{(RL)}\right] - 1.23,$$

wherein $$m_1 \cdot \left[M_{tip,c}^{(RL)} - 1.1\right] + 9.14 > FPF > m_2 \cdot \left[M_{tip,c}^{(RL)} - 1.1\right],$$

and wherein $m_1$ is equal to 9.43 when $$M_{tip,c}^{(RL)}$$

is greater than or equal to 1.1 and is equal to 27.02 when $$M_{tip,c}^{(RL)}$$

is less than 1.1, and wherein $m_2$ is equal to 0.87 when $$M_{tip,c}^{(RL)}$$

is greater than or equal to 1.1 and is equal to 3.34 when $$M_{tip,c}^{(RL)}$$

is less than 1.1; wherein the fan includes a fan hub-to-tip ratio ("HTR"), a fan blade count ("BC"), the fan pressure ratio ("FPR"), and the redline corrected fan tip Mach number $$(\text{“}M_{tip,c}^{(RL)}\text{”})$$

according to a Second Performance Factor ("SPF"), wherein $$SPF = \sqrt{\frac{\pi}{4}(1 - HTR^2)} \Big/ \left(\frac{BC}{20}\right) \Big/ \left(\frac{\sqrt{FPR - 1}}{\sqrt{0.4}}\right) \Big/ M_{tip,c}^{(RL)} - 0.97,$$

wherein $$m_3 \cdot \left[M_{tip,c}^{(RL)} - 1.1\right] + 2.52 > SPF > m_4 \cdot \left[M_{tip,c}^{(RL)} - 1.1\right]$$

wherein $m_3$ is equal to 3.17, and wherein $m_4$ is equal to 0.41 when $$M_{tip,c}^{(RL)}$$

is greater than or equal to 1.1 and is equal to 0.55 when $$M_{tip,c}^{(RL)}$$

is less than 1.1.

The turbomachine of any preceding clause, wherein FPF is within a range equal to or greater than −0.8 and equal to or less than 8.4.

The turbomachine of any preceding clause, wherein FPF is within a range equal to or greater than 0 and equal to or less than 6.

The turbomachine of any preceding clause, wherein FPF is within a range equal to or greater than 1 and equal to or less than 2.

The turbomachine of any preceding clause, wherein SPF is within a range equal to or greater than 0.087 and equal to or less than 2.4.

The turbomachine of any preceding clause, wherein SPF is within a range equal to or greater than 1 and equal to or less than 2.

The turbomachine of any preceding clause, wherein $$M_{tip,c}^{(RL)}$$

is within a range equal to or greater than 0.8 and equal to or less than 1.5.

The turbomachine of any preceding clause, wherein $$M_{tip,c}^{(RL)}$$

is within a range equal to or greater than 0.9 and equal to or less than 1.4.

The turbomachine of any preceding clause, wherein ratio c/D is within a range equal to or greater than 0.1 and equal to or less than 0.3.

The turbomachine of any preceding clause, wherein HTR is within a range equal to or greater than 0.2 and equal to or less than 0.4.

The turbomachine of any preceding clause, wherein HTR is within a range equal to or greater than 0.25 and equal to or less than 0.35.

The turbomachine of any preceding clause, wherein FPR is within a range equal to or greater than 1.2 and equal to or less than 1.6.

The turbomachine of any preceding clause, wherein FPR is within a range equal to or greater than 1.3 and equal to or less than 1.5.

The turbomachine of any preceding clause, wherein FPR is within a range equal to or greater than 1.35 and equal to or less than 1.45.

The turbomachine of any preceding clause, wherein BC is within a range equal to or greater than 3 and equal to or less than 18.

The turbomachine of any preceding clause, wherein BC is within a range equal to or greater than 10 and equal to or less than 16.

The turbomachine of any preceding clause, wherein the turbomachine has a gear ratio within a range equal to or greater than 3.2 and equal to or less than 5.0.

The turbomachine of any preceding clause, wherein the fan blade includes an airfoil portion made from a polymer matrix composite (PMC) material, a metallic leading edge, the ratio c/D is between 0.16 and 0.21, and the fan has between 16 and 25 fan blades.

What is claimed is:

1. A turbomachine for an aircraft comprising:

an annular casing;

a fan disposed inside the annular casing and mounted for rotation about an axial centerline, the fan including fan blades that extend radially outwardly toward the annular casing; and an airfoil comprising a composite core having a pressure sidewall and a suction sidewall extending between a core leading edge and a core trailing edge and a leading edge protective wrap;

wherein the fan includes an average fan chord width of the fan blades ("c"), a diameter of the fan ("D"), a fan pressure ratio ("FPR"), and a redline corrected fan tip Mach number $$(\text{“}M_{tip,c}^{(RL)}\text{”})$$

according to a First Performance Factor ("FPF"), wherein $$FPF = \left[\frac{c}{0.15 \cdot D}\right] \Big/ \left[\left[\frac{\sqrt{FPR - 1}}{\sqrt{0.4}}\right] \Big/ M_{tip,c}^{(RL)}\right] - 1.23,$$

wherein $$m_1 \cdot \left[M_{tip,c}^{(RL)} - 1.1\right] + 9.14 > FPF > m_2 \cdot \left[M_{tip,c}^{(RL)} - 1.1\right],$$

and wherein $m_1$ is equal to 9.43 when $$M_{tip,c}^{(RL)}$$

is greater than or equal to 1.1 and is equal to 27.02 when $$M_{tip,c}^{(RL)}$$

is less than 1.1, and wherein $m_2$ is equal to 0.87 when $$M_{tip,c}^{(RL)}$$

is greater than or equal to 1.1 and is equal to 3.34 when $$M_{tip,c}^{(RL)}$$

is less than 1.1.

2. The turbomachine of claim 1, wherein:

FPF is within a range equal to or greater than −0.8 and equal to or less than 8.4;

$$M_{tip,c}^{(RL)}$$

is within a range equal to or greater than 0.8 and equal to or less than 1.5;

a ratio c/D is within a range equal to or greater than 0.1 and equal to or less than 0.3; and FPR is within a range equal to or greater than 1.2 and equal to or less than 1.6.

3. The turbomachine of claim 1, wherein the turbomachine has a gear ratio within a range equal to or greater than 3.2 and equal to or less than 5.0.

4. The turbomachine of claim 1, wherein one or more of the fan blades includes an airfoil portion made from a polymer matrix composite (PMC) material, a ratio c/D is between 0.16 and 0.21, and the fan has between 16 and 25 fan blades.

5. The turbomachine of claim 1, wherein the leading edge protective wrap comprises:

a trailing wrap wrapped around the core leading edge and connected to the pressure sidewall and the suction sidewall of the composite core, the trailing wrap having a leading edge and having a pressure sidewall and a suction sidewall, and a leading wrap wrapped around the core leading edge and the leading edge of the trailing wrap and connected to the pressure sidewall and the suction sidewall of the trailing wrap, the leading wrap having a leading edge that is spaced from the leading edge of the trailing wrap.

6. The turbomachine of claim 5, wherein:

the leading wrap is connected to the pressure sidewall and the suction sidewall of the trailing wrap;

the leading edge of the leading wrap is spaced from the leading edge of the trailing wrap;

the airfoil further comprises a filler positioned between the leading edge of the trailing wrap and the leading edge of the leading wrap; and the airfoil further comprises a protective nose connected to the leading edge of the leading wrap.

7. The turbomachine of claim 6, wherein:

the trailing wrap and the leading wrap are formed of a non-metallic material;

the non-metallic material is a fibrous composite material; and the fibrous composite material is formed of at least one of an S-glass, carbon, E-glass, and Kevlar material.

8. The turbomachine of claim 6, wherein the trailing wrap has a first thickness and the leading wrap has a second thickness that is less thick than the first thickness.

9. The turbomachine of claim 6, wherein:

the composite core defines a pressure sidewall camber distance and a suction sidewall camber distance, the pressure sidewall camber distance spans between the core leading edge and the core trailing edge along the pressure sidewall of the composite core and the suction sidewall camber distance spans between the core leading edge and the core trailing edge along the suction sidewall of the composite core, and the trailing wrap is wrapped around the core leading edge of the composite core such that the trailing wrap extends from the core leading edge at least twenty percent of the pressure sidewall camber distance and from the core leading edge at least twenty percent of the suction sidewall camber distance.

10. The turbomachine of claim 6, wherein at least one of the leading wrap and the trailing wrap has fibers that wrap unbroken around the core leading edge.

11. The turbomachine of claim 6, wherein the filler is formed of at least one of a resin, an adhesive, composite tows, a 2D weave, a 3D weave, rolled fibers, and a preform.

12. The turbomachine of claim 6, wherein the composite core extends between a base and a tip defining a span length, and wherein the leading wrap, the trailing wrap, and the filler extend the span length of the composite core.

13. The turbomachine of claim 6, wherein the leading wrap extends between a pressure side end and a suction side end, the pressure side end being connected to the pressure sidewall of the trailing wrap and the suction side end being connected to the suction sidewall of the trailing wrap, and wherein the leading wrap is thinner at the leading edge of the leading wrap than at one or both of the pressure side end and the suction side end.

14. The turbomachine of claim 6, wherein the trailing wrap extends between a pressure side end and a suction side end, the pressure side end being connected to the pressure sidewall of the composite core and the suction side end being connected to the suction sidewall of the composite core, and wherein the trailing wrap is thinner at the leading edge of the trailing wrap than at one or both of the pressure side end and the suction side end.

15. The turbomachine of claim 5, wherein:

the airfoil further comprises a nose laminate, the nose laminate forming a butt joint with the leading edge of the trailing wrap; and the leading wrap includes a pressure sidewall and a suction sidewall, the pressure sidewall of the leading wrap being connected at least in part to the pressure sidewall of the trailing wrap and at least in part to the nose laminate, the suction sidewall of the leading wrap being connected at least in part to the suction sidewall of the trailing wrap and at least in part to the nose laminate.

16. The turbomachine of claim 15, further comprising a filler positioned between at least one of:

the nose laminate and the pressure sidewall of the leading wrap; and the nose laminate and the suction sidewall of the leading wrap.

17. The turbomachine of claim 15, wherein the nose laminate has at least two plies, and wherein at least one ply of the at least two plies of the nose laminate and the trailing wrap have the same thickness.

18. The turbomachine of claim 1, wherein:

the leading edge protective wrap is wrapped around the core leading edge and connected to the pressure sidewall and the suction sidewall of the composite core, the leading edge protective wrap being formed of a 3D woven material;

the leading edge protective wrap has a leading edge, a pressure sidewall connected to the pressure sidewall of the composite core, and a suction sidewall connected to the suction sidewall of the composite core; and the pressure sidewall of the leading edge protective wrap tapers from a pressure taper point positioned along the pressure sidewall of the leading edge protective to a pressure side end of the leading edge protective wrap and the suction sidewall of the leading edge protective wrap tapers from a suction taper point positioned along the suction sidewall of the leading edge protective to a suction side end of the leading edge protective wrap.

19. A turbomachine comprising:

an annular casing;

a fan disposed inside the annular casing and mounted for rotation about an axial centerline, the fan including fan blades that extend radially outwardly toward the annular casing; and an airfoil comprising a composite core having a pressure sidewall and a suction sidewall extending between a core leading edge and a core trailing edge and a leading edge protective wrap;

wherein the fan includes a fan hub-to-tip ratio ("HTR"), a fan blade count ("BC"), a fan pressure ratio ("FPR"), and a redline corrected fan tip Mach number $$(\text{“}M_{tip,c}^{(RL)}\text{”})$$

according to a Second Performance Factor ("SPF"), wherein $$SPF = \sqrt{\frac{\pi}{4}(1 - HTR^2)\Big/\left(\frac{BC}{20}\right)}\Big/\left(\frac{\sqrt{FPR-1}}{\sqrt{0.4}}\right)\Big/M_{tip,c}^{(RL)} - 0.97,$$

wherein $$m_3 \cdot \left[M_{tip,c}^{(RL)} - 1.1\right] + 2.52 > SPF > m_4 \cdot \left[M_{tip,c}^{(RL)} - 1.1\right]$$

wherein $m_3$ is equal to 3.17, and wherein $m_4$ is equal to 0.41 when $$M_{tip,c}^{(RL)}$$

is greater than or equal to 1.1 and is equal to 0.55 when $$M_{tip,c}^{(RL)}$$

is less than 1.1.

20. A turbomachine for an aircraft comprising:

an annular casing;

a fan disposed inside the annular casing and mounted for rotation about an axial centerline, the fan including fan blades that extend radially outwardly toward the annular casing; and an airfoil comprising a composite core having a pressure sidewall and a suction sidewall extending between a core leading edge and a core trailing edge and a leading edge protective wrap;

wherein the fan includes an average fan chord width of the fan blades ("c"), a diameter of the fan ("D"), a fan pressure ratio ("FPR"), and a redline corrected fan tip Mach number $$(\text{“}M_{tip,c}^{(RL)}\text{”})$$

according to a First Performance Factor ("FPF"), wherein $$FPF = \left[\frac{c}{0.15 \cdot D}\right]\Big/\left[\left[\frac{\sqrt{FPR-1}}{\sqrt{0.4}}\right]\Big/M_{tip,c}^{(RL)}\right] - 1.23,$$

wherein $$m_1 \cdot \left[M_{tip,c}^{(RL)} - 1.1\right] + 9.14 > FPF > m_2 \cdot \left[M_{tip,c}^{(RL)} - 1.1\right],$$

and wherein $m_1$ is equal to 9.43 when $$M_{tip,c}^{(RL)}$$

is greater than or equal to 1.1 and is equal to 27.02 when $$M_{tip,c}^{(RL)}$$

is less than 1.1, and wherein $m_2$ is equal to 0.87 when $$M_{tip,c}^{(RL)}$$

is greater than or equal to 1.1 and is equal to 3.34 when $$M_{tip,c}^{(RL)}$$

is less than 1.1;

wherein the fan includes a fan hub-to-tip ratio ("HTR"), a fan blade count ("BC"), the fan pressure ratio ("FPR"), and the redline corrected fan tip Mach number $$(\text{“}M_{tip,c}^{(RL)}\text{”})$$

according to a Second Performance Factor ("SPF"), wherein $$SPF = \sqrt{\frac{\pi}{4}(1 - HTR^2)\Big/\left(\frac{BC}{20}\right)}\Big/\left(\frac{\sqrt{FPR - 1}}{\sqrt{0.4}}\right)\Big/M_{tip,c}^{(RL)} - 0.97,$$

wherein $$m_2 \cdot \left[M_{tip,c}^{(RL)} - 1.1\right] + 2.52 > SPF > m_4 \cdot \left[M_{tip,c}^{(RL)} - 1.1\right]$$

wherein $m_3$ is equal to 3.17, and wherein $m_4$ is equal to 0.41 when $$M_{tip,c}^{(RL)}$$

is greater than or equal to 1.1 and is equal to 0.55 when $$M_{tip,c}^{(RL)}$$

is less than 1.1.

* * * * *